US007192694B2

(12) United States Patent
Nariyuki

(10) Patent No.: US 7,192,694 B2
(45) Date of Patent: Mar. 20, 2007

(54) PHOTOTHERMOGRAPHIC MATERIAL

(75) Inventor: Fumito Nariyuki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/702,440

(22) Filed: Nov. 7, 2003

(65) Prior Publication Data

US 2004/0096785 A1 May 20, 2004

(30) Foreign Application Priority Data

Nov. 12, 2002 (JP) ..... 2002-327943

(51) Int. Cl.
*G03C 5/16* (2006.01)
*G03C 1/498* (2006.01)

(52) U.S. Cl. ..... 430/350; 430/607; 430/610; 430/619; 430/620

(58) Field of Classification Search ..... 430/619, 430/350, 607, 610, 567, 620
See application file for complete search history.

(56) References Cited

U.S. PATENT DOCUMENTS

| | | | | |
|---|---|---|---|---|
| 4,332,889 | A * | 6/1982 | Siga et al. | 430/583 |
| 4,672,026 | A * | 6/1987 | Daubendiek | 430/495.1 |
| 5,698,380 | A * | 12/1997 | Toya | 430/363 |
| 5,747,235 | A * | 5/1998 | Farid et al. | 430/583 |
| 5,998,126 | A * | 12/1999 | Toya et al. | 430/619 |
| 6,143,488 | A | 11/2000 | Uytterhoeven et al. | |
| 6,787,298 | B2 * | 9/2004 | Goto et al. | 430/619 |
| 2003/0194659 | A1 * | 10/2003 | Ohzeki et al. | 430/350 |
| 2003/0194667 | A1 * | 10/2003 | Nariyuki | 430/619 |
| 2003/0207216 | A1 * | 11/2003 | Fukui et al. | 430/350 |
| 2003/0235794 | A1 * | 12/2003 | Yoshioka | 430/566 |
| 2004/0038161 | A1 * | 2/2004 | Ohzeki | 430/619 |

FOREIGN PATENT DOCUMENTS

| | | | |
|---|---|---|---|
| EP | 1096310 | A2 * | 5/2001 |
| EP | 1220026 | * | 2/2002 |
| WO | WO 97/48015 | | 12/1997 |

* cited by examiner

*Primary Examiner*—Thorl Chea
(74) *Attorney, Agent, or Firm*—Margaret A. Burke; Sheldon J. Moss

(57) ABSTRACT

A photothermographic material containing, on a substrate, at least a photosensitive silver halide, a non-photosensitive organic silver salt, a reducing agent and a binder in which the total silver iodide content of the photosensitive silver halide is 40 mol % or more and 100 mol % or less, and the coating amount of the photosensitive silver halide, in terms of an amount of silver, is 0.0005 g/m$^2$ or more and 0.4 g/m$^2$ or less, as well as an image forming method for the photothermographic material which comprises exposing the photothermographic material by using a semiconductor laser having an emission peak intensity at a wavelength of from 350 nm to 450 nm as a light source.

11 Claims, 1 Drawing Sheet

PHOTOTHERMOGRAPHIC MATERIAL

CROSS-REFERENCE TO RELATED APPLICATIONS

This application claims priority to Japanese patent application number 2002-327,943 filed Nov. 12, 2002, the disclosure of which is incorporated herein by reference.

BACKGROUND OF THE PRESENT INVENTION

1. Field of the Related Art

The present invention concerns a photothermographic material and an image forming method using the photothermographic material.

2. Description of the Related Art

In recent years, there has been a strong demand to decrease the volume of liquid processing wastes in the medical field both for environmental protection and economy of space. In order to use photothermographic materials in medical diagnosis and photographic techniques they must be capable of being exposed efficiently by laser image setters or laser imagers; further the materials must be capable of forming clear black images having high resolution and sharpness. With photothermographic materials, thermal development processing systems can be used that eliminate the use of solution system processing chemicals, have a more simple construction and do not deteriorate environments.

While such requirements exist also in the field of general image forming materials, in medical imaging, high image quality with excellent sharpness and grainin are particularly required since fine expression is needed; blue black image tone are preferred to facilitate diagnosis. At present, various kinds of hard copy systems that utilize pigments and dyes such as ink jet printers or electrophotography have been marketed as conventional image forming systems, but they are not satisfactory as image output systems for medical use.

Thermal image forming systems utilizing organic silver salts are described in the literature. In general, a photothermographic material has an image forming layer and the image forming layer contains a catalytically active amount of photocatalyst (for example, silver halide), a reducing agent, a reducible silver salt (for example, organic silver salt) and, optionally, a color toning agent for controlling the tone of silver dispersed in a binder matrix. The photothermographic material, when heated to a high temperature (for example, 80° C. or higher) after imagewise exposure, forms black silver images by oxidation/reduction reaction between a silver halide or reducible silver salt (functioning as an oxidizer) and a reducing agent. The oxidation/reduction reaction is promoted by the catalytic effect of latent images of the silver halide formed by exposure. Accordingly, black silver images are formed in an exposed region.

Fuji Medical Dry Imager FM-DPL has been sold as a medical image forming system using the photothermographic material.

Production of the thermal image forming systems utilizing the organic silver salt includes a method of production by solvent coating, and a method of production by coating and drying a coating solution containing, as an aqueous dispersion, with fine polymer particles as a main binder. Since the latter method does not require steps such as recovery of the solvent, production facilities are simple and it is advantageous in mass production.

Since the image forming system utilizing the organic silver salt described above has no fixing step, there is a significant problem of worsening print out, particularly when light is applied. U.S. Pat. No. 6,143,488 and EP-No. 0922995 disclose methods of utilizing AgI formed by conversion of organic silver salts as a means for improving the print out. However, no sufficient sensitivity could be obtained by the method of converting organic silver salts with iodine as described therein and it was difficult to obtain an actual system.

In addition, photosensitive materials using AgI are disclosed, for example, in International Publications Nos. 97-48014 and 97-48015, U.S. Pat. No. 6,165,705, and Japanese Patent Application Laid-open (JP-A) No. 8-297345 and JP No. 2785129 but none of them could attain a sufficient sensitivity/fog level and was not durable for practical use as laser exposure photosensitive materials. While JP-A No. 2000-305213 discloses an image forming method using blue-ultra violet laser light and photosensitive material, it does not use AgI and is insufficient in view of the sensitivity.

Therefore, there is a need in the art for the development of improved photothermographic materials that suppress the occurrence of fogging or print out while not lowering the sensitivity.

SUMMARY OF THE PRESENT INVENTION

The present invention provides an image forming material with less scattering of sensitivity and color tone depending on the developing time and having favorable color tone storability. It provides stable output images of reduced scattering for the sensitivity and the color tone caused by scattering of the developing time.

The present invention has been achieved by the following photothermographic material.

In a first aspect, a photothermographic material includes, on a substrate, at least a photosensitive silver halide, a non-sensitive organic silver salt, a reducing agent and a binder in which the total silver iodide content of the photosensitive silver halide is 40 mol % or more and 100 mol % or less, and the coating amount of the photosensitive silver halide in terms of an amount of silver is 0.0005 g/m$^2$ or more and 0.4 g/m$^2$ or less.

The present invention further provides, in a second aspect, an image forming method for a photothermographic material which comprises exposing the photothermographic material by using a semiconductor laser having an emission peak intensity at a wavelength of from 350 nm to 450 nm as a light source.

A third aspect of the present invention is a photothermographic material in the first feature, wherein the photosensitive silver halide is formed in a state where the non-photosensitive organic silver salt is not present.

A fourth aspect of the present invention is a photothermographic material in the first feature, wherein the total silver iodide content is 90 mol % or more and 100 mol % of less.

A fifth aspect of the present invention is a photothermographic material in the first feature, wherein the coating amount of the photosensitive silver halide, as an amount of silver, is 0.005 g/m$^2$ or more and 0.1 g/m$^2$ or less.

A sixth aspect of the present invention is a photothermographic material in the first feature, wherein the coating amount of the photosensitive silver halide, as an amount of silver, is 0.005 g/m2 or more and 0.05 g/m$^2$ or less.

A seventh aspect of the present invention is a photothermographic material in the first feature, wherein the average particle size of the photosensitive silver halide is 5 nm or more and 50 nm or less.

An eighth aspect of the present invention is a photothermographic material in the first feature, wherein the reducing agent contains a compound represented by the general formula (R):

General formula (R)

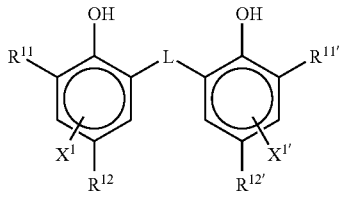

in which $R^{11}$ and $R^{11'}$ each represents independently an alkyl group of 1 to 20 carbon atoms, $R^{12}$ and $R^{12'}$ each represents independently an alkyl group of 1 to 20 carbon atoms, L represents a —S— group or —$CHR^{13}$— group, $R^{13}$ represents a hydrogen atom or an alkyl group of 1 to 20 carbon atoms, and $X^1$ and $X^{1'}$ each represents independently a hydrogen atom or a group capable of substitution on a benzene ring.

A ninth aspect of the present invention is a photothermographic material in the eighth feature, wherein $R^{11}$ and $R^{11'}$ in the general formula (R) each represents independently a secondary or tertiary alkyl group of 3 to 15 carbon atoms.

A tenth aspect of the present invention is a photothermographic material in the first feature, which further comprising a compound represented by the following general formula (H):

$$Q—(Y)N—C(Z_1)(Z_2)X \qquad \text{General formula (H)}$$

in which Q represents an alkyl group, aryl group or heterocyclic group, Y represents a bivalent connection group, N represents 0 or 1, $Z_1$ and $Z_2$ each represents a halogen atom, and X represents a hydrogen atom or an electron attractive group.

An eleventh aspect of the present invention is a photothermographic material in the first feature, wherein the average particle size of the photosensitive silver halide is 5 nm or more and 40 nm or less.

A twelfth aspect of the present invention is a photothermographic material in the first feature, wherein the average γ-phase ratio of the photosensitive silver halide is 5 mol % or more and 90 mol % or less.

A thirteenth aspect of the present invention is a photothermographic material in the first feature, wherein the average γ-phase ratio of the photosensitive silver halide is 25 mol % or more and 50 mol % or less.

A fourteenth aspect of the present invention is a photothermographic material in the first feature, further comprising a compound in which a one-electron oxidant formed by one-electron oxidation can release one electron or more electrons.

A fifteenth aspect of the present invention is a photothermographic material in the first feature, the non-photosensitive organic silver salt contains silver behenate by 40 mol % or more and 99 mol % or less.

A sixteenth aspect of the present invention is a photothermographic material in the first feature, wherein the non-photosensitive organic silver salt contains silver behenate by 65 mol % or more and 85 mol % or less.

A seventeenth aspect of the present invention is a photothermographic material in the first feature, further comprising a development accelerator.

An eighteenth aspect of the present invention is a photothermographic material in the first feature, further comprising a compound represented by the following general formula (D):

General formula (D)

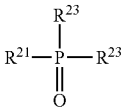

in which $R^{21}$ to $R^{23}$ each represents independently an alkyl group, aryl group, alkoxy group, aryloxy group, amino group or heterocyclic group.

Further, the aspect of the image forming method for the photothermographic material according to the present invention includes 19th to 20th features as shown below.

A nineteenth aspect of the present invention is an image forming method for a photothermographic material according to the second feature wherein, the exposure illuminance of the semiconductor laser is 1 $mW/mm^2$ or more.

A twentieth aspect of the present invention is an image forming method for a photothermographic material according to the second feature wherein, the exposure illuminance of the semiconductor laser is 10 $mW/mm^2$ or more and 50 $mW/mm^2$ or less.

The present inventors, as a result of earnest study, have found that development is suppressed by the dissolution of silver halide as the silver iodide content in the photosensitive silver halide increases. As a result, in a case where a sample with a low silver iodide content and a sample with a high content are developed for an identical developing time, the sensitivity was reduced apparently in the latter.

In the present invention, the foregoing problem has been solved by reducing the suppression of development by decreasing the coating amount of the photosensitive silver halide of high silver iodide content thereby improving the development progress. That is, apparent sensitivity has been improved by the completion of development in a short time. Further, improvement of the development progress can provide excellent photothermographic material of excellent image output stability with less variation in the sensitivity and the color tone even when the developing time fluctuates due to the scattering in conveyance.

Further, while the addition amount of the silver halide in the photothermographic material is determined properly while taking blending with other compositions into consideration, since excess addition of silver halide brings about fogging, it is desirable that the addition amount of the silver halide is as small as possible so long as image can be formed. Further, decrease of the entire coating amount of silver leads to an advantageous reduction in cost.

Accordingly, lowering of the coating amount of the photosensitive silver halide can suppress degradation of the development progress, which results in prevention of fogging and stable image output.

On the other hand, deterioration of image quality due to the decrease of the photosensitive site may be considered as a problem in a case of decreasing the coating amount of the photosensitive silver halide but the problem can be solved by decreasing the particle size of the photosensitive silver halide as in the seventh aspect of the present invention. That is, although the total coating amount of the photosensitive silver halide is decreased, this has not decreased the number of photosensitive sites forming latent images but rather has succeeded in increasing the number thereof. This can improve the image quality.

Further, a method of preparing a photosensitive silver halide has been studied as a means for improving the sensitivity to reach the third aspect of the present invention.

Further, the sensitivity is improved by using the second aspect of the present invention described above utilizing the light absorption condition inherent to silver iodide and increasing the sensitivity by exposure using a semiconductor laser having an emission peak intensity at a wavelength from 350 nm to 450 nm as a light source.

In addition, since the photothermographic material forms black silver images by oxidation/reduction reaction between a silver halide and a reducing agent, a technique capable of improving the development activity and improving the apparent sensitivity by making the reducing agent highly reactive has also been introduced as in the eighth and ninth aspect of the present invention.

As described above, by restricting the total silver iodide content of the photosensitive silver halide to 40 mol % or more and 100 mol % or less and restricting the coating amount of the photosensitive silver halide, in terms of an amount of silver, to 0.0005 g/m$^2$ or more and 0.4 g/m$^2$ or less, it has been found that occurrence of fogging or print out can be suppressed and lowering of the sensitivity can be suppressed, as well as that an unexpected effect can also be obtain that the color the color tone storability are favorable with less scattering of the sensitivity depending on the developing time.

DETAILED DESCRIPTION OF THE PRESENT INVENTION

1. Photothermographic Material

Figure 1:
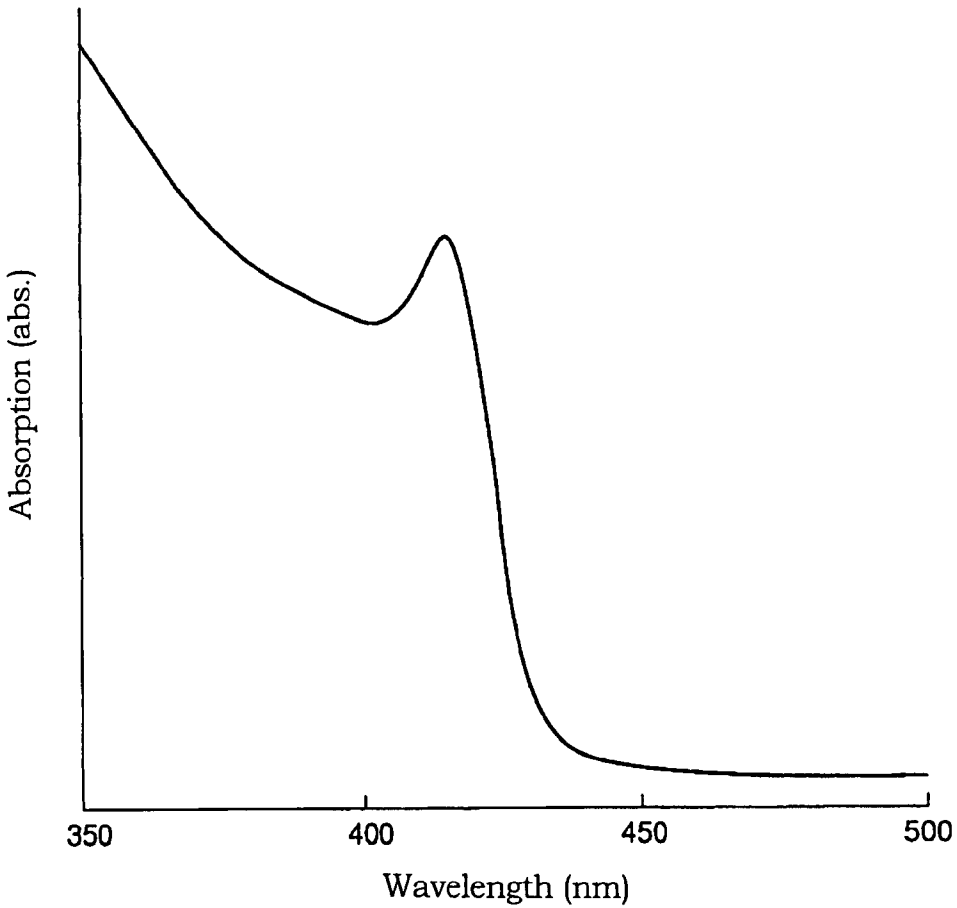
FIG. 1 is a graph showing a light absorption of a silver iodide emulsion used in the present invention.

The photothermographic material according to the present invention contains, on a substrate, at least a photosensitive silver halide, a non-sensitive organic silver salt, a reducing agent and a binder in which the total silver iodide content of the photosensitive silver halide is 40 mol % or more and 100 mol % or less, and the coating amount of the photosensitive silver halide as an amount of silver is 0.005 g/m$^2$ or more and 0.4 g/m$^2$ or less.

The photothermographic material of the present invention having the features described above can provide an image forming material with much less fluctuation in sensitivity depending on the developing time and having favorable color tone and color tone storability.

Each of the constituent components in the photothermographic material according to the present invention is to be described specifically.

1-1 Photosensitive Silver Halide

A portion of the silver halide in the present invention preferably has a layer of absorbing light by direct transition. It has been well-known that absorption by direct transition can be attained at 350 nm to 450 nm as an exposure wavelength used in the present invention by providing a high silver iodide structure having a hexagonal system wurtzite structure or tetragonal system zinc blende structure. However, silver halide having such an absorption structure is generally low in sensitivity and of less utility value with a photographic industrial point of view.

1) Exposure Illuminance

According to the study of the present inventors, high sensitivity and high sharpness can be attained with such a high silver iodide content photosensitive material in a photothermographic material having a non-photosensitive organic acid silver salt and a reducing agent, by conducting exposure at a high illuminance (1 mW/mm$^2$ or more) in a short time (1 sec or less, preferably, $10^{-2}$ sec or less and, further preferably, $10^{-4}$ sec or less).

2) Exposure Wavelength

The silver halide in the present invention preferably shows direct transition absorption derived from the silver iodide crystal structure to a wavelength between 350 nm and 450 nm. Whether the silver halide has light absorption of direct transition or not can be distinguished easily based on the observation of exciton absorption due to direct transition near 400 nm to 430 nm.

FIG. 1 shows light absorption of a silver iodide emulsion used preferably in the present invention. It can be seen that absorption of high silver iodide due to exciton can be observed near 420 nm.

While the direct transition light absorption type high silver iodide phase may be present alone but it is used preferably with a silver halide showing indirect transition absorption in a wavelength region from 350 nm to 450 nm such as a silver bromide emulsion, silver chloride emulsion, silver iodobromide emulsion, silver iodochloride, or a mixed crystal thereof.

While the silver halide phase absorbing light by direct transition generally shows an intense light absorption, it is less sensitive compared with the indirect transition type silver halide phase showing only weak absorption and has not been used commercially.

The exposure wavelength is, preferably, from 370 nm to 430 nm, more preferably, from 390 nm to 430 nm and particularly preferably, from 390 nm to 420 nm.

3) Halogen Composition

The photosensitive silver halide in the present invention has a total silver iodide content of 40 mol % or more and 100 mol % or less. Preferably, it is 90 mol % or more and 100 mol % or less. A higher total silver iodide content is more preferred.

4) Particle Size

The photosensitive silver halide in the present invention provides more preferred characteristics when the particle size is 5 nm or more and 50 nm or less. It is, more preferably, 5 nm or more to 45 nm or less and, further preferably, 5 nm or more and 40 nm or less and, further more preferably, 5 nm or more and 30 nm or less. The particle size means herein a diameter of an assumed sphere having a volume identical with that of a silver halide particle.

5) Particle Forming Method

The method of forming the photosensitive silver halide is well-known in the relevant field and, for example, a method described in Research Disclosure, 1978, June, No. 17029 or U.S. Pat. No. 3,700,458 can be used. Specifically, a method of preparing a photosensitive silver halide by adding a silver supplying compound and a halogen supplying compound in gelatin or other polymer solution and then mixing the same with an organic silver salt is used. Further, a method described in JP-A No. 11-119374, column Nos. 0217 to 0224, and methods described in JP-A Nos. 11-352627 and 2000-347335 are also preferred.

6) Particle Shape

The shape of the silver halide particles usable in the present invention can include, for example, cuboid, octahedron, dodecahedron, tetradecahedron, tabular particle, spherical particle, rod-shape particle and potato-like particle. In the present invention, dodecahedron and tetradecahedron are particularly preferred. The dodecahedral particles means herein a particle having {001}, {1-1 0}, and {101} faces, and the tetradecahedral particle is a particle having {110}, {101}, {100} faces. Both of the dodecahedral and tetrahedral particles can have arbitrary β-phase and γ-phase contents and it is preferable to contain at least the γ-phase and, more preferably, contain an average γ-phase ratio of 5 mol % or more and 90 mol % or less, further preferably, 10 mol % or more and 70 mol % or less and, furthermore preferably, 25 mol % or more and 50 mol % or less.

The γ-phase means a high silver iodide structure having a hexagonal system wurtzite structure and the β-phase means a high silver iodide structure having a cubic system zinc blende structure.

The average γ-phase ratio is determined by using a method proposed by C. R. Berry. The method determines based on a peak ratio of the silver iodide β-phase (100), (101) and (002) and the γ-phase (111) by a powder X-ray diffractiometry and details can be referred, for example, to Physical Review, Volume 161, Number 3, page 848-851, 1967.

7) Heavy Metal

In the present invention, a silver halide particle in which hexacyano metal complex is present to the uppermost surface of the particle is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[IR(CN)_6]^{3-}$, $[CR(CN)_6]^{3-}$, and $[Re(CN)_6]^{3-}$. In the present invention, hexacyano Fe complexes are preferred.

Since the hexacyano complex is present in the form of ion in an aqueous solution, paired cation is not important but it is preferred to use an alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra(n-butyl) ammonium ion) which is miscible with water and suitable to precipitation operation for a silver halide emulsion.

The hexacyano metal complex can be added while being mixed with water, as well as a mixed solvent of water and an appropriate organic solvent miscible with water (for example, alcohols, ethers, glycols, ketones, esters and amides), and gelatin.

The addition amount of the hexacyano metal complex, per one mol of silver, is preferably, $1\times10^{-5}$ mol or more and $1\times10^{-2}$ mol or less and, more preferably, $1\times10^{-4}$ mol or more and $1\times10^{-3}$ or less.

The hexacyano metal is caused to be present on the outermost surface of the silver halide particles, by adding the hexacyano metal complex directly after the completion of the addition of an aqueous solution of silver nitrate used in the formation of particles, and before completion of the charging step, during water washing step, during dispersion step, or before the chemical sensitizing step of conducting chalcogen sensitization such as sulfur sensitization, selenium sensitization and tellurium sensitization and noble metal sensitization such as gold sensitization, or before chemical sensitization. In order not to grow the fine silver halide particles, it is preferred to add the hexacyano metal complex quickly after formation of the particles and it is preferred to be added before the completion of the charging step.

The hexacyano complex may be added after addition of 96 wt % for the total amount of silver nitrate added for formation of particles, and it is more preferably started after addition of 98 wt % and it is particularly preferably started after addition of 99 wt %.

When the hexacyano metal complex is added after addition of an aqueous solution of silver nitrate just before completion of the particle formation, it can be adsorbed to the outermost surface of the silver halide particle and most of the complex form a less soluble salt with silver ions on the surface of the particle. Since the silver salt of hexacyano ferrate (II) is a less soluble salt than AgI, re-dissolution by fine particle can be prevented and fine silver halide particles with smaller particle size can be prepared.

The photosensitive silver halide particles in the present invention can contain metals belonging to the groups 8 to 10 of the periodical table (showing from groups 1 to 18) or metal complexes thereof.

Metals or central metals of metal complexes belonging to groups 8 to 10 of the periodical table are, preferably, rhodium, ruthenium or iridium. The metal complexes may be used each alone or two or more kinds of complexes of homo- or hetero-metals may be used together.

Preferred content per one mol of silver is within a range from $1\times10^{-9}$ mol or more to $1\times10^{-3}$ mol or less.

The heavy metals, metal complexes and the addition methods of them are described in JP-A No. 7-225449, JP-A No. 11-65021 in column Nos. 0018 to 0024 and JP-A No. 11-119374 in column Nos. 0227-0240.

Further, the metal atoms that can be incorporated in the silver halide particles (for example, $[Fe(CN)_6]^{4-}$), a desalting method and a chemical sensitization method of a silver halide emulsion used in the present invention are described in JP-A No. 11-84574 in column Nos. 0046 to 0050, JP-A No. 11-65021 in column Nos. 0025 to 0031, and JP-A No. 11-119374, column Nos. 0242 to 0250.

8) Gelatin

As the gelatin contained in the photosensitive silver halide emulsion used in the present invention, various kinds of gelatins can be used. For favorably keeping the dispersion state of the photosensitive silver halide emulsion in the coating solution containing the organic silver salt, a low molecular weight gelatin having a molecular weight of 500 to 60,000 is used preferably. The low molecular weight gelatin may be used upon formation of particles or upon dispersion after the desalting treatment but it is preferably used upon dispersion after the desalting treatment.

9) Chemical Sensitization

Various compounds known as the super sensitizer can be used with an aim of increasing the inherent sensitivity. The compound used in the present invention can include those compounds described, for example, in EP-A No. 587338, U.S. Pat. Nos. 3,877,943 and 4,873,184, JP-A Nos. 5-341432, 11-109547 and 10-111543.

The photosensitive silver halide particles in the present invention are preferably chemically sensitized by a sulfur sensitization method, selenium sensitization method or tellurium sensitization method. As the compounds used preferably for the sulfur sensitization method, selenium sensitization method, and tellurium sensitization method, known compounds, for example, compounds described in JP-A No. 7-128768 can be used.

Particularly, tellurium sensitization is preferred in the present invention, and compounds described in the literature in JP-A No. 11-65021 in column No. 0030 and compounds represented by the general formulae (II), (III), and (IV) in JP-A No. 5-313284 are more preferred.

In the present invention, the chemical sensitization can be conducted at any timing so long as it is after particle formation and before coating including, for example, (1) before spectral sensitization, (2) simultaneously with spectral sensitization, (3) after spectral sensitization, and (4) just before coating, after desalting. It is particularly preferred to be conducted after spectral sensitization.

The amount of sulfur, selenium and tellurium sensitizer used in the present invention may vary depending on the silver halide particle used, and chemical ripening conditions, and it is used, per one mol of silver halide, by about $10^{-8}$ mol to $10^{-2}$ mol and, preferably, $10^{-7}$ mol to $10^{-3}$ mol. While there are no particular restrictions on the conditions for chemical sensitization in the present invention, pH is about 5 to 8, pAg is 6 to 11 and temperature is about at 40° C. to 95° C.

To the silver halide emulsion used in the present invention, a thiosulfonic acid compound may also be added by the method, for example, shown in EP-A No. 293917.

10) Combined Use of Silver Halides

The photosensitive silver halide emulsions in the photosensitive materials used in the present invention may be used each alone or in combination of two or more of them (for example, those of different average particle sizes, those of different halogen compositions, those of different crystal habits and those of different conditions for the chemical sensitization). Gradation can be controlled by using plural kinds of photosensitive silver halides of different sensitivities.

The techniques concerned can include those described in JP-A Nos. 57-119341, 53-106125, 47-3929, 48-55730, 46-5187, 50-73627, and 57-150841. As the difference of the sensitivity, it is preferred to provide a difference of 0.2 logE or more between each of the emulsions.

11) Coating Amount

The addition amount of the photosensitive silver halide, when expressed as the coating amount of silver per 1 $m^2$ of the photosensitive material, is from 0.0005 $g/m^2$ or more and 0.4 $g/m^2$ or less, more preferably, 0.001 $g/m^2$ or more and 0.2 $g/m^2$ or less, further preferably, 0.005 $g/m^2$ or more and 0.1 $g/m^2$ or less and, further more preferably, 0.005 $g/m^2$ or more and 0.05 $g/m^2$ or less.

The photosensitive silver halide based on one mol of silver contained in the organic silver salt is, preferably, 0.0005 mol or more and 0.3 mol or less, more preferably, 0.001 mol or more and 0.15 mol or less, further preferably, 0.005 mol or more and 0.075 mol or less and, further more preferably, 0.005 mol or more and 0.038 mol or less.

12) Mixing of Photosensitive Silver Halide and Organic Silver Salt

Mixing method and mixing condition for a photosensitive silver halide and an organic silver salt prepared separately include a method of mixing silver halide particles and an organic silver salt completed for preparation respectively by a high speed stirrer, ball mill, sand mill, colloid mill, vibration mill or homogenizer, or a method of mixing a photosensitive silver halide completed for preparation at a certain timing during preparation of an organic silver salt thereby preparing an organic silver salt.

As described above, the silver halide in the present invention is preferably formed in a state where the organic silver salt is not present. Further, mixing of two or more kinds of aqueous dispersion of organic silver salts and two or more kinds of aqueous dispersions of photosensitive silver salts upon mixing is a preferred method for controlling photographic properties.

13) Mixing of Silver Halide to Coating Liquid

A preferred timing for adding the silver halide into an image forming layer coating solution in the present invention is from 180 min to immediately before coating, preferably, from 60 min to 10 sec before coating and there are no particular restrictions for the mixing method and the mixing condition so long as the effect of the present invention is provided sufficiently.

Concrete mixing method includes a method of mixing in a tank adapted such that an average staying time calculated based on the addition flow rate and the liquid feed amount to a coater gives a desired time, or a method of using a static mixer as described, for example, in "Liquid Mixing Technique" written by N. Harnby, M. F. Edwards, and A. W. Nienow, translated by Koji Takahashi (published from Nikkan Kogyo Shinbun Co., 1989), Chapter 8.

14) Compound in Which a One-electron Oxidant Formed by One-electron Oxidation Can Release One Electron or More Electrons The photothermographic material in the present invention preferably contains a compound in which a one-electron oxidant formed by one-electron oxidation can release one electron or more electrons.

The compound in which a one-electron oxidant formed by one-electron oxidation can release one electron or more electrons contained in the photothermographic material of the present invention is a compound selected from the following types 1 to 5.

(Type 1)

A compound in which a one-electron oxidant formed by one-electron oxidation can further release two or more electrons accompanying successive bonding cleavage reaction.

(Type 2)

A compound in which a one-electron oxidant formed by one-electron oxidation can further release one electron accompanying successive bonding cleavage reaction, and having two or more adsorptive groups to a silver halide in one identical molecule.

(Type 3)

A compound in which a one-electron oxidant formed by one-electron oxidation can further release one electron or more electrons after the succeeding bond-forming process.

(Type 4)

A compound in which a one-electron oxidant formed by one-electron oxidation can release one electron or more electrons after successive ring-opening reaction in the molecule.

(Type 5)

A compound represented by X—Y in which X represents a reducing group and Y represents a splitting group, a one-electron oxidant formed from the reducing group represented by X by one-electron oxidation splits Y accompanying successive cleavage reaction for X—Y bond to form an X radical, and can release a further electron therefrom.

Among the compounds of the type 1 and types 3–5, most preferred is "compound having adsorptive group to the silver halide in the molecule" or "a compound having a partial structure of a spectral sensitizing dye in the molecule". More preferably, it is "compound having adsorptive group to a silver halide in the molecule". The compound of types 1 to 4 is more preferably "compound having nitrogen-containing heterocyclic ring group substituted with two or more mercapto groups as the adsorptive group".

The compound of the types 1 to 5 to be described specifically.

For the compound of the type 1, "bonding cleavage reaction" means cleavage for the bonding between each of the elements such as carbon-carbon, carbon-silicon, carbon-hydrogen, carbon-boron, carbon-tin, and carbon-germanium which may be further accompanied with cleavage for carbon-hydrogen bonding. The compound of type 1 is a compound which is subjected to one-electron oxidation to form a one-electron oxidant and then can release two or more electrons (preferably three or more electrons) accompanying the bonding cleavage reaction.

Preferred compounds among the compounds of type 1 are represented by the general formula (A), general formula (B), general formula (1), general formula (2), or general formula (3).

General formula (A)

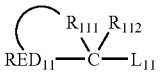

General formula (B)

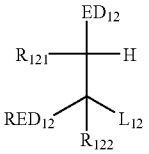

In the general formula (A), $RED_{11}$ represents a reducing group capable of undergoing one-electron oxidation and $L_{11}$ represents a splitting group. $R_{112}$ represents a hydrogen atom or a substituent. $R_{111}$ represents a non-metal atom group capable of forming, together with carbon atom (C) and $RED_{11}$, a cyclic structure corresponding to a tetrahydro form, hexahydro form or octahydro form of a 5-membered or 6-membered aromatic ring (including aromatic heterocyclic ring).

In the general formula (B) $RED_{12}$ represents a reducing group that can be subjected to one-electron oxidation and $L_{12}$ represents a splitting group. $R_{121}$ and $R_{122}$ each represents a hydrogen atom or a substituent. $ED_{12}$ represents an electron donating group. In the general formula (B), $R_{121}$ and $RED_{12}$, $R_{121}$ and $ED_{122}$, or $ED_{12}$ and $RED_{12}$ may be bonded to each other to form a cyclic structure.

The compound represented by the general formula (A) or the general formula (B) is a compound of splitting $L_{11}$ or $L_{12}$ spontaneously by bonding cleavage reaction after one-electron oxidation of the reducing group represented by $RED_{11}$ or $RED_{12}$ and capable of releasing two or more, preferably, three or more electrons accompanying therewith.

General Formula (1), General Formula (2), General Formula (3)

[Kagaku 5]

General formula (1)

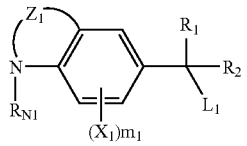

General formula (2)

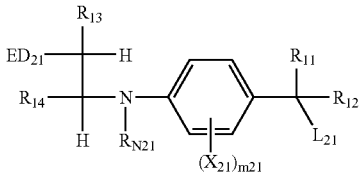

General formula (3)

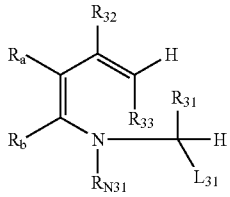

In the general formula (1), $Z_1$ represents a group of atoms capable of forming a 6-membered ring together with a nitrogen atom and two carbon atoms of the benzine ring, $R_1$, $R_2$ and $R_{N1}$ each represents a hydrogen atom or a substituent, $X_1$ represents a substituent capable of substitution on the benzene ring, $m_1$ represents an integer of 0 to 3, and $L_1$ represents a splitting group. In the general formula (2), $ED_{21}$ represents an electron donating group, $R_{11}$, $R_{12}$ $R_{N21}$, $R_{13}$, and $R_{14}$ each represents a hydrogen atom or a substituent, $X_{21}$ represents a substituent capable of substitution on the benzene ring, $m_{21}$ represents an integer of 0 to 3, and $L_{21}$ represents a splitting group. $R_{N21}$, $R_{13}$, $R_{14}$, $X_{21}$ and $ED_{21}$ may join to each other to form a cyclic structure. In the general formula (3), $R_{32}$, $R_{33}$, $R_{31}$, $R_{N31}$, $R_a$, and $R_b$ each represents a hydrogen atom or a substituent, and $L_{31}$ represents a splitting group. In a case where $R_{N31}$ represents a group other than aryl group, $R_a$ and $R_b$ may join to each other to form an aromatic ring.

The compounds described above are compounds splitting $L_1$, $L_{21}$ or $L_{31}$ spontaneously by cleavage reaction after one-electron oxidation and capable of releasing two or more, preferably, three or more electrons accompanying therewith.

At first, the compound represented by the general formula (A) is to be described specifically.

In the general formula (A), the reducing group capable of undergoing one-electron oxidation represented by $RED_{11}$ is a group capable of bonding with $R_{111}$ to be described later to form a predetermined ring and can include specifically those bivalent groups formed each by removing one hydrogen atom from an appropriate portion suitable to ring formation from the following monovalent group. They are, for example, alkylamino group, arylamino group (anilino group, naphthylamino group, etc.) heterocyclic amino group (benzothiazolyl amino group, pyrrolyl amino group, etc.), alkylthio group, arylthio group (phenylthio group, etc.), heterocyclic thio group, alkoxy group, aryloxy group (phenoxy group, etc.), heterocyclic oxy group, aryl group (phenyl group, naphthyl group, anthranyl group, etc.), aromatic or non-aromatic heterocylic group (5-membered to 7-membered mono or condensed ring heterocyclic ring containing at least one hetero atoms of nitrogen atom, sulfur atom, oxygen atom and selenium atom, specific examples including, for example, tetrahydroquinoline ring, tetrahydroisoquinoline ring, tetrahydroquinoxaline ring, tetrahydroquinazoline ring, indoline ring, indole ring, indazole ring, carbazole ring, phenoxadine ring, phenothiazine ring, benzothiazoline ring, pyrrole ring, imidazole ring, thiazoline ring, piperidine ring, pyrrolidine ring, morpholine ring, benzoimidazole ring, benzoimidazoline ring, benzooxazoline ring, and methylene oxyphenyl ring) (hereinafter, $RED_{11}$ is to be described by the name of monovalent group for the sake of convenience). $RED_{11}$ may have a substituent.

The substituents in the present invention means selected from the following groups unless otherwise described. They include, for example, halogen atom, alkyl group (including aralkyl group, cycloalkyl group, active methine group, etc.), alkenyl group, alkynyl group, aryl group, heterocyclic group (irrespective of substitution position), heterocyclic group containing quaternarized nitrogen atom (for example, pyridinio group, imidazolio group, quinolinio group, and isoquinolinio group), acyl group, alkoxycarbonyl group, aryloxy carbonyl group, carbamoyl group, carboxy group or salt thereof, sulfonyl carbamoyl group, acyl carbamoyl group, sulfamoyl carbamoyl group, carbazoyl group, oxalyl group, oxamoyl group, cyano group, carbon imidoyl group, thiocarbamoyl group, hydroxyl group, alkoxy group (including groups containing ethyleneoxy group or propyleneoxy group units repetitively), aryloxy group, heterocyclic oxy group, acyloxy group (alkoxy or aryloxy), carbonyloxy group, carbamoyloxy group, sulfonyloxy group, amino group, (alkyl, aryl or hetercyclic) amino group, acylamino group, sulfoneamide group, ureido group, thioureido group, imide group, (alkoxy or aryloxy) carbonyl amino group, sulfamoyl amino group, semicarbazide group, thiosemicarbazide group, hydrazino group, ammonio group, oxamoyl amino group, (alkyl or aryl) sulfonyl ureido group, acyl ureido group, acyl sulfamoylamino group, nitro group, mercapto group, (alkyl or aryl or heterocyclic) thio group, (alkyl or aryl) sulfonyl group, (alkyl or aryl) sulfinyl group, sulfo group or salts thereof, sulfamoyl group, acylsulfamoyl group, sulfonylsulfamoyl group or salts thereof, and groups containing phosphoric amide or phospholic ester structure. The substituent described above may further be substituted with such substituents.

$RED_{11}$ is, preferably, an alkylamino group, arylamino group, heterocyclic amino group, aryl group, aromatic or non-aromatic heterocyclic group and, further preferably, arylamino group (particularly, anilino group), and aryl group (particularly, phenyl group). In a case where they have substituents, the substituent is preferably a halogen atom, alkyl group, alkoxy group, carbamoyl group, sulfamoyl group, acylamino group and sulfone amide group.

In a case where $RED_{11}$ represents an aryl group, the aryl group preferably has at least one "electron donating group". "Electron donating group" means herein a hydroxy group, alkoxy group, mercapto group, sulfoneamide group, acylamino group, alkylamino group, arylamino group, heterocyclic amino group, active methine group, a five-membered single or fused ring electron excessive aromatic heterocyclic group containing at least one nitrogen atom in the ring (for example, indolyl group, pyrrolyl group, imidazolyl group, benzimidazolyl group, thiazolyl group, benzthiazolyl group, and indazolyl group), nitrogen atom-substituted non-aromatic nitrogen-containing heterocyclic group (group which can be also referred to as a cyclic amino group such as pyrrolidinyl group, indolinyl group, piperidinyl group, piperadynyl group and morpholino group).

The active methine group means herein a methine group substituted with two "electron attractive group" and "electron attractive group" means herein an acyl group, alkoxycarbonyl group, aryloxy carbonyl group, carbamoyl group, alkylsulfonyl group, arylsulfonyl group, sulfamoyl group, trifluoromethyl group, cyano group, nitro group, and carbon imidoyl group. The two electron attractive groups may join to each other to form a cyclic structure.

In the general formula (A), $L_{11}$ represents, specifically, a carboxy group or a salt thereof, silyl group, hydrogen atom, triaryl boron anion, trialkyl stannyl group, trialkyl germyl group, or $—CR_{C1}R_{C2}R_{C3}$ group. The silyl group represents specifically a trialkyl silyl group, aryl dialkyl silyl group and triaryl silyl group which may have an optional substituent.

In a case where $L_{11}$ represents a salt of carboxy group, a counter ion forming the salt can include, for example, alkali metal ion, alkaline earth metal ion, heavy metal ion, ammonium ion, and phosphonium ion, preferably, alkali metal ion or ammonium ion and, most preferably, alkali metal ion (particularly, $Li^+$, $Na^+$, $K^+$ ion).

In a case where $L_{11}$ represents $—CR_{C1}R_{C2}R_{C3}$, $R_{C1}$, $R_{C2}$, and $R_{C3}$ each represents independently a hydrogen atom, alkyl group, aryl group, heterocyclic group, alkylthio group, arylthio group, alkylamino group, arylamino group, heterocyclic amino group, alkoxy group, aryloxy group, and hydroxy group which may join to each other to form a cyclic structure and which may further have an optional substituent. However, in a case where one of $R_{C1}$, $R_{C2}$, and $R_{C3}$ represents a hydrogen atom or alkyl group, remaining two groups do not represent hydrogen atom or alkyl group. $R_{C1}$, $R_{C2}$, and $R_{C3}$ each independently represents preferably alkyl group, aryl group (particularly, phenyl group), alkylthio group, arylthio group, alkylamino group, arylamino group, heterocyclic group, alkoxy group, and hydroxy group and can include, specifically, for example, phenyl group, p-dimethylaminophenyl group, p-methoxyphenyl group, 2,4-dimethoxyphenyl group, p-hydroxyphenyl group, methylthio group, phenylthio group, phenoxy group, methoxy group, ethoxy group, dimethylamino group, N-methylanilino group, diphenylamino group, morpholino group, thiomorpholino group, and hydroxyl group. In a case where they bond to each other to form the cyclic structure, they include, for example, 1,3-dithiolan-2-yl group, 1,3-dithian-2-yl group, N-methyl-1,3-thiazolidin-2-yl group, and N-benzylbenzothiazolidin-2-yl group.

It is also preferred for a case that $—CR_{c1}R_{C2}R_{C3}$ group represents the group identical with the residue of the general formula (A) after removing $L_{11}$ therefrom as a result of selecting $R_{C1}$, $R_{C2}$, and $R_{C3}$ respectively within the range described above.

In the general formula (A), $L_{11}$ is, preferably, a carboxy group or a salt thereof and a hydrogen atom. More preferably, it is a carboxy group or a salt thereof. In a case where $L_{11}$ represents a hydrogen atom, the compound represented by the general formula (A) preferably has a base portion present in the molecule. After the oxidation of the compound represented by the general formula (A) under the effect of the base portion, the hydrogen atom represented by $L_{11}$ is deprotonated to further release an electron therefrom.

The base means herein, specifically, a conjugated base of an acid showing from about 1 to about 10 pKa. It can include, for example, nitrogen-containing heterocyclic rings (pyridines, imidazoles, benzoimidazoles and thiazoles), anilines, trialkylamines, amino group, carbonaceous acids (for example, active methylene anion), thioacetic acid anion, carboxylate (—$COO^-$), sulfate (—$SO_3^-$) or amine oxide (>$N^+(O^-)$—). It is preferably a conjugated base of an acid showing from about 1 to about 8 pKa, carboxylate, sulfate or amine oxide being more preferred and caboxylate being particularly preferred. In a case where the base has an anion, it may also have a pair cation and examples thereof can include alkali metal ion, alkaline earth metal ion, heavy metal ion, ammonium ion and phosphonium ion. The base is bonded at an arbitrary position to a compound represented by the general formula (A). The base portion may be bonded at any of positions of $RED_{11}$, $R_{111}$ and $R_{112}$ in the general formula (A) or it may be bonded at the substituent for the groups described above.

In the general formula (A), $R_{112}$ represents a hydrogen atom or a substituent capable of substitution on a carbon atom. However, $R_{112}$ does not represent a group identical with $L_{11}$.

$R_{112}$ is preferably a hydrogen atom, alkyl group, aryl group (for example, phenyl group), alkoxy group (for example, methoxy group, ethoxy group and benzyloxy group), hydroxyl group, alkylthio group (for example, methylthio group, and butylthio group), amino group, alkylamino group, arylamino group, and heterocyclic amino group and, more preferably, a hydrogen atom, alkyl group, alkoxy group, hydroxyl group, phenyl group, and alkylamino group.

In the general formula (A), the cyclic structure formed with $R_{111}$ is a cyclic structure corresponding to a tetrahydro form, hexahydro form, or octahydro form of a 5-membered or 6-membered aromatic ring (including aromatic heterocyclic ring), in which the hydro form means a cyclic structure where the carbon-carbon double bond (or carbon-nitrogen double bond) present in the aromatic ring (including aromatic heterocyclic) is partially hydrogenated, and the tetrahydro form, hexahydro form and octahydro form mean structures in which two, three and four carbon-carbon double bonds (or carbon nitrogen double bonds) are hydrogenated, respectively. By hydrogenation, the aromatic ring forms a partially hydrogenated non-aromatic ring structure.

Specifically, they include, for example, pyrrolidine ring, imidazolidine ring, thiazolidine ring, pyrazolidine ring and oxazolidine ring, piperidine ring, tetrahydropyridine ring, tetrahydropyrimidine ring, piperadine ring, tetraline ring, tetrahydroquinoline ring, tetrahydroisoquinoline ring, tetrahydroquinazoline ring, and tetrahydroquinoxaline ring, tetrahydrocarbazole ring, and octahydrophenanthridine ring. The ring structures may have optional substituents.

The cyclic structure formed with $R_{111}$ is, more preferably, pyrrolidine ring, imidazolidine ring, piperidine ring, tetrahydropyridine ring, tetrahydropyrimidine ring, piperadine ring, tetrahydroquinoline ring, tetrahydroisoquinoline ring, tetrahydroquinazoline ring, tetrahydroquinoxaline ring, and tetrahydrocarbazole ring and, particularly preferably, pyrrolidine ring, piperidine ring, piperadine ring, tetrahydropyridine ring, tetrahydroquinoline ring, tetrahydroisoquinoline ring, tetrahydroquinazoline ring, tetrahydroquinoxaline ring and, most preferably, pyrrolidine ring, piperidine ring, tetrahydropyridine ring, tetrahydroquinoline ring, and tetrahydroisoquinoline ring.

In the general formula (B), $RED_{12}$ and $L_{12}$ each represents a group identical with $RED_{11}$ and $L_{11}$ in the general formula (A), respectively and preferred ranges thereof are also identical. However, $RED_{12}$ is a monovalent group except for the case of forming the following cyclic structure and, specifically, it can include monovalent groups described for $RED_{11}$. $R_{121}$ and $R_{122}$ are groups identical with $R_{112}$ in the general formula (A) and preferred ranges thereof are also identical. $ED_{12}$ represents an electron donating group. $R_{121}$ and $RED_{12}$, $R_{121}$ and $R_{122}$, or $ED_{12}$ and $RED_{12}$ may joined to each other to form a cyclic structure.

The electron donating group represented by $ED_{12}$ in the general formula (B) is identical with the electron donating group explained as the substituent in a case where $RED_{11}$ represents the aryl group. $ED_{12}$ is preferably a hydroxyl group, alkoxy group, mercapto group, sulfone amide group, alkylamino group, arylamino group, active methine group, 5-membered mono or condensed electron excessive aromatic heterocyclic group containing at least one nitrogen atom in the ring, nitrogen atom-substituted non-aromatic nitrogen-containing heterocyclic group, and phenyl group substituted with the electron donating group described above and it is, further preferably, hydroxyl group, mercapto group, sulfone amide group, alkylamino group, arylamino group, active methine group, nitrogen atom-substituted non-aromatic heterocyclic group, and phenyl group substituted with the electron-donating group described above (for example, p-hydroxyphenyl group, p-dialkylaminophenyl group, o-, p-dialkoxyphenyl group).

In the general formula (B), $R_{12}$ and $RED_{12}$, $R_{122}$ and $R_{121}$, or $ED_{12}$ and $RED_{12}$ may join to each other to form a cyclic structure. The cyclic structure formed herein is a non-aromatic carbo-cyclic heterocyclic structure which is a 5-membered to 7-membered single or condensed ring of substituted or not-substituted cyclic structure. In a case where $R_{121}$ and $RED_{12}$ form a cyclic structure, specific examples thereof can include, in addition to those mentioned above as the example where $R_{111}$ forms a cyclic structure in the general formula (A), pyrroline ring, imidazoline ring, thiazoline ring, pyrazoline ring, oxazoline ring, indane ring, morpholine ring, indoline ring, tetrahydro-1,4-oxazine ring, 2,3-dihydrobenzo-1,4-oxazine ring, tetrahydro-1,4-thiadine ring, 2,3-dihydrobenzo-1 ,4-thiazine ring, 2,3-dihydrobenzofuran ring, and 2,3-dihydrobenzothiophene ring. In a case where $ED_{12}$ and $RED_{12}$ form the ring structure, $ED_{12}$ preferably represents an amino group, alkyl amino group, or arylamino group and specific examples of the ring structure to be formed can include, for example, tetrahydropyradine ring, piperadine ring, tetrahydroquinoxaline ring, and tetrahydroisoquinoline ring. In a case where $R_{122}$ and $R_{121}$ form the ring structure, specific examples thereof can include cyclohexane ring and cyclopentane ring.

Then, the general formulae (1)–(3) are to be described.

In the general formulae (1) to (3), $R_1$, $R_2$, $R_{11}$, $R_{12}$, and $R_{31}$ are groups identical with $R_{112}$ in the general formula (A) and preferred ranges thereof are also identical. $L_1$, $L_{21}$, $L_{31}$ represent splitting groups identical with the groups mentioned as specific examples in the explanation for $L_{11}$ in the general formula (A) and preferred ranges thereof are also identical. The substituent represented by $X_1$, $X_{21}$ are identical with examples for the substituents in a case where $RED_{11}$ of the general formula (A) has substituents and preferred ranges thereof are also identical. $m_1$ and $m_{21}$ each represents preferably an integer of 0 to 2 and, more preferably, 0 or 1.

In a case where $R_{N1}$, $R_{N21}$, $R_{N31}$ represent substituents, the substituents are preferably alkyl group, aryl group and heterocyclic ring, which may further have optional substituent. $R_{N1}$, $R_{N21}$, $R_{N31}$ each represents preferably a hydrogen atom, alkyl group or aryl group, hydrogen atom or alkyl group being more preferred.

In a case where $R_{13}$, $R_{14}$, $R_{33}$, $R_a$, and $R_b$ each represents a substituent, the substituent is, preferably, an alkyl group, aryl group, acyl group, alkoxycarbonyl group, carbamoyl group, cyano group, alkoxy group, acylamino group, sulfoneamino group, ureido group, thioureido group, alkylthio group, arylthio group, alkylsulfonyl group, arylsulfonyl group, or sulfamoyl group.

In the general formula (1), the 6-membered ring formed with $Z_1$ is a non-aromatic heterocyclic ring condensed with the benzene ring of the general formula (1) and, specifically, a tetrahydroquinoline ring, tetrahydroquinoxaline ring and tetrahydroquinazoline ring, preferably, tetrahydroquinoline ring or tetrahydroquinoxaline ring as a ring structure also including the benzene ring to be condensed. They may have a substituent.

In the general formula (2), $ED_{21}$ is a group identical with $ED_{12}$ in the general formula (B) and a preferred range thereof is also identical.

In the general formula (2), any two of $R_{N21}$, $R_{13}$, $R_{14}$, $X_{21}$ and $ED_{21}$ may join to each other to form a ring structure. The ring structure formed by bonding between $R_{N21}$ and $X_{21}$ is, preferably, 5-membered to 7-membered non-aromatic carbocyclic or heterocyclic ring condensed preferably with the benzene ring and specific examples thereof can include tetrahydroquinoline ring, tetrahydroquinoxaline ring, indoline ring, and 2,3-dihydro-5,6-benzo-1,4-thiazine ring. It is preferably tetrahydroquinoline ring, tetrahydroquinoxaline ring, and indoline ring.

In the general formula (3), in a case where $R_{N31}$ represents a group other than aryl group, $R_a$ and $R_b$ join to each other to form an aromatic ring. The aromatic ring means herein an aryl group (for example, phenyl group and naphthyl group) and an aromatic heterocyclic ring (for example, pyridine ring group, pyrrole ring group, quinoline ring group, and indole ring group), aryl group being preferred. The aromatic ring group may have an optional substituent.

In the general formula (3), $R_a$ and $R_b$ preferably join to each other to form an aromatic ring (particularly, phenyl group).

In the general formula (3), $R_{32}$ is, preferably, hydrogen atom, alkyl group, aryl group, hydroxy group, alkoxy group, mercapto group and amino group, in which it is also one preferred examples where $R_{32}$ represents a hydroxyl group, $R_{33}$ also represents "electron attractive group". "Electron attractive group" is identical with that explained previously and acyl group, alkoxycarbonyl group, carbamoyl group or cyano group is preferred.

Then, the compound of type 2 is to be described.

"Bonding cleavage reaction" in the compound of type 2 means cleavage of bonding between each of elements such as carbon-carbon, carbon-silicon, carbon-hydrogen, carbon-boron, carbon-tin, and carbon-germanium which may be accompanied with cleavage for carbon-hydrogen bond.

The compound of type 2 is a compound having two or more adsorptive groups to silver halide in the molecule. More preferably, it is a compound having a nitrogen-containing heterocyclic group substituted with two or mercapto groups as the adsorptive groups. The number of the adsorptive groups is, preferably from 2 to 6, further preferably, from 2 to 4. The adsorptive group will be described later.

Preferred compounds among the compounds of type 2 are represented by the general formula (C).

General formula (C)

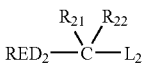

The compound represented by the general formula (C) is a compound of spontaneously splitting $L_2$ by bonding cleavage reaction after one-electron oxidation of the reducing group represented by $RED_2$, thereby capable of releasing further one electron.

In the general formula (C), $RED_2$ represents a group identical with that for $RED_{12}$ of the general formula (B) and a preferred range thereof is also identical. $L_2$ represents a group identical with that described for $L_{11}$ of the general formula (A) and a preferred range thereof is also identical. In a case where $L_2$ represents a silyl group, the compound has a nitrogen-containing heterocyclic group substituted with two or more mercapto groups as adsorptive groups. $R_{21}$ and $R_{22}$ each represents a hydrogen atom or a substituent and they are groups identical with $R_{112}$ of the general formula (A) and preferred ranges thereof are also identical. $RED_2$ and $R_{21}$ may join to each other to form a cyclic structure.

The cyclic structure formed herein is a 5-membered to 7-membered single or fused non-aromatic or carbocyclic heterocyclic ring which may have a substituent. However, the ring structure is not a ring structure corresponding to a tetrahydro form, hexahydro form or octahydroform of an aromatic ring or an aromatic heterocyclic ring. The cyclic structure is, preferably, a cyclic structure corresponding to a dihydro form of an aromatic ring or aromatic heterocyclic ring and specific examples thereof can include, for example, 2-pyrroline ring, 2-imidazoline ring, 2-thiazoline ring, 1,2-dihydropyridine ring, 1,4-dihydropyridine ring, indoline ring, benzoimidazoline ring, benzothazoline ring, benzoxazoline ring, 2,3-dihydrobenzothiophene ring, 2,3-dihydrobenzofuran ring, benzo-α-pyrane ring, 1,2-dihydroquinoline ring, 1,2-dihydroquinazoline ring, and 1,2-dihydroquinoxaline ring, preferably, 2-imidazoline ring, 2-thiazoline ring, indoline ring, benzoimidazoline ring, benzothiazoline ring, benzoxazoline ring, 1,2-dihydropyridine ring, 1,2-dihydroquinoline ring, 1,2-dihydroquinazoline ring, and 1,2-dihydroquinoxaline ring, more preferably, indoline ring, benzoimidazoline ring, benzothiazoline ring, 1,2-dihydroquinoline ring, and, particularly preferably, indoline ring.

The compound of type 3 is to be described below.

In the compound of type 3, "bonding-forming process" means formation of inter-atom bonding such as carbon-carbon, carbon-nitrogen, carbon-sulfur and carbon-oxygen. The compound of type 3 is, preferably, a compound in which a one-electron oxidant formed by one-electron oxidation reacts successively with a reactive group site present together in the molecule (carbon-carbon double bond site, carbon-carbon triple bond site, aromatic group site or non-aromatic heterocyclic group site of a condensed benzo ring) to form bonding and, subsequently, can release further one electron or more electrons. Referring more specifically, the compound of type 3 has a feature that a one-electron oxidant formed by one-electron oxidation (cation radical species or neutral radical species formed by dissociation of proton therefrom) reacts with the reactive group present together in one identical molecule to form a bonding thereby forming additionally radical species having a ring structure in the molecule and then the second electron is released from the radical species directly or accompanying deprotonation.

Further in some compounds of type 3, the thus formed 2-electron oxidant may further release one electron or more electrons, usually, two or more electrons after undergoing hydrolyzing reaction or taking place tautomeric isomerizing reaction directly accompanying transfer of proton. Alternatively, it can also include those having an ability of releasing one electron or more electrons, usually, two or more electrons directly from the 2-electron oxidant not by way of the tautomeric isomerization.

The compound of type 3 is represented preferably by the general formula (D).

$RED_3$—$L_3$—$Y_3$ General formula (D)

In general formula (D), $RED_3$ represents a reducing group capable of one-electron oxidation, $Y_3$ represents a reactive group site that reacts after one-electron oxidation of $RED_3$ and, specifically, represents an organic group containing a carbon-carbon double bond site, carbon-carbon triple bond site, aromatic group site or non-aromatic heterocyclic group site of condensed benzo ring. $L_3$ represents a connection group for coupling $RED_3$ and $Y_3$.

$RED_3$ represents a group identical with that for $RED_{12}$ of the general formula (B) which can include, preferably, arylamino group, heterocyclic amino group, aryloxy group, arylthio group, aryl group, aromatic or non-aromatic heterocyclic group (particularly, nitrogen-containing heterocyclic group being preferred), further preferably, arylamino group, heterocyclic amino group, aryl group, aromatic or non-aromatic heterocyclic group. For the heterocyclic group, preferred are tetrahydroquinoline ring group, tetrahydroquinoxaline ring group, tetrahydroquinazoline ring group, indoline ring group, indole ring group, carbazole ring group, phenoxadine ring group, phenothiazine ring group, benzothianzoline ring group, pyrrole ring group, imidazole ring group, thiazole ring group, benzoimidazole ring group, benzoimidazoline ring group, benzothiazoline ring group, 3,4-methylenedioxyphenyl-1-yl group.

Particularly preferred $RED_3$ is an arylamino group (particularly, anilino group), aryl group (particularly phenyl group), or aromatic or non-aromatic heterocyclic group.

In a case where $RED_3$ represents an aryl group, the aryl group preferably has at least one "electron donating group". "Electron donating" is identical with those described previously.

In a case where $RED_3$ represents the aryl group, the substituent for the aryl group is more preferably alkylamino group, hydroxyl group, alkoxy group, mercapto group, sulfoneamide group, active methine group, nitrogen atom-substituted non-aromatic nitrogen-containing heterocyclic group and, further preferably, alkylamino group, hydroxyl group, active methine group and a nitrogen atom-substituted non-aromatic nitrogen-containing heterocyclic group and, most preferably, an alkylamino group and a nitrogen atom-substituted non-aromatic nitrogen-containing heterocyclic group.

In a case where the organic group containing the carbon-carbon double bond site represented by $Y_3$ (for example, vinyl group) has a substituent, the substituent is, preferably, an alkyl group, phenyl group, acyl group, cyano group, alkoxycarbonyl group, carbamoyl group, and an electron donating group in which the electron donating group is, preferably, alkoxy group, hydroxyl group (which may be protected with a silyl group and can include, for example, trimethylsilyloxy group, t-butyldimethylsilyloxy group, triphenylsilyloxy group, triethylsilyloxy group, and phenyldimethylsilyloxy group), amino group, alkylamino group, arylamino group, sulfoneamido group, active methine group, mercapto group, alkylthio group and phenyl group having the electron donating group described above as the substituent.

In a case where the organic group containing the carbon-carbon double bond site has an hydroxyl group as a substituent, $Y_3$ contains the partial structure described on the right as: $>C_1{=}C_2(—OH)—$, which may be tautomerically isomerized to form a partial structure shown on the right as: $>C_1H—C_2({=}O)—$. In this case, it is also preferred that the substituent substituting on the $C_1$ carbon is an electron attractive group in which $Y_3$ has a partial structure of "active methylene group" or "active methine group". The electron attractive group capable of providing the partial structure of the active methylene group or active methine group is identical with those described for "active methine group" as described previously.

In a case where the organic group containing the carbon-carbon triple site represented by $Y_3$ (for example, ethynyl group) has a substituent, the substituent is, preferably, an alkyl group, phenyl group, alkoxy group, carbonyl group, carbamoyl group, and electron donating group.

In a case where $Y_3$ represents an organic group containing the aromatic group site, the aromatic group is, preferably, an aryl group having the electron donating group as a substituent (phenyl group being particularly preferred) or an indole ring group, in which the electron donating group is, preferably, hydroxyl group (which may be protected by silyl group), alkoxy group, amino group, alkylamino group, active methine group, sulfoneamide group, and mercapto group.

In a case where $Y_3$ represents an organic group containing a non-aromatic heterocyclic site of the condensed benzo ring, the non-aromatic heterocyclic group of the condensed benzo ring can include, preferably, those incorporating the aniline structure as a partial structure, and can include, for example, indoline ring group, 1,2,3,4-tetrahydroquinoline ring group, 1,2,3,4-tetrahydroquinoxaline ring group, and 4-quinolone ring group.

The reactive group represented by $Y_3$ is, more preferably, an organic group containing carbon-carbon double bond site, aromatic group site or non-aromatic heterocyclic group of a condensed benzo ring. Further preferred are carbon-carbon double bond site, phenyl group or indole ring group having an electron donating group as a substituent, a non-aromatic heterocyclic group of a condensed benzo ring incorporating an aniline structure as a partial structure. The carbon-carbon double bond site more preferably has at least one electron donating group as a substituent.

It is also a preferred example of the compound represented by the general formula (D) in a case where the reactive group represented by $Y_3$ has a partial structure identical with the reducing group represented by $RED_3$ as a result of selection from the range described so far.

$L_3$ represents a connecting group for coupling $RED_3$ and $Y_3$ and, specifically, represents a single bond, alkylene group, arylene group, heterocyclic group, —O—, —S—, —NRN—, —C(=O)—, —$SO_2$—, —SO—, —P(=O)— each alone or a group comprising the combination of such groups. $R_N$ represents a hydrogen atom, alkyl group, aryl group, and heterocyclic group. The connecting group represented by $L_3$ may have an optional substituent. The connecting group represented by $L_3$ can be connected at any optional position of the group represented by $RED_3$ and $Y_3$ in the form of substituting one optional hydrogen atom of each of them. Preferred examples of $L_3$ can include a single bond, alkylene group (particularly, methylene group, ethylene group, and propylene group), arylene group (particularly, phenylene group), —C(=O)— group, —O— group, —NH— group, —N(alkyl group)- group, and a bivalent connecting group comprising a combination of such groups.

Referring to the group represented by $L_3$, when cation radical species ($X^{+}$.) formed by oxidation of $RED_3$ or radical species (X.) formed therefrom accompanying deprotonation and the reactive group represented by $Y_3$ are reacted to form bonding, it is preferred that the atom groups relevant thereto can form a 3 to 7-membered ring structure including $L_3$. For this purpose, it is preferred that the radial species (X+. or X.), the reactive group represented by Y and L are connected by way of a group of 3 to 7 atoms.

Then, compound of type 4 is to be described.

The compound of type 4 is a compound having a ring structure substituted with a reducing group which can release, after one-electron oxidation of the reducing agent, one electron or more electrons accompanying the cleavage reaction of the ring structure. The cleavage reaction of the ring structure mentioned herein means the reaction of the form represented below.

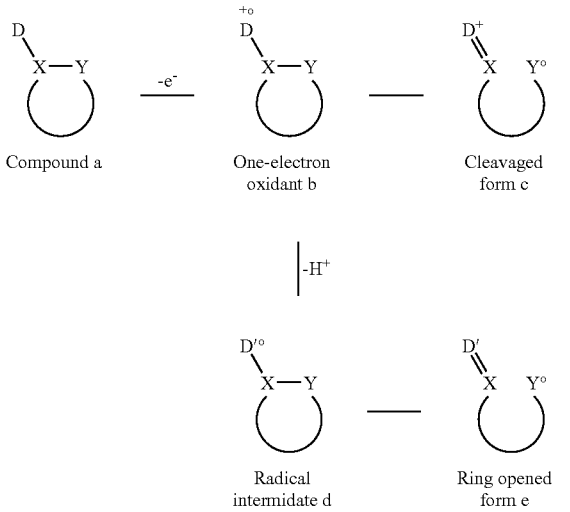

In the formulae, the compound a represents the compound of type 4. In the compound a, D represents a reducing group and X, Y represent atoms forming the bonding to be cleavaged after one-electron oxidation. At first, the compound a is undergoes one-electron oxidation to form a one-electron oxidant b, from which a ring-opened body c is formed by conversion of the single bond: D—X to double bond and, at the same time, disconnection for the bond X—Y. Alternatively, it may sometimes transform through a route of forming a radical intermediate d from the one-electron oxidant b accompanying deprotonation and also forming the ring-opened body e therefrom. This compound has a feature of successively releasing one electron or more electrons from the thus formed ring-opened body c or e.

The ring structure of the compound of type 4 is a 3- to 7-membered carbocyclic or heterocyclic ring, which represents a single or condensed saturated or unsaturated aromatic ring. A saturated ring structure is preferred and 3-membered ring or 4-membered ring is more preferred. Preferred ring structure can include a cyclopropane ring, cyclobutane ring, oxylan ring, oxetane ring, aziridine ring, azetidine ring, episulfide ring, and thiethane ring. More preferred are cyclopropane ring, cyclobutane ring, oxylan ring, oxetane ring and azetidine group and, particularly preferred are cyclopropane ring, cyclobutane ring and azetidine ring. The ring structure may have an optional substituent. The compound of type 4 is represented, preferably, in accordance with the general formulae (E) or (F).

General formula (E)

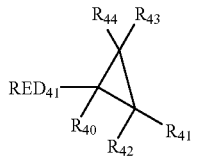

General formula (F)

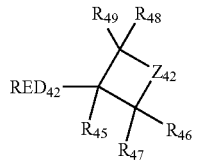

In the general formula (E) and the general formula (F), $RED_{41}$ and $RED_{42}$ each represents a group identical with that for $RED_{12}$ of the general formula (B) and a preferred range thereof is also identical. $R_{40}$ to $R_{44}$, and $R_{45}$ to $R_{49}$ each represents a hydrogen atom or a substituent. In the general formula (F), $Z_{42}$ represents —$CR_{420}R_{421}$—, —$NR_{423}$— or —O—. Then, $R_{420}$, $R_{421}$ each represents a hydrogen atom or a substituent, while $R_{423}$ represents a hydrogen atom, alkyl group, aryl group or heterocyclic group.

In the general formula (E) and the general formula (F), $R_{40}$ and $R_{45}$ each represents, preferably, a hydrogen atom, alkyl group, and a heterocyclic group, hydrogen atom, alkyl group or aryl group being more preferred. $R_{41}$ to $R_{44}$, and $R_{46}$ to $R_{49}$ each represents, preferably, a hydrogen atom, alkyl group, alkenyl group, aryl group, heterocyclic group, arylthio group, alkylthio group, acylamino group, and sulfoneamide group and, more preferably, a hydrogen atom, alkyl group, aryl group, and heterocyclic group.

For $R_{41}$ to $R_{44}$, it is preferred that at least one of them is a donating group and both of $R_{41}$ and $R_{42}$ or $R_{43}$ and $R_{44}$ are electron attractive groups. More preferably, at least one of $R_4$, to $R_{44}$ is a donating group. Further preferably, at least one of $R_{41}$ to $R_{44}$ is a donating group, and not donating group in $R_{41}$ to $R_{44}$ is a hydrogen atom or alkyl group.

The donating group means herein "electron donating group" or an aryl group substituted with at least one "electron donating group". The donating group used preferably can included an alkylamino group, arylamino group, heterocyclic amino group, 5-membered single or condensed electron excessive aromatic heterocyclic group containing at least one nitrogen atom in the ring, nitrogen atom-substituted non-aromatic nitrogen-containing heterocyclic group, and a phenyl group substituted with at least one electron donating group. Those used more preferably are alkylamino group, arylamino group, 5-membered single or condensed electron excessive aromatic heterocyclic group containing at least one nitrogen atom in the ring (indole ring, pyrrole ring, carbazole ring, etc.), phenyl group substituted with electron donating group (phenyl group substituted with three or more alkoxy groups, phenyl group substituted with hydroxyl group or alkylamino group or arylamino group, etc.). Those used particularly preferably can include, arylamino group, 5-membered single or condensed electron excessive aromatic heterocyclic group containing nitrogen atom in the ring (particularly, 3-indolyl group), and phenyl group substituted with electron donating group (particularly, trialkoxyphenyl group, alkylamino group or arylamino group-substituted phenyl group).

$Z_{42}$ is, preferably, —$CR_{420}R_{421}$— or —$NR_{423}$— and, more preferably, —$NR_{423}$—. $R_{420}$, $R_{421}$ each represents preferably a hydrogen atom, alkyl group, aryl group, heterocyclic group, acylamino group or sulfone amino group and, more preferably, a hydrogen atom, alkyl group, aryl group, or heterocyclic group. $R_{423}$ is preferably, a hydrogen atom, alkyl group, aryl group, or aromatic heterocyclic group and, more preferably, a hydrogen atom, alkyl group, or aryl group.

Where each of the groups of $R_{40}$ to $R_{49}$, and $R_{420}$, $R_{421}$, $R_{423}$ is a substituent, the total number of carbon atoms for each of them is preferably 40 or less and, more preferably, the total number of carbon atoms is 30 or less and, particularly preferably, the total number of carbon is 15 or less. Further, the substituents described above may join to each other or join with other site in the molecule ($RED_{41}$, $RED_{42}$ or $Z_{42}$) to form a ring.

In the compound of types 1 to 4 usable in the present invention, the adsorptive group to the silver halide is a group directly adsorbing to the silver halide or a group promoting adsorption to the silver halide and it can include, specifically, a mercapto group (or salt thereof, thion group (—C(═S)—), a heterocyclic group containing at least one atom selected from nitrogen atom, sulfur atom, selenium atom and tellurium atom, sulfide group, cation group and ethynyl group. However, in the compound of type 2 in the present invention, sulfide group is not included as the absorptive group.

The mercapto group (or salt thereofl as the adsorptive group means the mercapto group (or the salt thereof) itself, as well as, represents, more preferably, a heterocyclic group, aryl group or alkyl group substituted with at least one mercapto group (or salt thereof). The heterocyclic group is a 5-membered to 7-membered single or condensed aromatic or non-aromatic heterocyclic group including, for example, imidazole ring group, thiazole ring group, oxazole ring group, benzimidazole ring group, benzothiazole ring group, benzoxazole ring group, triazole ring group, thiadiazole ring group, oxadiazole ring group, tetrazole ring group, purine ring group, pyridine ring group, quinoline ring group, isoquinoline ring group, pyrimidine ring group, and triazine ring group. Further, it may also be a heterocyclic group containing a quaternarized nitrogen atom, in which the substituting mercapto group may be dissociated to form a meso ion. Examples of such heterocyclic group can include, for example, imidazolium ring group, pyrazolium ring group, thiazolium ring group, triazolium ring group, tetrazolium ring group, thiadiazolium ring group, pyridinium ring group, pirimidinium ring group, and triajinium ring group. Among all, triazolium ring group (for example, 1,2,4-triazolium-3-thiorate ring group) is preferred. The aryl group can include phenyl group or naphthyl group. The alkyl group can include linear, branched or cyclic alkyl groups of 1 to 30 carbon atoms. When the mercapto group forms a salt, the pair ion can include, for example, cation of alkali metal, alkaline earth metal and heavy metal ($Li^+$, $Na^+$, $K^+$, $Mg^{2+}$, $Ag^+$, $Zn^{2+}$), ammonium ion, heterocyclic group containing quaternarized nitrogen atom, or phosphonium ion. The mercapto group as the adsorptive group may also be tautomerically isomerized into a thion group and it can specifically include, for example, thioamide group (here, —C(═S)—NH— group), and a group containing a partial structure of the thioamide group, that is, a linear or cyclic thioamide group, thioureido group, thiourethane group and dithiocarbamate ester group. Examples of cyclic group can include, for example, thiazolidine-2-thion group, oxazolidine-2-thion group, 2-thiohydantoin group, rhodanine group, isorhodanine group, thiobarbituric acid group, and 2-thioxo-oxazolidine-4-on group.

The thion group as the adsorptive group can include a case where the mercapto group forms the thion group by tautomeric isomerization and also include a linear or cyclic thioamide group, thioureido group, thiourethane group or dithiocarbamate ester group that can not be tautomerically isomerized into the mercapto group (not having hydrogen atom at the α-position of the thion group).

The heretocyclic group containing at least one atom selected from nitrogen atom, sulfur atom, selenium atom and tellurium atom as the adsorptive group is a nitrogen-containing heterocyclic group having —NH— group capable of forming imino silver (>NAg)as a partial structure of the heterocyclic ring, or a heterocyclic group having —S— group, —Se-group, —Te— group or ═N— group capable of coordination to a silver ion by coordination bonding as a partial structure of the heterocyclic ring. Examples of the former can include, for example, benzotriazole group, triazole group, indazole group, pyrazole group, tetrazole group, benzoimidazole group, imidazole group, and purine group, and examples of the latter can include, for example, thiophene group, thiazole group, oxazole group, benzothiazole group, benzoxazole group, thiadiazole group, oxadiazole group, triazine group, selenoazole group, benzselenoazole group, telluazole group, and benztellurazole group. The former is preferred.

The sulfide group as the adsorptive group can include all of the groups having "—S—" partial structure and, preferably, those groups having the partial structure of alkyl (or alkylene)-S-alkyl (or alkylene), aryl (or arylene)-S-alkyl (or alkylene), and aryl (or arylene)-S-aryl (or arylene). Further, such sulfide groups may also form a cyclic structure, or may form —S—S— group. Specific examples in a case of forming the cyclic structure can include those groups containing, for example, thiolan ring, 1,3-dithiolan ring or 1,2-dithiolan ring, thian ring, dithian ring, or tetrahydro-1,4-thiazine ring (thiomorphorine ring). A particularly preferred sulfide group is a group having a partial structure of alkyl (or alkylene)-S-alkyl (or alkylene).

The cationic group as the adsorptive group means a group containing a quaternarized nitrogen atom, specifically, a group containing a nitrogen-containing heterocyclic group containing ammonium group or quaternarized nitrogen atom. However, the cationic group does not form a portion of an atom group forming the dye structure (for example, cyanine color forming group). The ammonio group is a trialkyl ammonio group, dialkylaryl ammonio group, and alkyldiaryl ammonio group, and can include, for example, benzyldimethyl ammonio group, trihexyl ammonio group, and phenyldiethyl ammonio group. The nitrogen-containing heterocyclic group containing a quaternarized nitrogen atom can include, for example, pyridinio group, quinolinio group, isoquinolinio group, and imidazolio group. It is, preferably, a prydinio group and imidazolio group and, particularly preferably, pyridinio group. The nitrogen-containing heterocyclic group containing the quaternarized nitrogen atom may have an optional substituent, and the substituent is, preferably, an alkyl group, aryl group, acylamino group, chlorine atom, alkoxy carbonyl group and carbamoyl group and, in the case of the pyridinio group, the substituent is, particularly preferably, a phenyl group.

The ethynyl group as the adsorptive group means —C═CH group in which the hydrogen atom may be substituted.

The adsorptive group described above may have an optional substituent.

Specific examples of the adsorptive group can further include those described in the specification of JP-A No. 11-95355, in pages 4 to 7.

Preferred adsorptive groups in the present invention can include mercapto-substituted nitrogen-containing heterocyclic group (for example, 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzthiazole group, 1,5-dimethyl-1,2,4-triazolium-3-thiorate group, etc.), and a nitrogen-containing heterocyclic group having —NH— group capable of forming imino silver (>NAg) as a partial structure of the heterocyclic (for example, benzotriazole group, benzimadazole group, indazole group, etc.). Particularly preferred are 5-mercaptotetrazole group, 3-mercapto-1,2,4-triazole group, and benzotriazole group and, most preferred are 3-mercapto-1,2,4-triazole group and 5-mercaptotetrazole group.

In the compound described above, those compounds having two or more mercapto groups in the molecule as the partial structure are also particularly preferred compounds. The mercapto group (—SH), in a case where it is tautomerically isomerizable, may form a thion group. Examples of such compound can include compounds having two or more adsorptive groups having the mercapto group or thion group described above as the partial structure (for example, ring-forming thioamide group, alkylmercapto group, arylmercapto group and heterocyclic mercapto group) in the molecule, or may have one or more of adsorptive groups having two or more mercapto groups or thion groups as the partial structure (for example, dimercapto substituted nitrogen-containing heterocyclic group).

Examples of the adsorptive groups having two or more mercapto groups as the partial structure (for example, dimercapto-substituted nitrogen-containing heterocyclic group, etc.) can include, for example, 2,4-dimercaptopyrimidine group, 2,4-dimercaptotriazine group, 3,5-dimercapto-1,2,4-triazole group, 2,5-dimercapto-1,3-thiazole group, 2,5-dimercapto-1,3-oxazole group, 2,7-dimercapto-5-methyl-s-triazolo(1, 5-A)-pyrimidine, 2,6,8-trimercaptopurine, 6,8-dimercaptopurine, 3,5,7-trimercapto-s-triazolotriazine, 4,6-dimercaptopyrazolopyrimidine, and 2,5-dimercaptoimidazole, 2,4-dimercaptopyrimidine group, 2,4-dimercaptotriazine group, and 3,5-dimercapto-1,2,4-triazole group being particularly preferred.

The adsorptive group may be substituted on any position of the general formulae (A) to (F) and the general formulae (1) to (3). It is preferably substituted on $RED_{11}$ $RED_{12}$, $RED_2$ and $RED_3$ in the general formula (A) to (D), on $RED_{41}$, $R_{41}$, $RED_{42}$, $R_{46}$–$R_{48}$ in the general formulae (E), (F), and on any optional position except for $R_1$, $R_2$, $R_{11}$, $R_{12}$, $R_{31}$, $L_1$, $L_{21}$, $L_{31}$ in the general formulae (1) to (3) and, further preferably, be substituted on $RED_{11}$–$RED_{42}$ in all of the general formulae (A)–(F).

The partial structure of the spectral sensitizing dye is a group containing a color forming group of the spectral sensitizing dye, which is a residue after removing an optional hydrogen atom or a substituent from a spectral sensitizing dye compound. The partial structure of the spectral sensitizing dye may be substituted at any position in the general formulae (A) to (F) and the general formulae (1) to (3), and it preferably substitutes at $RED_{11}$, $RED_{12}$, $RED_2$ and $RED_3$ in the general formula (A) to (D), at $RED_{41}$, $R_{41}$, $RED_{42}$, $R_{46}$–$R_{48}$ in the general formulae (E), (F), and at any optional position except for $R_1$, $R_2$, $R_{11}$, $R_{12}$, $R_{31}$, $L_1$, $L_{21}$, $L_{31}$ in the general formulae (1) to (3) and, further preferably, substitutes at $RED_{11}$–$RED_{42}$ in all of the general formulae (A) to (F). Preferred spectral sensitizing dye is a spectral sensitizing dye used typically in the color sensitizing technique and can include, for example, cyanine dyes, composite cyanine dyes, merocyanine dyes, composite merocyanine dyes, homopolar cyanine dyes, styryl dyes, hemicyanine dyes. Typical spectral sensitizing dyes are disclosed in Research Disclosure, Item 36544, September, 1994. Those skilled in the art can synthesizing the dyes described above in accordance with the procedures described in the Research Disclosure, or in The Cyanine Dyes and Related Compounds, by F. M. Hamer (Interscience Publishers, New York, 1964). Further, all of the dyes described in the specification in pages 7 to 14 of JP-A No. 11-95355 (U.S. Pat. No. 6,054,260) are applied as they are.

The compounds of types 1 to 4 in the present invention preferably, has the total number of carbon atoms in a range of 10 to 60. This, is more preferably, from 15 to 50, further preferably, 18 to 40 and, particularly preferably, 18 to 30.

The compounds of types 1 to 4 in the present invention undergo one-electron oxidation being triggered upon exposure of a silver halide photosensitive material using them and, after successive reaction, are further oxidized by releasing one electron or two or more electrons depending on the type. The oxidation potential at the first electron is, preferably, about 1.4 V or lower and, further preferably, 1.0 V or lower. The oxidation potential is, preferably, higher than 0 V and, more preferably, higher than 0.3 V. Accordingly, the oxidation potential is within a range, preferably, from about 0 to about 1.4 V and, more preferably, from about 0.3 to about 1.0 V.

The oxidation potential can be measured by the method of cyclic voltammetry. Specifically, it is measured by dissolving a material in a solution of acetonitrile : water (containing 0.1 M lithium perchlorate)=80% :20% (vol %), passing a nitrogen gas for 10 min, and then measuring at 25° C. with a potential scanning rate of 0.1 V/sec by using a glass-like carbon disk as an operation electrode, a platinum wire as a counter electrode and a calomel electrode (SCE) as a reference electrode. The oxidation potential-to-SCE is taken at a peak potential of cyclic voltammetry waves.

In a case where the compounds of types 1 to 4 in the present invention are compounds which undergo one-electron oxidation and, after succeeding reaction, release further one electron, the oxidation potential at the latter stage is, preferably, from −0.5 V to −2 V, more preferably, −0.7 V to −2 V, further preferably, from −0.9 V to −1.6 V.

In a case where the compounds of types 1 to 4 in the present invention are compounds which undergo one-electron oxidation and, after succeeding reaction, release further two or more electrons and undergo oxidation, the oxidation potential at the latter stage has no particular restriction. Since the oxidation potential at the second electron can not be distinguished from the oxidation potential after the third electron, it is often difficult to actually measure and distinguish them exactly.

Then, the compound of type 5 is to be described.

The compound of type 5 is represented by X—Y in which X represents a reducing group and Y represents a splitting group. One-electron oxidant formed by one-electron oxidation of the reducing group represented by X splits the group Y accompanying the successive cleavage reaction for X—Y bond to form X radical, from which further one electron can be released. The reaction when the compound of type 5 is oxidized can be represented by the following equation.

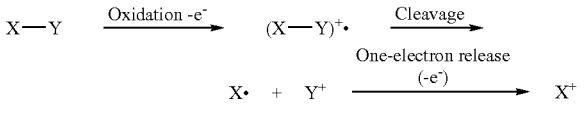

The oxidation potential of the compound of type 5 is preferably from 0 to 1.4 V, more preferably, from 0.3 V to 1.0 V. Further, the oxidation potential of radial X. formed by the reaction scheme shown above is preferably −0.7 V to −2.0 V and, more preferably, from −0.9 V to −1.6 V. The compound of type 5 is represented, preferably, by the general formula (G).

General formula (G)

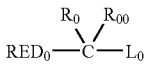

In the general formula (G), $RED_0$ represents a reducing group, $L_0$ represents a splitting group, and $R_0$ and $R_{00}$ each represents a hydrogen atom or a substituent. $RED_0$ and $R_0$, and $R_0$ and $R_{00}$ may join to each other to form a ring structure. $RED_0$ represents the identical group with that for $RED_2$ of the general formula (C) and a preferred range thereof is also identical. $R_0$ and $R_{00}$ represents the identical group with that for $R_{21}$ , $R_{22}$ of the general formula (C) and preferred ranges thereof are also identical. However, $R_0$ and $R_{00}$ do not represent groups identical with those of $L_0$ except for the case of hydrogen atom. The example for the cyclic structure can include examples identical with those in a case where $RED_2$ and $R_{21}$ of the general formula (C) are connected to form a ring structure and a preferred range thereof is also identical. Examples of the ring structure formed by bonding of $R_0$ and $R_{00}$ to each other can include, for example, a cyclopentane ring or tetrahydrofuran ring. $L_0$ in the general formula (G) is a group identical with that for $L_2$ in the general formula (C) and a preferred range thereof is also identical.

The compound represented by the general formula (G) preferably has an absorptive group to a silver halide or a partial structure of the spectral sensitizing dye in the molecule, but it does not have two or more adsorptive groups simultaneously in the molecule when $L_0$ represents a group other than the silyl group. However, it may have two or more sulfide groups as the adsorptive group irrespective of $L_0$. The adsorptive group to the silver halide in the compound represented by the general formula (G) can include, for example, those identical with the adsorptive groups which may be in the compounds of types 1 to 4 in the present invention and, in addition, include all of those described as "silver halide adsorption group" in the specification of JP-A No. 11-95355, in pages 4 to 7, and a preferred range thereof is also identical.

The partial structure of the spectral sensitizing dye which may be in the compound represented by the general formula (G) is identical with the partial structure of the spectral sensitizing dye which may be in the compounds of types 1 to 4 in the present invention, as well as can include all of those described as "light absorbing group" in the specification of JP-A 11-95355, in pages 7 to 14, and, preferred range thereof is also identical.

Specific examples of the compounds of types 1 to 5 in the present invention are to be set forth below but the present invention is not restricted to them.

1

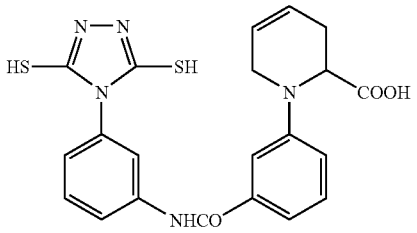

2

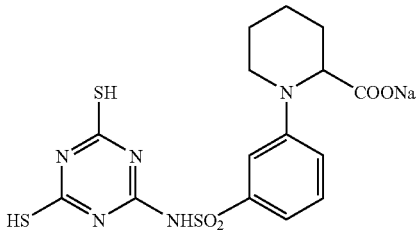

3

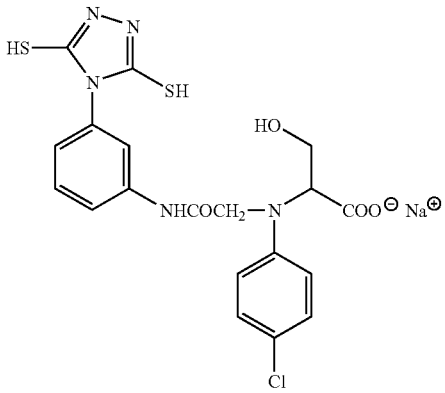

4

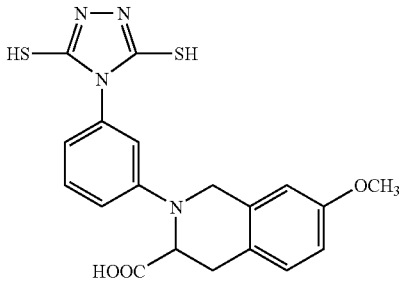

-continued
5
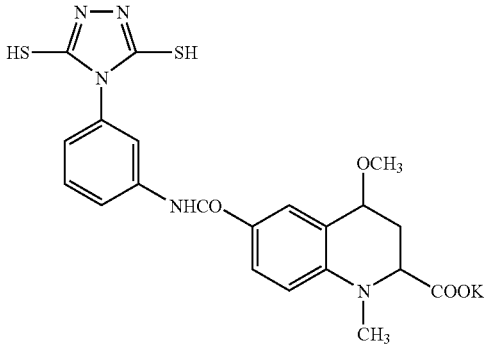
6
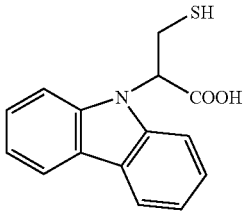
7
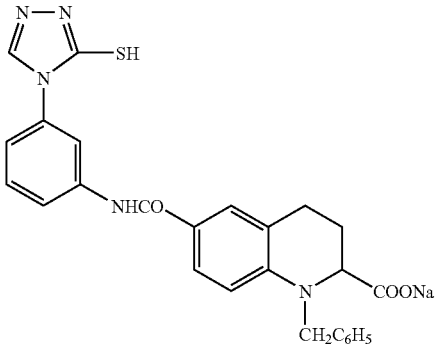
8
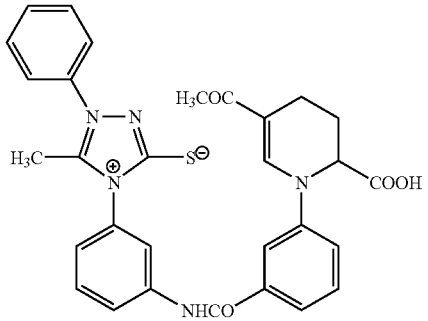
9
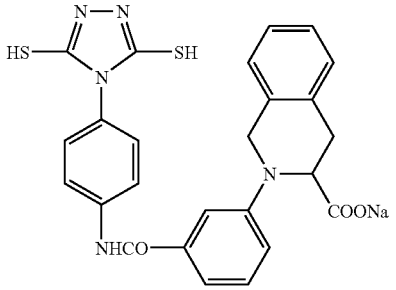
10
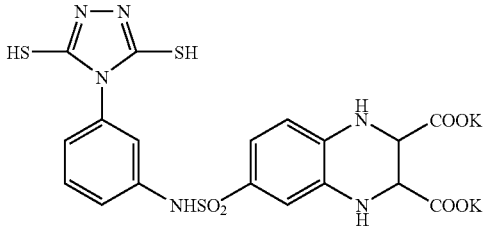
11
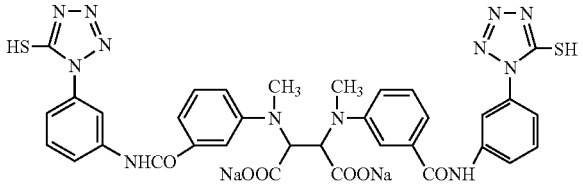
12
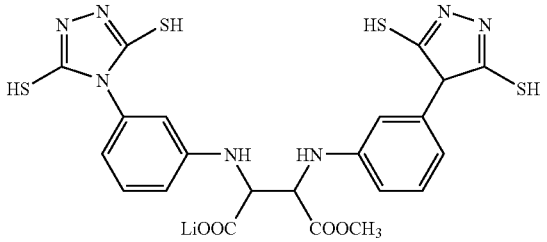
13
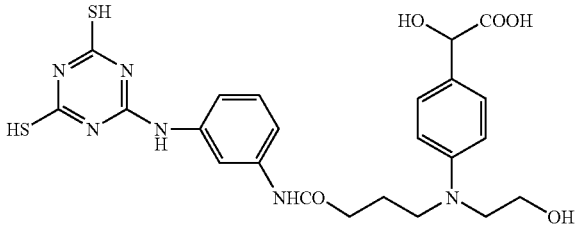
14
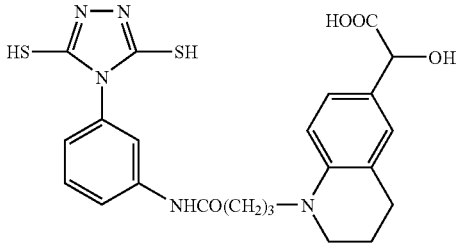

-continued
15
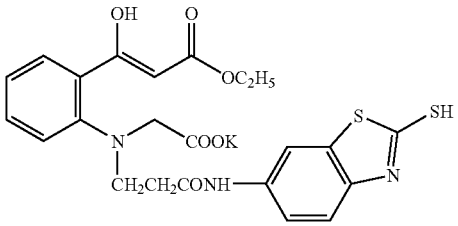
16
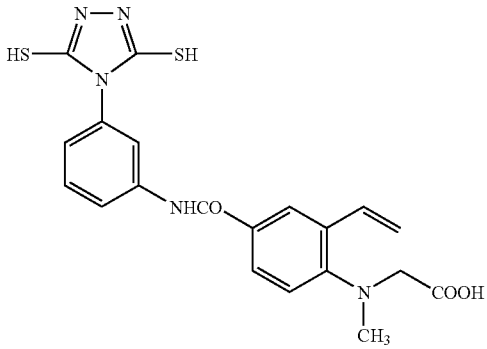
17
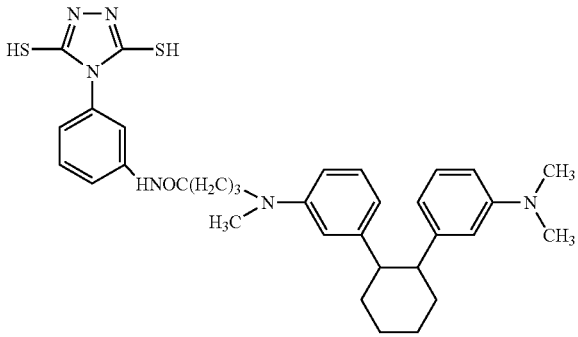
18
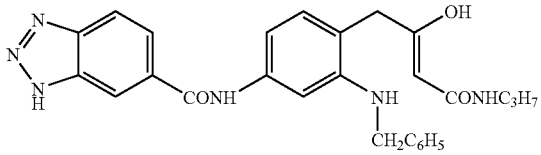
19
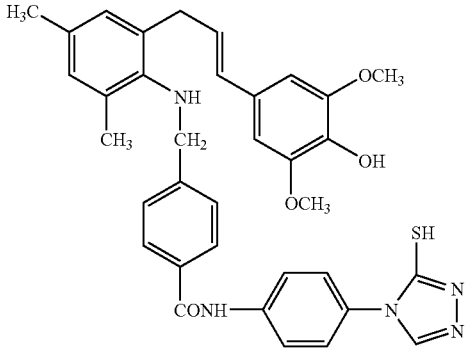
20
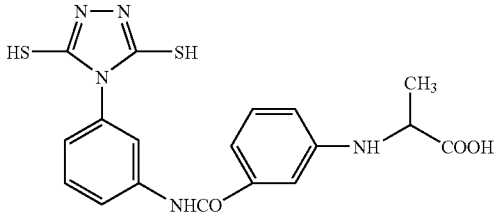
21
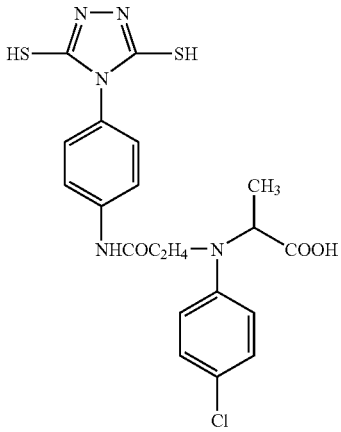
22
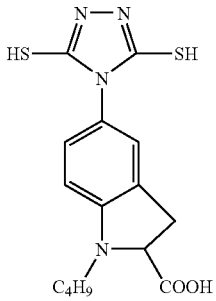

-continued
23
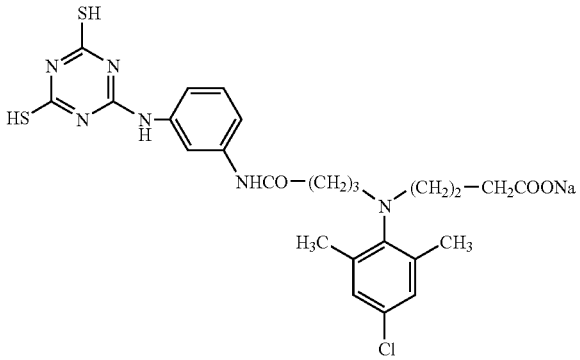
24
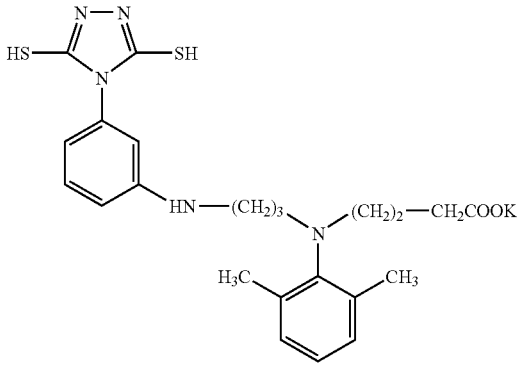
25
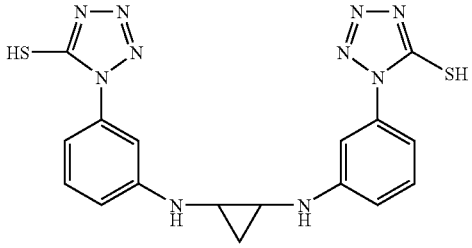
26
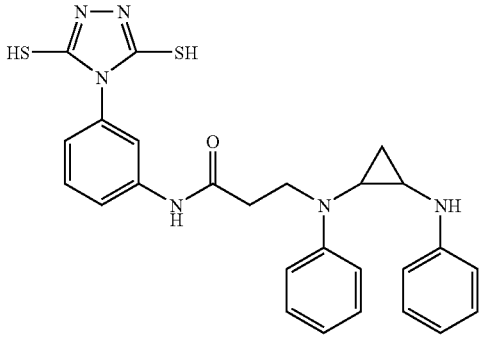
27
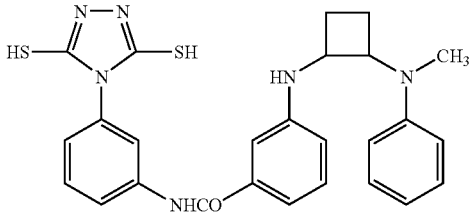
28
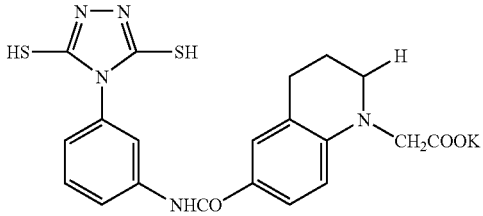
29
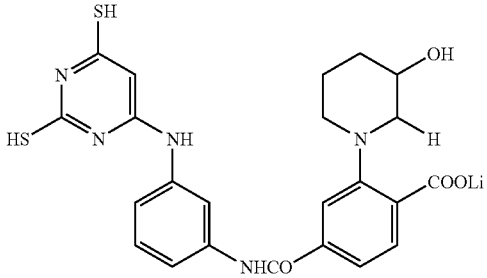
30
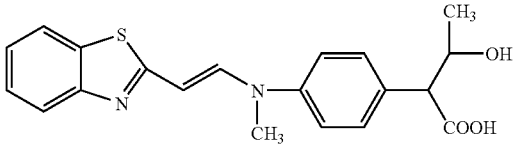
31
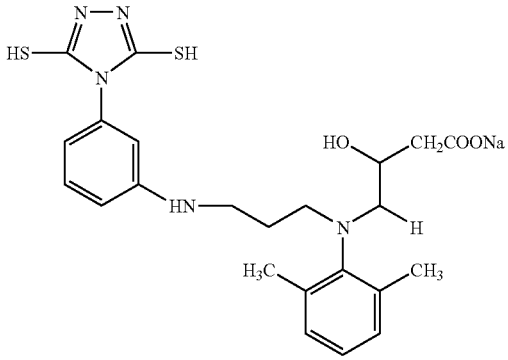
32
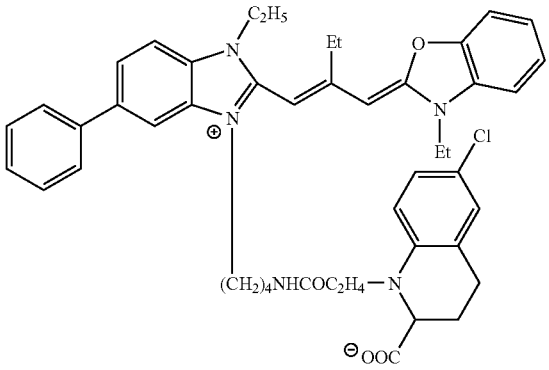

-continued
33
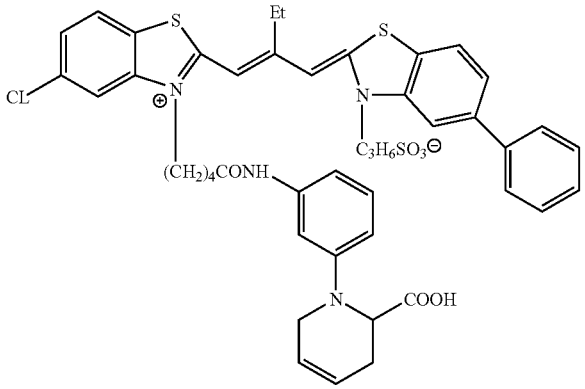
34
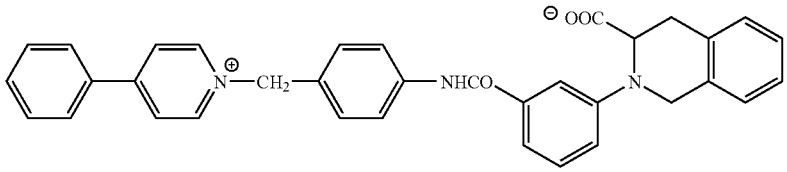
35
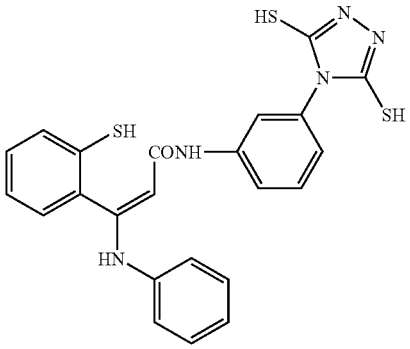
G-1
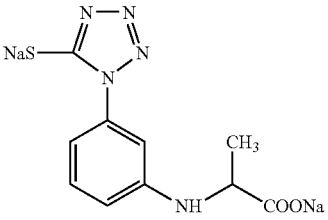
G-2
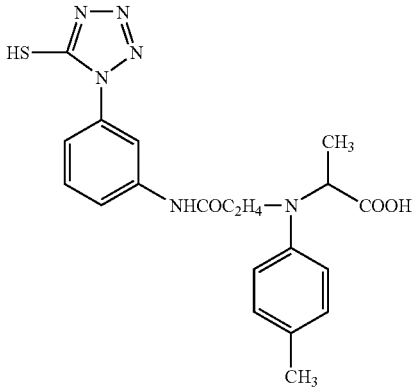
G-3
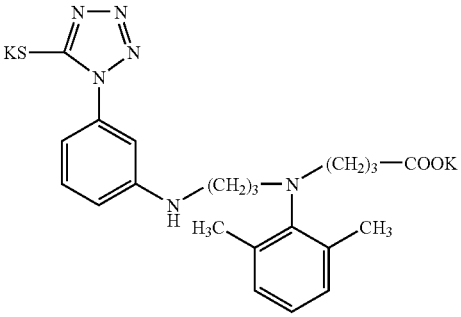

-continued

G-4

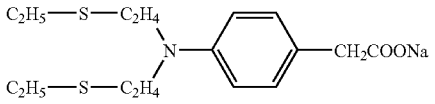

G-5

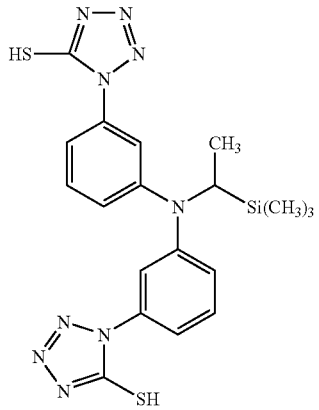

The compounds of types 1 to 4 in the present invention are identical with the compounds described specifically, in JP-A Nos. 2003-114487, 2003-114486, 2003-140287, 2003-075950 and 2003-114488 respectively. Examples of the specific compounds described in the specification of the patent applications described above can also be mentioned as specific examples for the compounds of types 1 to 4 in the present invention. Further, synthesis examples for the compounds of types 1 to 4 in the present invention are also identical with those described in the patent literatures.

Specific examples of the compounds of type 5 in the present invention can include, further, those compounds described in JP-A No. 9-211769 (compounds PMT-1 to S-37 described in Table E and Table F in pages 28–32), JP-A Nos. 9-211774, and 11-95355 (compound INV 1 to 36), JP-W No. 2001-500996 (compounds 1 to 74, 80 to 87, and 92 to 122), U.S. Pat. Nos. 5,747,235 and 5,747,236, EP No. 786692 A1 (compounds INV 1 to 35), EP-A No. 893732 Al, U.S. Pat. Nos. 6,054,260 and 5,994,051, which are referred to as "1-photon 2-electron sensitizing agent" or "deprotonating electron donating sensitizing agent".

The compound of types 1 to 5 in the present invention may be used at any step during preparation of the photosensitive silver halide emulsion or in the production steps for the photothermographic material. For example, the compound may be used upon formation of photosensitive silver halide particles, desalting step, during chemical sensitization and before coating. Further, the compound can be added divisionally by plural times during the steps and added, preferably, from the completion of formation of the photosensitive silver halide particles before the desalting step, during chemical sensitization Oust before starting to just after completion of chemical sensitization), and before coating and, more preferably, from the chemical sensitization till mixing with the non-photosensitive organic silver salt.

The compound of types 1 to 5 in the present invention is preferably added being dissolved in a water or a water soluble solvent such as methanol or ethanol or a mixed solvent of them. In a case of dissolving in water, a compound the solubility of which is improved by controlling pH to higher or lower may be added by dissolution while controlling the pH to higher or lower level.

The compound of types 1 to 5 in the present invention is preferably used in an image forming layer containing a photosensitive silver halide and a non-photosensitive organic silver salt but it may be added to a protection layer or an intermediate layer together with the image forming layer containing the photosensitive silver halide the and non-photosensitive organic silver salt and then diffused upon coating. The addition timing of the compound may be either before or after the sensitizing dye and is incorporated respectively in a silver halide emulsion layer, preferably, at a ratio of $1\times10^{-9}$ to $5\times10^{-1}$ and, more preferably, $1\times10^{-8}$ to $5\times10^{-2}$ mol per one mol of the silver halide.

1-3 Non-photosensitive Organic Silver Salt

The organic silver salt usable in the present invention is relatively stable to light and it functions as a silver ion supplier in a case where it is heated at 80° C. or higher in the presence of an exposed photo-catalyst (latent images of photosensitive silver halide, etc.) and a reducing agent, to form silver images.

Any organic substance capable of supplying silver ions that can be reduced by a reducing agent may be contained as an organic silver salt in addition to silver behenate. The non-photosensitive organic silver salt is described, for example, in JP-A No. 10-62899, in column Nos. 0048 to 0049, EP-A No. 0803764 A1, from page 18, line 24 to page 19, line 37, EP-A No. 0962812 A1, JP-A Nos. 11-349591, 2000-7683 and 2000-72711. Among them, silver salts of organic acid, particularly, silver salts of long chained aliphatic carboxylic acids (with number of carbon atoms of 10 to 30, preferably, 15 to 28) are preferred. Preferred examples of the fatty acid silver salts include, for example, silver lignocerate, silver behenate, silver arachidate, silver stearate, silver oleate, silver laurate, silver caproate, silver myristate, silver palmitate, silver erucate and mixtures thereof.

In the present invention, use of organic silver salts with the silver behenate content within a range, preferably, from 40 mol % or more and 99 mol % or less is preferred since they provide favorable characteristics for image storability, heat development activity and rapidness. The content is, preferably, 50 mol % or more and 95 mol % or less, more preferably, 60 mol % or more and 90 mol % or less, further preferably, 65 mol % or more and 85 mol % or less. Particularly for the design attaching importance to the image storability, the silver behenate content is, preferably, 70 mol % or more and 99 mol % or less and, more preferably, 80 mol % or more and 99 mol % or less. Further, in the design attaching importance to the heat developing activity and the rapidness, the silver behenate content is, preferably, 50 mol % or more and 85 mol % or less, more preferably, 55 mol % or more and 80 mol % or less. Further, it is preferably used at a silver erucate content of 2 mol % or less, more preferably, 1 mol % or less and, further preferably, 0.1 mol % or less.

There is no particular restriction on the shape of the organic silver salt usable in the present invention and it may be any of needle shape, rod shape, tabular or flaky shape.

In the present invention, a flaky organic silver salt is preferred. Short needle shape, rectangular, cuboidal or potato-like indefinite shaped particle with the major axis to minor axis ratio being less than 5 is also used preferably. Such organic silver particle has a feature of less suffering from fogging during heat development compared with long needle shape particles with the major axis to minor axis length ratio of 5 or more. Particularly, a particle with the major axis to minor axis ratio of 3 or less is preferred since it can improve the mechanical stability of the coating film. In the present specification, the flaky organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, when x is determined for the particles by the number of about 200, those capable of satisfying the relation: x (average)≧1.5, x being an average value is defined as a flaky shape. The relation is preferably: 30≧x (average)≧0.5 and, more preferably, 15≧x (average)≧1.5. By the way, needle shape is expressed as 1.5≧x (average) ≧1.

In the flaky particle, a can be regarded as a thickness of a plate particle having a main plate with b and c being as the sides. a in average is, preferably, 0.01 μm or more and 0.30 μm or less and, more preferably, 0.1 μm or more and 0.23 μm or less. c/b in average is, preferably, 1 or more and 6 or less, more preferably, 1 or more and 4 or less and, further preferably, 1 or more and 3 or less and, most preferably, 1 or more and 2 or less.

The particle size distribution of the organic silver salt is preferably a mono-dispersion. Mono-dispersion means that the percentage value obtained by dividing the standard deviations for the respective length of the minor axis and the major axis with the minor axis and the major axis respectively is preferably 100% or less, more preferably, 80% or less and, further preferably, 50% or less. As the method of measuring the shape of the organic silver salt, it can be determined from transmission type electron microscopic images for the dispersion of the organic silver salt. Another method of determining the mono-dispersibility is a method of determining the standard deviation for the volume addition average diameter of the organic silver salt, and the percentage value obtained by dividing the volume addition average diameter (fluctuation coefficient) is, preferably, 100% or less, more preferably, 80% or less and, further preferably, 50% or less. As the measuring method, a commercially available laser light scattering type particle size measuring device can be used for instance. The measuring method can also be used for the determination of other particle size to be described below.

For the production of the organic acid silver salts used in the present invention and the dispersion method thereof, known methods can be applied. Reference can be made, for example, to JP-A No. 10-62899, EP-A Nos. 0803763 A1 and 0962812 A1, JP-A Nos. 11-349591, 2000-7683, 2000-72711, 2001-163889, 2001-163890,. 2001-163827, 2001-033907, 2001-188313, 2001-083652, 2002-006442 and 2002-031870 described above.

When the photosensitive silver halide is present together upon dispersion of the organic silver salt, since fogging increases to remarkably lower the sensitivity, it is more preferred not to substantially contain the photosensitive silver halide during dispersion.

In the present invention, the amount of the photosensitive silver salt in the aqueous dispersion to which it is dispersed is, preferably, 1 mol % or less, more preferably, 0.1 mol % based on 1 mol of the organic acid silver salt in the liquid and, more preferably, the photosensitive silver salt is not added positively.

In the present invention, the photosensitive material can be produced by mixing an aqueous dispersion of an organic silver salt and an aqueous dispersion of a photosensitive silver salt, in which the mixing ratio between the organic silver salt and the photosensitive silver salt can be selected depending on the purpose. The ratio of the photosensitive silver salt to the organic silver salt is, preferably, within a range of 1 mol % or more and 30 mol % or less and, further, 2 mol % or more and 20 mol % or less and, particularly, within a range 3 mol % or more and 15 mol % or less.

Mixing of two or more kinds of the aqueous dispersions of organic silver salts and two or more kinds of aqueous dispersions. of the photosensitive silver salts upon mixing is a method used preferably for controlling the photographic properties.

The organic silver salt used in the present invention can be used at a desired amount and it is, preferably, from 0. 1 $g/m^2$ or more and 5 $g/m^2$ or less, more preferably, from 1 $g/m^2$ or more and 3 $g/m^2$ or less and, further preferably, from 1.2 $g/m^2$ or more and 2.5 $g/m^2$ or less as the amount of silver.

1-4 Reducing Agent

The reducing agent used in the present invention is to be described.

The photothermographic material according to the present invention preferably contains a heat developing agent as a reducing agent for the organic silver salt. The reducing agent for the organic silver salt may be any substance (preferably, organic substance) capable of reducing silver ion into metal silver.

Examples of the reducing agent described above are described in JP-A No. 11-65021 in column Nos. 0043-0045, and EP-A No. 0803764 A1, from page 7, line 34 to page 18, line 12.

In the present invention, the reducing agent is, preferably, a so-called hindered phenolic reducing agent or a bisphenolic reducing agent having a substituent on the ortho-position to the phenolic hydroxyl group, and the compound represented by the following general formula (R) is more preferred.

General formula (R)

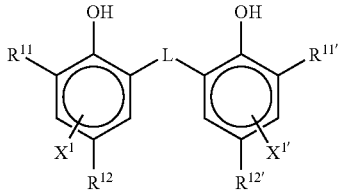

In the general formula (R), $R^{11}$ and $R^{11'}$ each represents independently an alkyl group of 1 to 20 carbon atoms. $R^{12}$ and $R^{12'}$ each represents independently a hydrogen atom or a substituent capable of substitution on the benzene ring. L represents —S— group or —$CHR^{13}$— group. $R^{13}$ represents a hydrogen atom or an alkyl group of 1 to 20 carbon atoms. $X^1$ and $X^{1'}$ each represents independently a hydrogen atom or a group capable of substitution on the benzene ring.

The general formula (R) is to be described specifically.

$R^{11}$ and $R^{11'}$ each represents independently a substituted or not-substituted alkyl group of 1 to 20 carbon atoms. While there is no particular restriction on the substituent of the alkyl group, it can preferably include, for example, aryl group, hydroxyl group, alkoxy group, aryloxy group, alkylthio group, arylthio group, acylamino group, sulfoneamide group, sulfonyl group, phosphoryl group, acyl group, carbamoyl group, ester group, ureido group, urethane group and halogen atom. $R^{12}$ and $R^{12'}$ each independently represents a hydrogen atom or a substituent capable of substitution on the benzene ring, and $X^1$ and $X^{1'}$ also represents each independently a hydrogen atom or a group capable of substitution on the benzene ring. The group capable of substitution on the benzene ring can include, preferably, an alkyl group, aryl group, halogen atom, alkoxy group and acylamino group.

L represents —S— group or —$CHR^{13}$— group. $R^{13}$ represents a hydrogen atom or an alkyl group of 1 to 20 carbon atoms and the alkyl group may have a substituent. Specific examples of the not-substituted alkyl group of $R^{13}$ can include, for example, methyl group, ethyl group, propyl group, butyl group, heptyl group, undecyl group, isopropyl group, 1-ethylpentyl group, and 2,4,4-trimethylpentyl group. Examples of the substituent for the alkyl group can include the same substituents as those for $R^{11}$.

$R^{11}$ and $R^{11'}$ can include each, preferably, a secondary or tertiary alkyl group of 3 to 15 carbon atoms and, specifically, isopropyl group, isobutyl group, t-butyl group, t-amyl group, t-octyl group, cyclohexyl group, cyclopentyl group, 1-methylcyclohexyl group, and 1-methylcyclopropyl group.

$R^{11}$ and $R^{11'}$ are more preferably tertiary alkyl groups of 4 to 12 carbon atoms. Among them, t-butyl group, t-amyl group and 1-methylcyclohexyl group are further preferred, with t-butyl group being most preferred.

$R_{12}$ and $R^{12'}$ are preferably alkyl groups of 1 to 20 carbon atoms and, specifically, include methyl group, ethyl group, propyl group, butyl group, isopropyl group, t-butyl group, t-amyl group, cyclohexyl group, 1-methylcyclohexyl group, benzyl group, methoxymethyl group, and methoxyethyl group. They are, more preferably, methyl group, ethyl group, propyl group, isopropyl group, and t-butyl group.

$X^1$ and $X^{1'}$ are preferably a hydrogen atom, halogen atom and alkyl group and, more preferably, hydrogen atom.

L is preferably —$CHR^{13}$— group.

$R^{13}$ is preferably a hydrogen atom or an alkyl group of 1 to 15 carbon atoms, and the alkyl group is preferably a methyl group, ethyl group, propyl group, isopropyl group, and 2,4,4-trimethylpentyl group. Particularly preferred $R^{13}$ is a hydrogen atom, methyl group, ethyl group, propyl group or isopropyl group.

In a case where $R^{13}$ is a hydrogen atom, $R^{12}$ and $R^{12'}$ are preferably alkyl groups of 2 to 5 carbon atoms. Ethyl group or propyl group is more preferred, with ethyl group being most preferred.

In a case where $R^{13}$ is a primary or secondary alkyl group of 1 to 8 carbon atoms, $R^{12}$ and $R^{12'}$ are preferably methyl group. As a primary or secondary alkyl group of 1 to 8 carbon atoms for $R^{13}$, a methyl group, ethyl group, propyl group and isopropyl group are more preferred and methyl group, ethyl group, and propyl group are further preferred.

In a case where each of $R^{11}$, $R^{11'}$, $R^{12}$ and $R^{12'}$ is a methyl group, $R^{13}$ is preferably a secondary alkyl group. The secondary alkyl group for $R^{13}$ is, preferably, an isopropyl group, isobutyl group, and 1-ethylpentyl group, isopropyl group being more preferred.

The reducing agent described above have different heat developability and color tone of developed silver depending on the combination of $R^{11}$, $R^{11'}$, $R^{12}$, $R^{12'}$ and $R^{13}$. Since they can be controlled by the combination of two or more kinds of reducing agents, it is preferred to use them in combination of two or more of them depending on the purpose.

Specific examples of the reducing agents including the compounds represented by the general formula (R) in the present invention are to be shown below but the present invention is not restricted to them.

(R-1)

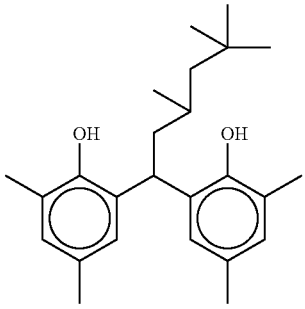

(R-2)

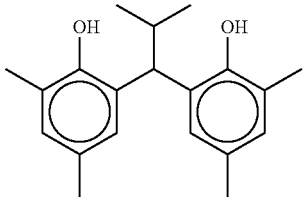

(R-3)

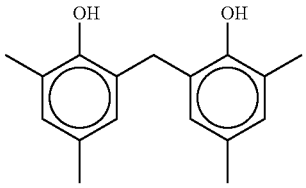

(R-4)

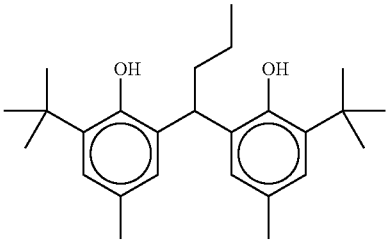

(R-5)

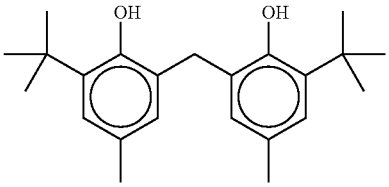

-continued
(R-6)
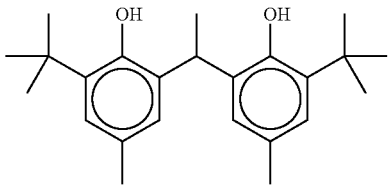
(R-7)
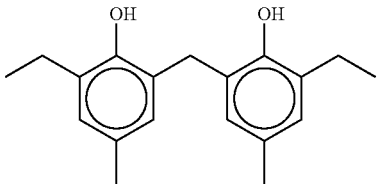
(R-8)
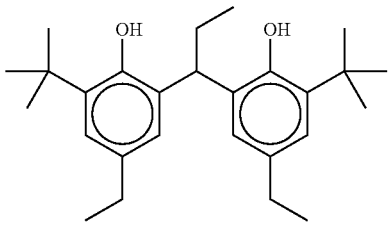
(R-9)
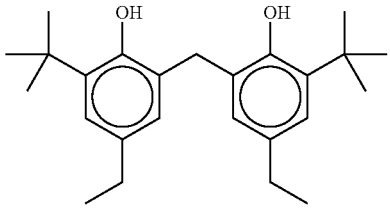
(R-10)
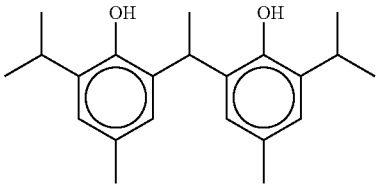
(R-11)
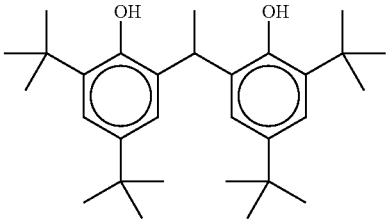
(R-12)
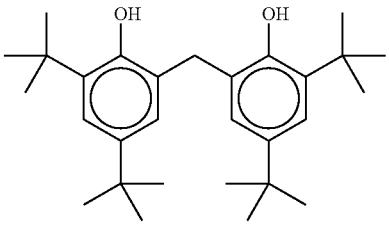
-continued
(R-13)
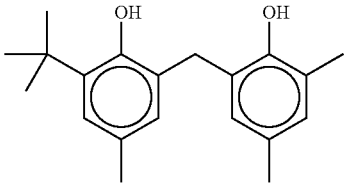
(R-14)
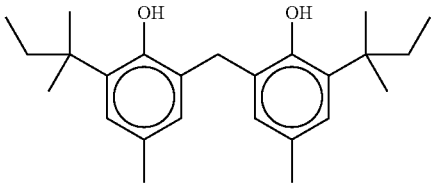
(R-15)
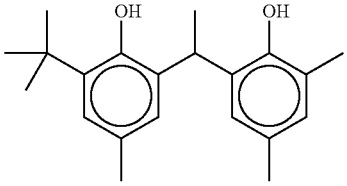
(R-16)
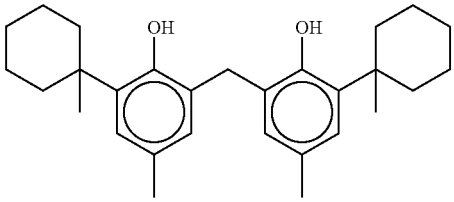
(R-17)
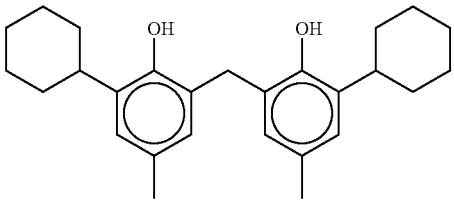
(R-18)
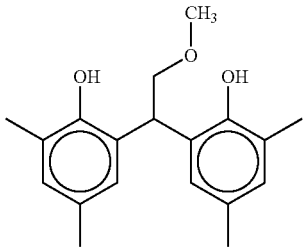
(R-19)
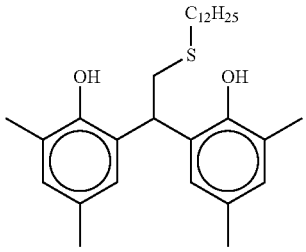

-continued
(R-20)
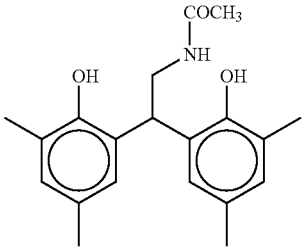
(R-21)
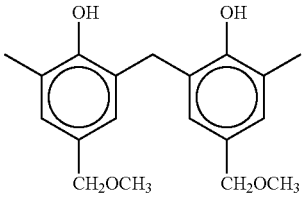
(R-22)
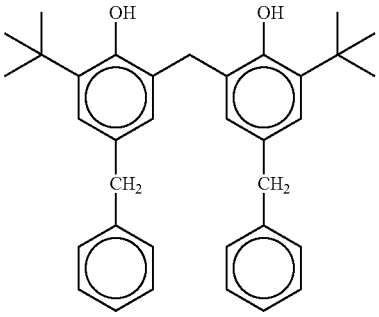
(R-23)
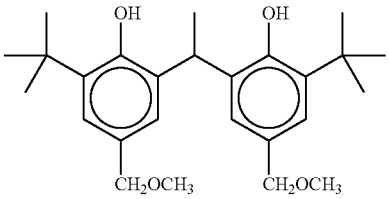
(R-24)
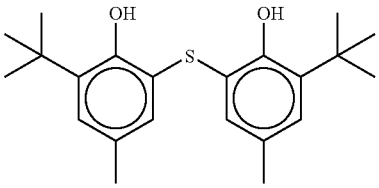
(R-25)
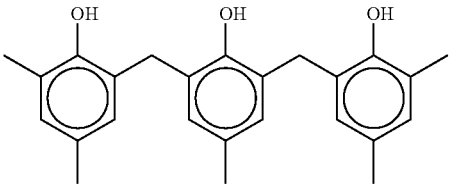
(R-26)
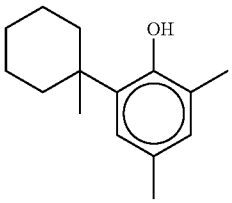
-continued
(R-27)
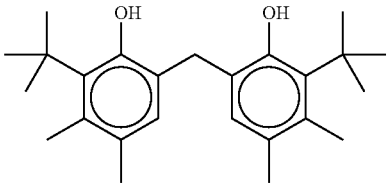
(R-28)
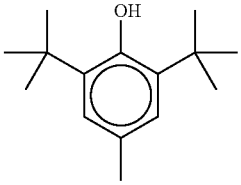
(R-29)
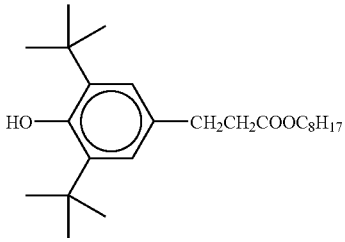
(R-30)
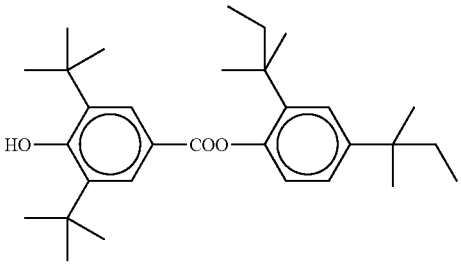
(R-31)
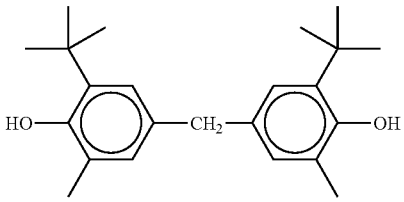
(R-32)
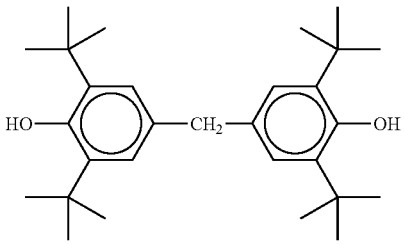
(R-33)
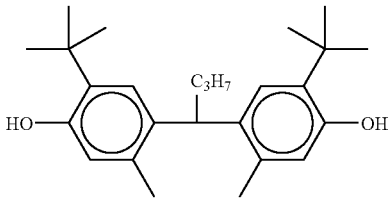

-continued (R-34)

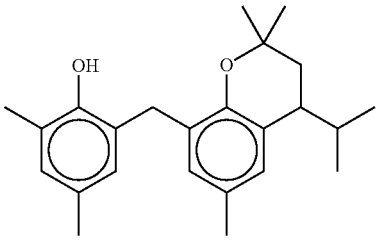

In the present invention, the addition amount of the reducing agent is, preferably, from 0.01 g/m$^2$ or more and 5.0 g/m$^2$ or less and, more preferably, from 0.1 g/m$^2$ or more and 3.0 g/m$^2$ or less. It is preferably contained by 5 mol % or more and 50 mol % or less, more preferably, 8 mol % or more and 40 mol % or less and, further preferably, 10 mol % or more and 30 mol % or less based on one mol of silver on the side of the surface having the image forming layer. The reducing agent is incorporated preferably in the image forming layer.

The reducing agent may be incorporated in a coating solution and incorporated in a photosensitive material by any form and method such as in the form of solution, emulsified dispersion or fine solid particle dispersion.

The well-known emulsifying dispersion method can include a method of dissolving by using oils such as dibutyl phthalate, tricresyl phosphate, glyceryl triacetate, and diethyl phthalate or auxiliary solvents such as ethyl acetate and cyclohexanone thereby preparing the emulsifying dispersion mechanically.

Further, the fine solid particle dispersion method can include a method of dispersing a powder of the reducing agent in an appropriate solvent such as water by a ball mill, colloid mill, vibration ball mill, sand mill, jet mill, roller mill or supersonic waves thereby preparing a solid dispersion. In this case, a protection colloid (for example, polyvinyl alcohol), surfactant (for example, anionic surfactant such as sodium triisopropyl naphthalene sulfonate (mixture of those having different substitution positions of three isopropyl groups)) may be used. In the mills described above, beads, for example, of zirconia are generally used as the dispersion medium, and Zr or the like leaching from the beads may sometimes be intruded into the dispersion. Depending on the dispersion condition, it is usually within a range from 1 ppm to 1000 ppm. If the content of Zr in the photosensitive material is 0.5 mg or less per 1 g of the silver, it causes no practical problem.

The liquid dispersion is preferably incorporated with a antiseptic (for example, sodium salt of benzoisothiazolinone).

1-5 Development Accelerator

The development accelerator used preferably in the photothermographic material of the present invention can include sulfoneamide phenolic compounds represented by the general formula (A) as described, for example, in the specification of JP-A No. 2000-267222 or specification of JP-A No. 2000-330234, hindered phenolic compound represented by the general formula (II) as described in JP-A No. 2001-92075, general formula (I) described in the specification of JP-A No. 10-62895 and the specification of JP-A No. 11-15116, and hydrazinic compounds represented by the general formula (1) described in the specification of JP-A No. 2002-278017, and phenolic or naphtholic compounds represented by the general formula (2) as described in the specification of JP-A No. 2001-264929. The development accelerator is used within a range from 0.1 mol % or more and 20 mol % or less, preferably, within a range from 0.5 mol % or more and 10 mol % or less and, more preferably, within a range from 1 mol % or more and 5 mol % or less based on the releasing agent. The method of introducing into the photosensitive material can include the method like that for the reducing agent and, particularly preferably, it is added as a solid dispersion or an emulsified dispersion.

In a case of adding as the emulsified dispersion, it is preferably added as an emulsified dispersion dispersed by using a high melting solvent which is solid at a normal temperature and an auxiliary solvent of a low boiling point, or added as a so-called oilless emulsified dispersion not using the high boiling point solvent. In the present invention, among the development accelerators described above, hydrazinic compounds represented by the general formula (1) described in JP-A No. 2002-278017 and naphtholic compounds represented by the general formula (2) described in JP-A No. 2001-264929 are particularly preferred.

Preferred specific examples of the development accelerators usable in the present invention are shown below. The present invention is not restricted to them.

(A-1)

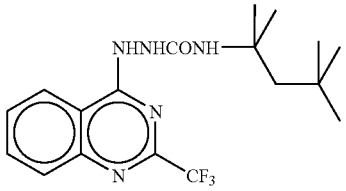

(A-2)

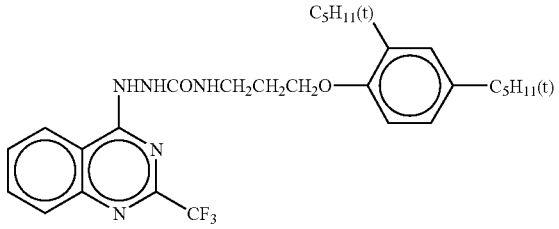

(A-3)

(A-4)

-continued

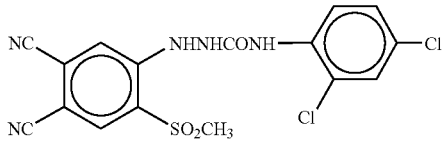

(A-5)

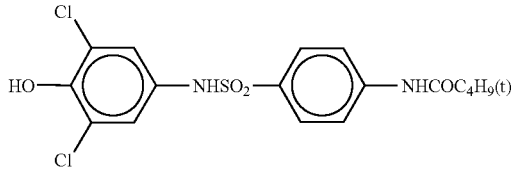

(A-6)

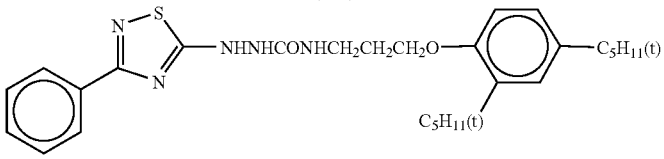

(A-7)

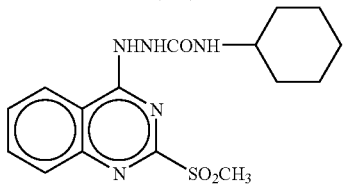

(A-8)

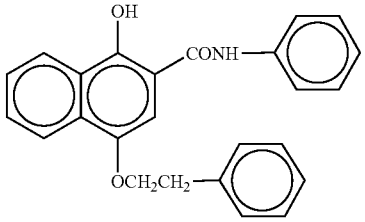

(A-9)

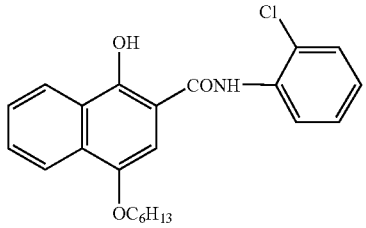

(A-10)

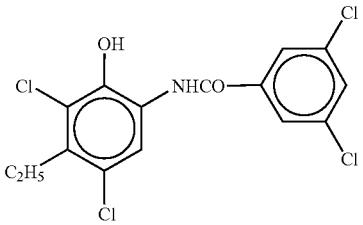

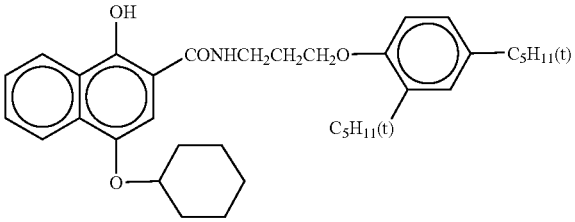

1-6 Hydrogen Bonding Compound

Then, the hydrogen bonding compounds used in the present invention are described.

In a case where the reducing agent in the present invention has an aromatic hydroxyl group (—OH), particularly, in the case of bisphenols described above, it is preferred to use a non-reducing compound having a group capable of forming hydrogen bond with the group described above in combination.

The group forming the hydrogen bond with the hydroxyl group or the amino group can include, for example, phosphoryl group, sulfoxide group, sulfonyl group, carbonyl group, amide group, ester group, urethane group, ureido group, tertiaryamino group, and nitrogen-containing aromatic group.

Among them, preferred are those compounds having phosphoryl group, sulfoxide group, amide group (not having >N—H group and blocked as >N—Ra (Ra: substituent other than H), urethane group (not having >N—H group and blocked as >N—Ra (Ra: substituent other than H), and ureido group (not having >N—H group and blocked as >N—Ra (Ra: substituent other than H).

In the present invention, a particularly preferred hydrogen bonding compound is a compound represented by the following general formula (D).

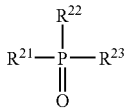

In the general formula (D), $R^{21}$ to $R^{23}$ each represents independently an alkyl group, aryl group, alkoxy group, aryloxy group, amino group or heterocyclic group, which may not have a substituent or have a substituent.

The substituent in a case where $R^{21}$ to $R^{23}$ has a substituent can include, for example, a halogen atom, alkyl group, aryl group, alkoxy group, amino group, acyl group, acylamino group, alkylthio group, arylthio group, sufoneamide group, acyloxy group, oxycarbonyl group, carbamoyl group, sulfamoyl group, sulfonyl group, and phosphoryl group and preferred substituent can include an alkyl group or aryl group, for example, a methyl group, ethyl group, isopropyl group, t-butyl group, t-octyl group, phenyl group, 4-alkoxyphenyl group, and 4-acyloxyphenyl group.

The alkyl group for $R^{21}$ to $R^{23}$ can include, specifically, a methyl group, ethyl group, butyl group, octyl group, dodecyl group, isopropyl group, t-butyl group, t-amyl group, t-octyl group, cyclohexyl group, 1-methylcyclohexyl group, benzyl group, phenethyl group, and 2-phenoxypropyl group.

The aryl group can include specifically, a phenyl group, cresyl group, xylyl group, naphthyl group, 4-t-butylphenyl group, 4-t-octylphenyl group, 4-anisidyl group, and 3,5-dichlorophenyl group.

The alkoxy group can include, specifically, a methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, and benzyloxy group.

The aryloxy group can include, specifically, a phenoxy group, cresyloxy group, isopropylphenoxy group, 4-t-butylphenoxy group, naphthoxy group, and biphenylxoy group.

The amino group can include, specifically, a dimethylamino group, diethylamino group, dibutylamino group, dioctylamino group, N-methyl-N-hexylamino group, dicyclohexylamino group, diphenylamino group, and N-methyl-N-phenylamino group.

For $R^{21}$ to $R^{23}$, an alkyl group, aryl group, alkoxy group, and aryloxy group are preferred. With a view point of the effect of the present invention, it is preferred that at least one of $R^{21}$ to $R^{23}$ is alkyl group or aryl group and it is more preferred that two or more of them are alkyl group or aryl group. Further, with a view point of availability at a reduced cost, it is preferred that $R^{21}$ to $R^{23}$ are identical groups.

Specific examples of the hydrogen bonding compounds including the compounds of the general formula (D) in the present invention are shown below but the present invention is not restricted to them.

(D-1)

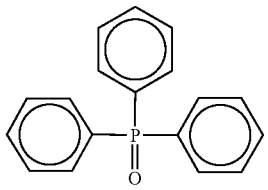

(D-2)

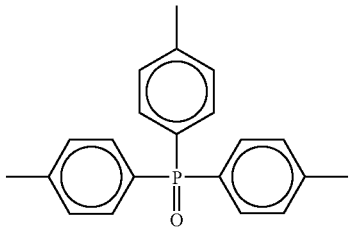

(D-3)

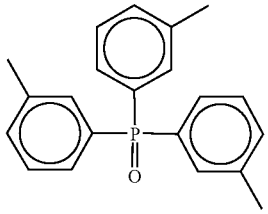

(D-4)

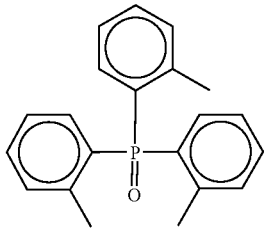

(D-5)

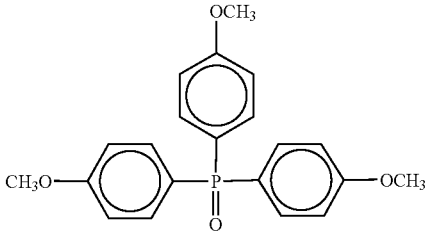

(D-6)

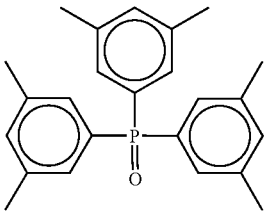

(D-7)

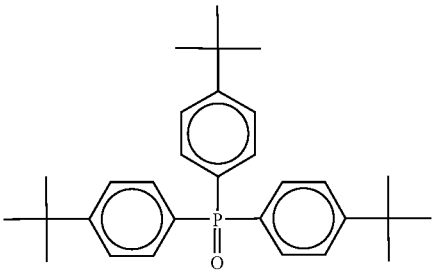

(D-8)

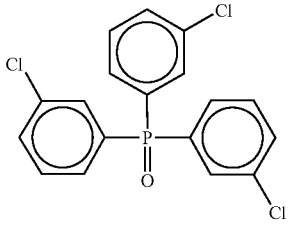

(D-9)

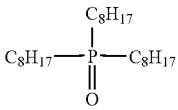

(D-10)

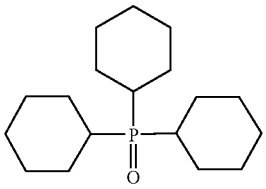

(D-11)

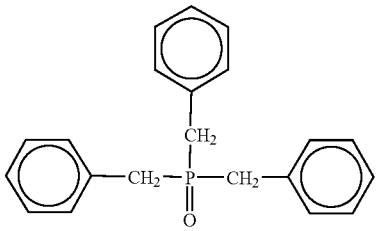

-continued (D-12)

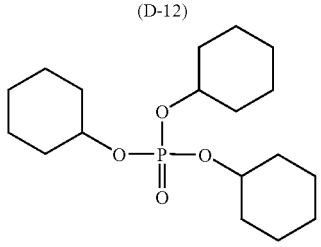

(D-13)

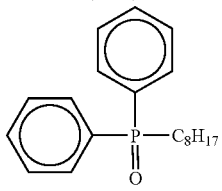

(D-14)

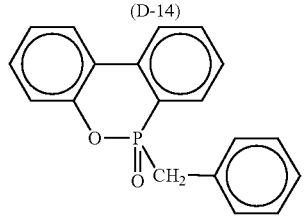

(D-15)

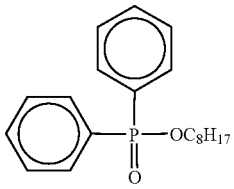

(D-16)

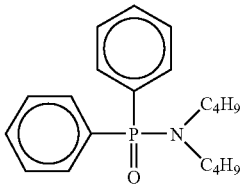

(D-17)

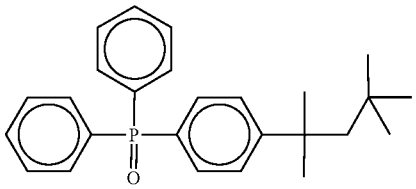

(D-18)

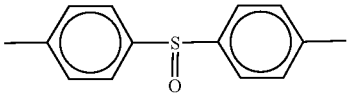

(D-19)

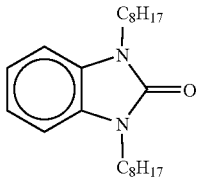

(D-20)

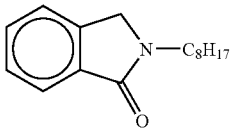

(D-21)

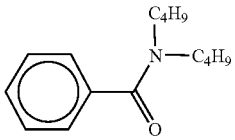

Specific examples of the hydrogen bonding compound can include those described in the specification of EP No. 1096310 and JP-A No. 2002-318431 in addition to those described above.

The compound of the general formula (D) in the present invention can be incorporated in the form of solution, emulsified dispersion and dispersion of finely dispersed solid particles into a coating liquid in the same manner as in the reducing agent and can be used in the photosensitive material. The compound forms a hydrogen bonding complex with a compound having a phenolic hydroxyl group or amino group in the state of solution and can be isolated in the crystalline state as a complex depending on the combination of the reducing agent and the compound of the general formula (D) in the present invention. Use of the thus isolated crystal powder as the dispersion of finely dispersed solid particles is particularly preferred for obtaining stable performance. Further, a method of powder-mixing the reducing agent and the compound of the general formula (D) in the present invention, and forming a complex during dispersion, for example, by a sand grinder mill (SGM) by using an appropriate dispersant can also be used preferably.

The compound of the general formula (D) is preferably used within a range from 1 mol % or more and 200 mol % or less, more preferably, within a range from 10 mol % or more and 150 mol % or less and, further preferably, within a range from 20 mol % or more and 100 mol % or less.

1-7 Binder

Then, the binder used in the present invention is to be described.

Any polymer may be used as a binder for the image forming layer in the present invention and suitable binder is transparent or translucent and generally colorless and can include polymers and copolymers of natural resins or synthetic resins, as well as other film-forming media, for example, gelatines, rubbers, poly(vinyl alcohols), hydroxyethyl celluloses, cellulose acetates, cellulose acetate butylates, poly(vinylpyrrolidones), casein, starch, poly(acrylic acids), poly(methylmethacrylic acids), poly(vinyl chlorides), poly(methacrylic acids), styrene-maleic acid anhydride copolymers, styrene-acrylonitrile copolymers, styrene-butadiene copolymers, poly(vinylacetals) (for example, poly(vinylformal), and poly(vinylbutyral)), poly (esters), poly(urethanes), phenoxy resins, poly(vinylidene chloride), poly(epoxides), poly(carbonates), poly(vinyl acetates), poly(olefins), cellulose esters, and poly(amides).

The binder may be formed by coating from water or an organic solvent or emulsion.

In the present invention, the glass transition temperature of the binder that can be used together for the organic silver salt containing layer (hereinafter sometimes also referred to as high Tg binder) is preferably 10° C. or higher and 80° C. or lower and it is, more preferably, 15° C. to 70° C. and, further preferably, 20° C. or higher and 65° C. or lower.

Tg is calculated according to the following equation in the present specification.

$$1/Tg=\Sigma(Xi/Tgi)$$

It is assumed here monomer ingredients by the number of n from i=1 to n are copolymerized in the polymer. Xi represents the weight ratio of the $i_{th}$ monomer ($\Sigma Xi=1$) and Tgi represents a glass transition temperature (absolute temperature) of a homopolymer of the $i_{th}$ monomer. $\Sigma$ is a sum for i=1 to m.

For the value Tgi of the glass transition temperature for the homopolymer of each of the monomers, values in Polymer Handbook (3rd Edition) (written by J. BR and Rup, E. H. ImmeRgut (Wiley-Interscience, 1989)) were adopted.

Two or more kinds of binders may be used together as required. Further, a binder with a glass transition temperature of 20° C. or higher and a binder with a glass temperature of lower than 20° C. may be used in combination. In the case of using two or more kinds of polymers of different Tg in combination, it is preferred that weight average Tg thereof is within the range described above.

In the present invention, it is preferred to form the image forming layer by using a coating solution in which 30 wt % or more of the solvent is water and coating and drying the same to form a coating layer.

In the present invention, in a case where the image forming layer is formed by using a coating solution in which 30 wt % or more of the solvent is water and coating and drying the same, and further in a case where the binder in the image forming layer is soluble or dispersible to an aqueous solvent (water solvent), the performance can be improved particularly when it comprises a polymer latex with an equilibrium water content at 25° C. and 60% RH of 2 wt % or less. Most preferred form is prepared such that the ionic conductivity is 2.5 mS/cm or lower and such preparation method can include a method of conducting purification by using a separation functional film after the synthesis of the polymer.

The aqueous solvent to which the polymer is soluble or dispersible mentioned herein is water or mixture of water and 70 wt % or less of a water miscible organic solvent.

The water miscible organic solvent can include, for example, alcohols such as methyl alcohol, ethyl alcohol, and propyl alcohol, cellosolves such as methyl cellosolve, ethyl cellosolve, and butyl cellosolve, ethyl acetate, and dimethylformamide.

The term "aqueous solvent" is used also to a system in which the polymer is not dissolved thermodynamically but is present in a so-called dispersed state.

"Equilibrium water content (wt %) at 25° C., 60% RH" can be expressed as below by using weight W1 for a polymer in a moisture controlled equilibrium under 25° C., 60% RH atmosphere and the weight WO for the polymer in an bone dried state:

$$\text{Equilibrium water content at 25° C., 60\% RH} = \{(W1 = -W0)/W0\} \times 100$$

For the definition and the measuring method of the water content, Polymer Engineering Course 14, Polymer Material Test Method (edited by Polymer Society, published from Chijin Shokan) can be referred to for instance.

The equilibrium water content of the binder polymer usable in the present invention at 25° C., 60% RH is, preferably, 2 wt % or less, more preferably, 0.01 wt % or more and 1.5 wt % or less and, further preferably, 0.02 wt % or more and 1 wt % or less.

In the present invention, a polymer dispersible in an aqueous solvent is particularly preferred. As an example of the dispersed state, either a latex in which fine particles of water insoluble hydrophobic polymer are dispersed, or a dispersion of polymer molecules in a state of molecules or forming micelle may be used, with the latex-dispersed particles being more preferred.

The average particle size of the dispersed particles is within a range from 1 nm or more and 50,000 nm or less, preferably, from 5 nm or more and 1000 nm or less, more preferably, within a range from 10 nm or more and 500 nm or less and, further preferably, within a range from 50 nm or more and 200 nm or less. There is no particular restriction on the particle size distribution of the dispersed particles which may have a wide particle size distribution or a particle size distribution of mono dispersion. Use of two or more of those having particle size distributions of mono dispersion in admixture is also a preferred method of use in view of control for the physical property of the coating solution.

As preferred embodiments of polymers dispersible to the aqueous solvent in the present invention, hydrophobic polymer such as acrylic polymers, poly(esters), rubbers (for example SBR resin), poly(urethanes), poly(vinyl chlorides), poly(vinyl acetates), poly(vinylidene chlorides), and poly (olefins) can be used preferably. The polymer may be a linear polymer or branched polymer, or crosslinked polymer, as well as it may be a so-called homopolymer in which single monomers are polymerized or a copolymer in which two or more kinds of monomers are polymerized. In the case of the copolymer, it may be either a random copolymer or a block copolymer.

The molecular weight of the polymer, based on the number average molecular weight, is from 5,000 or more and 1,000,000 or less, preferably, 10,000 or more and 200,000 or less. A polymer with excessively small molecular weight provides insufficient dynamic strength for the image forming layer, whereas a polymer of excessively large molecular weight is not preferred since the film-deposition property is poor. Further, the crosslinking polymer latex can be used particularly preferably.

-Specific Example of Polymer Latex-

Specific examples of preferred polymer latex are shown below but the present invention is not restricted to them.

The latex is to be expressed by using starting monomers and numerical values in parentheses mean wt % and the molecular weight is a number average molecular weight. In a case of using the polyfunctional monomer, since it forms a crosslinking structure and the concept of the molecular weight can not be applied, it is described as crosslinking with description for the molecular weight being omitted.

Tg Represents a Glass Transition Temperature

P-1: -MMA (70)-EA(27)-MAA(3) latex (molecular weight 37,000, Tg 61° C.)

P-2: -MMA (70)-2EHA(20)-St(5)-AA(5) latex(molecular weight 40,000, Tg 59-C)

P-3: -St(50)-Bu(47)-MAA(3) latex (crosslinking, Tg −17° C.)

P-4: -St(68)-Bu(29)-AA(3) latex (crosslinking, Tg 17° C.)

P-5: -St(71)-Bu(26)-AA(3) latex (crosslinking, Tg 24° C.)

P-6: -St(70)-Bu(27)-IA(3) latex (crosslinking),

P-7: -St(75)-Bu(24)-AA(l) latex (crosslinking, Tg 29° C.).

P-8: -St(60)-Bu(35)-DVB-(3)-MAA(2) latex (crosslinking),

P-9: -St(70)-Bu(25)-DVB-(2)-AA (3) latex (crosslinking),

P-10: -VC(50)-MMA(20)-EA(20)-AN(5)-AA(5) latex (molecular weight 80,000),

P-11: -VDC(85)-MMA(5)-EA(5)-MAA(5) latex (molecular weight 67,000),

P-12: -Et(90)-MAA(10) latex (molecular weight 12,000),

P-13: -St(70)-2EHA(27)-AA(3) latex (molecular weight 130,000, Tg 43-C)

P-14: -MMA(63)-EA(35)-AA(2) latex (molecular weight of 33,000, Tg 47-C),

P-15: -St(70.5)-Bu(26.5)-AA(3) latex (crosslinking, Tg 23° C.),

P-16: -St(69.5)-Bu(27.5)-AA (3) latex (crosslinking, Tg 20.5° C.).

The abbreviations for the structure represent the following monomers. MMA; methyl methacrylate, EA; ethyl acrylate, MAA: methacrylic acid, 2EHA: 2-ethylhexylacrylate, St; styrene, Bu; butadiene, AA; acrylic acid, DVB; divinyl benzene, VC; vinyl chloride, AN; acrylonitrile, VDC; vinylidene chloride, Et; ethylene, IA; itaconic acid.

The polymer latexes described above are also commercially available and the following polymers can be utilized. They can include CEBIAN A-4635, 4718, 4601 (all manufactured by Dicel Chemical Industry Co. Ltd.), and Nipol Lx 811.814, 821, 820, 857 (manufactured by Nippon Zeon Co.) as examples for the acrylic polymer, FINETEX, ES 650, 611, 675, 850 (manufactured by Dainippon Ink Chemical Co.), WD-size, WMS (manufactured by Eastman Chemical Co.) as examples for polyesters, HYDRAN AP 10, 20, 30 and 40 (manufactured by Dai Nippon Ink Chemical Co.) as examples for polyurethanes, LACSTAR 7310K, 3307B, 4700H and 7132C (manufactured by Dainippon Ink Chemical Co.), and Nipol Lx 416, 410, 438C and 2507 (manufactured by Nippon Zeon Co.) as examples for rubbers. G 351, G576 (manufactured by Nippon Zeon Co.) as examples for polyvinyl chlorides, L 502, L513 (manufactured by Asahi Kasei Industry Co.) as examples for polyvinylidene chlorides, and CHEMIPAL S120, SA100 (manufactured by Mitsui Chemical Co.) as examples for polyolefins.

The polymer latexes described above may be used alone or two or more of them may be blended as required.

As the polymer latex used in the present invention, latex of styrene-butadiene copolymer is particularly preferred. The weight ratio between the styrene monomer unit and the butadiene monomer unit in the styrene-butadiene copolymer is, preferably, 40:60 to 95:5. Further, the ratio of the styrene monomer unit and the butadiene monomer unit in the copolymer is, preferably, 60 wt % or more and 99 wt % or less. Further, the polymer latex in the present invention contains acrylic acid or methacrylic acid, preferably, by 1 wt % or more and 6 wt % or less and, more preferably, 2 wt % or more and 5 wt % or less based on the sum of styrene and butadiene. The polymer latex in the present invention preferably contains acrylic acid.

The latex of the styrene-butadiene copolymer preferably used in the present invention can include, for example, P-3 to P-8 and 15 described above, and LACSTAR-3307B, 7132C, Nipol Lx416 as commercial products.

Tg of the latex of the styrene-butadiene copolymer is, preferably, 10° C. or higher and 30° C. or lower and, more preferably, 17° C. or higher and 25° C. or lower.

A hydrophilic polymer such as gelatin, polyvinyl alcohol, methyl cellulose, hydroxypropyl cellulose and carboxymethyl cellulose may be added optionally to the image forming layer of the photosensitive material in the present invention. The addition amount of the hydrophilic polymer is, preferably, 30 wt % or less and, more preferably, 20 wt % or less for the entire binder of the image forming layer.

The organic silver salt containing layer (that is, image forming layer) in the present invention is preferably formed by using the polymer latex. The amount of the binder in the image forming layer is that the weight ratio of the entire binder/organic silver salt is, within a range, of, preferably, from 1/10 to 10/1, more preferably, 1/3 to 5/1 and, further preferably, 1/1 to 3/1.

Further, the organic silver salt containing layer is usually also a photosensitive layer containing the photosensitive silver halide as the photosensitive silver salt (emulsion layer, image forming layer), in which the weight ratio for the entire binder/silver halide is within a range, preferably, from 400/1 to 5/ 1, more preferably, 200 /1 to 10/1.

The entire amount of the binder in the image forming layer of the present invention is within a range, preferably, 0.2 g/m$^2$ or more and 30 g/m$^2$ or less, more preferably, 1 g/m$^2$ or more and 15 g/m$^2$ or less and, further preferably, 2 g/m$^2$ or more and 10 g/m$^2$ or less. In the image forming layer of the present invention, a crosslinker for closslinking and a surfactant for the improvement of the coatability may also be added.

1-8 Preferred Solvent for Coating Solution

A solvent for image forming layer coating solution of the photosensitive material in the present invention (for the sake of simplicity, solvent and the dispersant are collectively referred to as the solvent) is preferably an aqueous solvent containing 30 wt % or more of water.

As the ingredient other than water, any water miscible organic solvent such as methyl alcohol, ethyl alcohol, isopropyl alcohol, methyl cellosolve, ethyl cellosolve, dimethyl formamide, and ethyl acetate may be used. The water content in the solvent for the coating solution is, preferably, 50 wt % or more and, more preferably, 70 wt % or more.

Examples of preferred solvent composition can include, in addition to water, water/methyl alcohol=90/10, water/methyl alcohol=70/30, water/methyl alcohol/dimethylformamide=80/15/5, water/methyl alcohol/ethyl cellosolve=85/10/5, and water/methyl alcohol/isopropyl alcohol=85/10/5 (numerical value based on wt %).

1-9 Anti-foggant

The anti-foggant used in the present invention is to be described next.

The anti-foggant, the stabilizer and the stabilizer precursor usable in the present invention can include those described in JP-A No. 10-62899, in column No. 0070, EP-A No. 0803764A1, in page 20, line 57-page 21, line 7, compounds described in JP-A Nos. 9-281637 and 9-329864, compounds described in U.S. Pat. No. 6,083,681 and EP No. 1048975.

Further, the anti-foggant used preferably in the present invention is an organic halogen compound and includes those disclosed in JP-A No. 11-65021, in column Nos. 0111 to 0112. Particularly, the organic halogen compound represented by the formula (P) in JP-A No. 2000-284399, the organic polyhalogen compound represented by the general formula (II) in JP-A No. 10-339934 and the organic polyhalogen compounds described in JP-A Nos. 2001-31644 and 2001-33911 are preferred.

-Polyhalogen Compound-

Preferred organic polyhalogen compounds in the present invention are to be described specifically.

The preferred polyhalogen compound in the present invention is a compound represented by the following general formula (H).

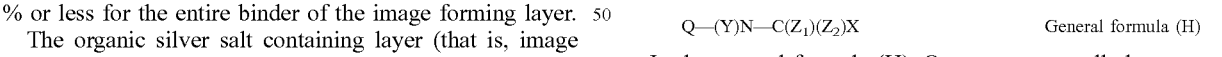

$$Q—(Y)N—C(Z_1)(Z_2)X \qquad \text{General formula (H)}$$

In the general formula (H), Q represents an alkyl group, aryl group or heterocyclic group, Y represents a bivalent connection group, n represents 0 or 1, $Z_1$ and $Z_2$ each represents a halogen atom and X represents a hydrogen atom or an electron attractive group.

In the general formula (H), Q preferably represents a phenyl group substituted with an electron attractive group in which the Hammett's substituent group constant up takes a positive value. For the Hammett's substituent constant, Journal of Medicinal Chemistry, 1973, vol. 16, No. 11, pages 1207–1216 etc. can be referred to.

The electron attractive group described above can include, for example, halogen atom (fluorine atom (σp value: 0.06), chlorine atom (σp value: 0.23), bromine atom (σp value: 0.23), iodine atom (σp value: 0.18)), trihalomethyl group (tribromomethyl (σp value: 0.29), trichloromethyl (σp value: 0.33), trifluoromethyl (σp value: 0.54)), cyano group (σp value: 0.66), nitro group (σp value: 0.78), aliphatic sulfonyl group (for example, methanesulfonyl (σp value: 0.72)), aryl sulfonyl group, heterocyclic sulfonyl group, aliphatic acyl group (for example, acetyl (σp value: 0.50), aryl acyl group ( for example, benzoyl (σp value: 0.43)), heterocyclic acyl group, alkinyl group (for example, C≡CH (σp value: 0.23)), aliphaticoxy carbonyl group (for example, methoxy carbonyl (σp value: 0.45), aryloxy carbonyl group (for example, phenoxy carbonyl (σp value: 0.44)), heterocyclicoxy carbonyl group, carbamoyl group (σp value: 0.36), sulfamoyl group (σp value: 0.57), sulfoxide group, heterocyclic group, and phosphoryl group. The σp value is, preferably, within a range from 0.2 to 2.0 and, more preferably, 0.4 to 1.0.

Particularly, preferred electron attractive groups are carbamoyl group, alkoxycarbonyl group, alkylsulfonyl group, and alkylphosphoryl group, with carbamoyl group being most preferred among them.

X is preferably an electron attractive group and, more preferably, a halogen atom, aliphatic sulfonyl group, aryl sulfonyl group, heterocyclic sulfonyl group, aliphatic acyl group, aryl acyl group, heterocyclic acyl group, aliphatic oxycarbonyl group, aryloxy carbonyl group, heterocyclic oxycarbonyl group, carbamoyl group, and sulfamoyl group, with the halogen atom being particularly preferred. Among the halogen atoms, preferred are chlorine atom, bromine atom and iodine atom, and further preferred are chlorine atom and bromine atom, with the bromine atom being particularly preferred.

Y represents, preferably, —C(═O)—, —SO— or —$SO_2$— and, more preferably, —C(═O)—, and —$SO_2$— and, particularly preferably, —$SO_2$—. N represents 0 or 1 and, preferably, 1. Specific examples of the compounds of the general formula (H) of the present invention are shown below.

(H-1)

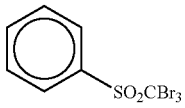

(H-2)

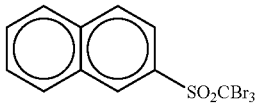

(H-3)

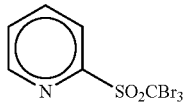

(H-4)

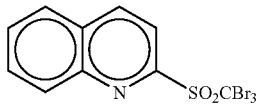

(H-5)

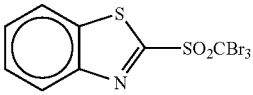

(H-6)

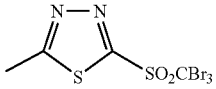

(H-7)

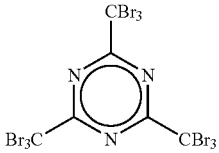

(H-8)

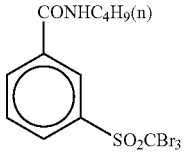

(H-9)

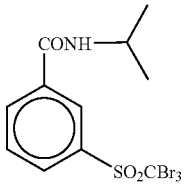

(H-10)

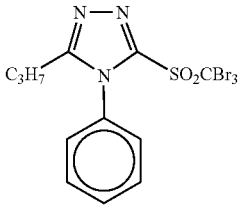

(H-11)

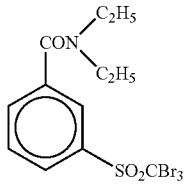

(H-12)

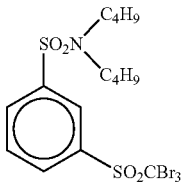

(H-13)

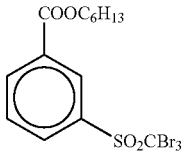

(H-14)

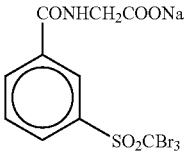

(H-15)

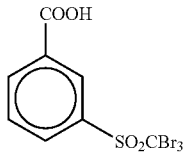

(H-16)

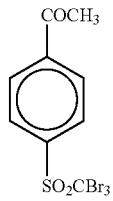

(H-17)

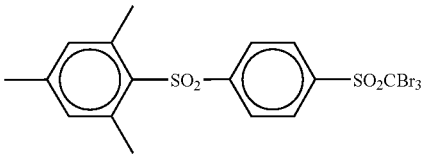

(H-18)

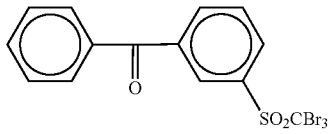

-continued (H-19)

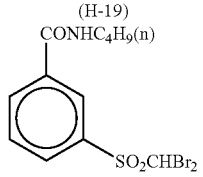

(H-20)

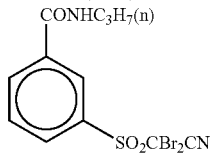

(H-21)

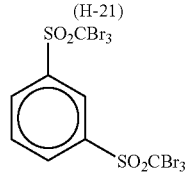

(H-22)

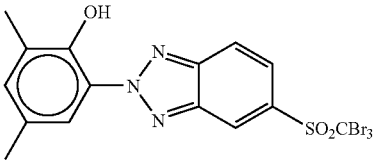

(H-23)

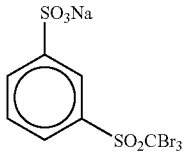

(H-24)

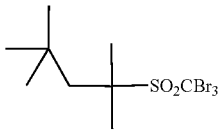

The compound represented by the general formula (H) in the present invention is used, based on 1 mol of the non-photosensitive silver salt of the image forming layer, preferably, within a range of $1\times10^{-4}$ mol or more and 0.5 mol or less, more preferably, within a range of $10^{-3}$ mol or more and 0.1 mol or less and, further preferably, within a range of $5\times10^{-3}$ mol or more and 0.05 mol or less.

In the present invention, the method of incorporating the anti-foggant in the photosensitive material can include a method as described for the method of incorporating the reducing agent, and also the organic polyhalogen compound is preferably added as a fine solid particle dispersion.

-Other Anti-foggant-

Other anti-foggants can include mercury (II) salt in column No. 0113 and benzoic acids in column No. 0114 of JP-A No. 11-65021, salicylic acid derivative in JP-A 2000-206642, a formalin scavenger compound represented by the formula (S) in JP-A No. 2000-221634, a triazine compound according to claim 9 of JP-A No. 11-352624, a compound represented by the general formula (III) of JP-A No. 6-11791, and 4-hydroxy-6-methyl-1,3,3a,7-tetrazaindene.

The photothermographic material in the present invention may also contain an azolium salt with an aim of preventing fogging. The azolium salt can include the compound represented by the general formula (XI) described in JP-A No. 59-193447. The compound described in JP-B No. 55-12581, and the compound represented by the general formula (II) described in JP-A No. 60-153039. The azolium salt may be added at any portion in the photosensitive material and it is preferably added as the addition layer to the layer of the surface having the image forming layer and, further preferably, added to the image forming layer.

For the addition timing, the azolium salt may be added at any step for the preparation of the coating solution. In a case where it is added to the image forming layer, it may be added at any step from the preparation of the organic silver salt to the preparation of the coating solution, and it is preferably added in the course after the preparation of the organic silver salt to immediately before coating. The azolium salt may be added by any method such as in the form of powder, solution and fine particle dispersion. Further, it may also be added as a solution in admixture with other additives such as the sensitizing dye, reducing agent or color toning agent.

In the present invention, the azolium salt may be added in any amount and it is preferably $1\times10^{-6}$ mol or more and 2 mol or less and, further preferably, $1\times10^{-3}$ mol or more and 0.5 mol or less per 1 mol of silver.

1-10 Other Additives

1) Mercaptos, Disulfides and Thions

In the present invention, mercapto compound, disulfide compound and thion compound can be incorporated for suppressing or promoting development thereby controlling development, for improving the spectral sensitizing efficiency or improving the storability before and after development, which are described in JP-A No. 10-62899, in column Nos. 0067 to 0069, as compound represented by the general formula (I) in JP-A No. 10-186572 and in column Nos. 0033 to 0052 thereof as specific examples thereof and in EP-A No. 0803764 A1, page 20, lines 36 to 56. Among them, mercapto-substituted heterocyclic aromatic compounds described in JP-A Nos. 9-297367, 9-304875, 2001-100358 are preferred.

2) Toning Agent

In the photothermographic material of the present invention, addition of a color toning agent is preferred, and the color toning agent is described in JP-A No. 10-62899, in column Nos. 0054 to 0055, EP-A No. 0803764 A1 in page 21, lines 23–48, and JP-A No. 2000-356317. Particularly, phthalazinones (phthalazinone, phthalazinone derivatives or metal salts; for example, 4-(1-naphthyl) phthalazinone, 6-chlorophthalazinone, 5,7-dimetoxyphthalazinone and 2,3-dihydro-1,4-phthalazinone); combination of phthalazinones and phthalic acids (for example, phthalic acid, 4-methyl phthalic acid, 4-nitro phthalic acid, diammonium phthalate, sodium phthalate, potassium phthalate, and tetrachloro phthalic acid anhydride); and phthalazines (phthalazine, phthalazine derivative or metal salts; for example, 4-(1-naphthyl)phthalazine, 6-isopropyl phthalazine, 6-t-butyl phthalazine, 6-chlorophthalazine, 5,7-dimethoxyphthalazine and 2,3-dihydrophthalazine) are preferred, and a combination of phthalazines and phthalic acids is particularly preferred in the combination with a silver halide of a composition with high silver iodide content.

The addition amount of the color toning agent in the present invention, based on 1 mol of the organic silver salt, is 0.01 mol or more and 0.3 mol or less, more preferably, 0.02 mol or more and 0.2 mol or less and, particularly preferably, 0.02 mol or more and 0.1 mol or less.

3) Plasticizer, Lubricant

The plasticizer and the lubricant usable for the image forming layer of the present invention are described in JP-A No. 11-65021, in column No. 0117. The lubricant is described in JP-A No. 11-84573 in column Nos. 0061 to 0064.

4) Dye, Pigment

For the image forming layer in the present invention, various kinds of dyes and pigments can be used with a view point of improving color tone, preventing occurrence of interference fringe upon laser exposure and prevention of irradiation (for example, C.I. Pigment Blue 60, C.I. Pigment Blue 64, C.I. Pigment Blue 15:6). They are specifically described in WO98/36322, and JP-A Nos. 10-268465 and 11-338098.

5) Super-hard Toner

For forming ultra-hard gradation image suitable to print plate making application, it is preferred to add a super-hard toner to the image forming layer. The super-hard toner and the addition method and the amount thereof are described as compounds of the formula (H) in JP-A No. 11-65021, in column Nos. 0118, as compounds of the formulae (1)–(3) in JP-A No. 11-223898, in column Nos. 0136 to 0193, and as compounds of the formulae (A), (B) in JP-A 2000-284399. And super hardening promoter is described in JP-A No. 11-65021, in column No. 0102, and JP-A No. 11-223898, in column Nos. 0194 to 0195.

For using formic acid or formate as a strong fogging substance, it is preferably contained by 5 mm mol or less and, further preferably, 1 mm mol or less per one mol of silver on the side having the image forming layer containing the photosensitive silver halide.

In a case of using the super-hard toner in the photothermographic material of the present invention, it is preferred to use an acid formed by hydration of diphosphorus pentaoxide or a salt thereof in combination.

The acid formed by hydration of diphosphorus pentaoxide or the salt thereof can include, for example, meta-phosphoric acid (salt), pyro-phosphoric acid (salt), ortho-phosphoric acid (salt), tri-phosphoric acid (salt), tetra-phosphoric acid (salt), and hexameta-phosphoric acid (salt).

The acid or the salt thereof formed by hydration of diphosphorus pentaoxide used particularly preferably can include ortho-phosphoric acid (salt) and hexameta-phosphoric acid (salt). Specific salts are sodium ortho-phosphate, sodium dihydrogen ortho-phosphate, sodium hexameta-phosphate and ammonium hexameta-phosphate.

The amount of acid formed by hydration of diphosphorus pentaoxide or the salt thereof to be used (coating amount per 1 $m^2$ of photosensitive material) may be any desired amount corresponding to the performance such as sensitivity or fogging and it is, preferably, from 0.1 $mg/m^2$ or more and 500 $mg/m^2$ or less, more preferably, 0.5 $mg/m^2$ or more and 100 $mg/m^2$ or less.

1-12 Layer Constitution

The image forming layer in the present invention may be constituted with one layer or plural layers. In a one layer constitution, it can comprise a non-photosensitive organic silver salt, a photosensitive silver halide, a reducing agent and a binder and, optionally, can contain additional materials such as color toning agent, covering aid and other auxiliary agents. In a case of plural layer constitution, they have to incorporate the organic silver salt and the silver halide in the first image forming layer (usually, layer adjacent with a support) and several other ingredients in the second image forming layer or both of the layers.

The constitution for the multi-color photosensitive thermographic photothermographic material may contain a combination of the two layers described above for each of the colors, or all of ingredients may be incorporated in a single layer as described in the specification of U.S. Pat. No. 4,708,928. In a case of the multi-color photothermographic material, the emulsion layers are kept being distinguished from each other by using a functional or not-functional barrier between each of the photosensitive layers as described in the specification of U.S. Pat. No. 4,460,681.

The photothermographic material of the present invention may have a non-photosensitive layer in addition to the image forming layer. The non-photosensitive layer can be classified, in view of the arrangement thereof as:

(1) a surface protection layer disposed on the image forming layer (on the side remote from the support),
(2) an intermediate layer disposed between each of the plurality of image forming layers or between the image forming layer and the protection layer,
(3) an undercoat layer disposed between the image forming layer and the support, and
(4) a back layer disposed on the opposite side to the image forming layer.

Further, a filter layer (that functions as an optical filter) can be disposed, which is provided as the layer (1) or (2). The anti-halation layer is disposed as the layer (3) or (4) to the photosensitive material.

1) Surface Protection Layer

A surface protection layer can be disposed to the photothermographic material in the present invention with an aim of preventing adhesion of the image forming layer. The surface protection layer may comprise a single layer or plural layers. The surface protection layer is described in JP-A No. 11-65021, in column Nos. 0119 to 0120 and JP-A No. 2001-348546.

The binder for the surface protection layer of the present invention is preferably gelatin and it is also preferred to use polyvinyl alcohol (PVA) alone or in combination. As gelatin, inert gelatin (for example, Nitta gelatin 750), or phthalized gelatin (for example, Nitta gelatin 801) can be used.

PVA can include those described in JP-A No. 2000-171936, in column Nos. 0009 to 0020, and they include, preferably, wholly saponified product PVA-105 and partially saponified product PVA-205 or PVA-335, and modified polyvinyl alcohol MP-203 (trade names of products manufactured by Kuraray Co.).

The coating amount of the polyvinyl alcohol (per 1 $m^2$ of support) for the protection layer (per one layer) is, preferably, 0.3 $g/m^2$ or more and 4.0 $g/m^2$ or less and, more preferably, 0.3 $g/m^2$ or more and 2.0 $g/m^2$ or less.

2) Anti-halation Layer

The anti-halation layer is described, for example, in JP-A No. 11-65021, in column Nos. 0123 to 0124, JP-A Nos. 11-223898, 9-230531, 10-36695, 10-104779, 11-231457, 11-352625, and 11-352626.

The anti-halation layer contains an anti-halation dye having absorption at an exposure wavelength. In the present invention, since the wavelength of an exposure laser has a peak wavelength in a region from 350 nm to 440 nm, it is preferred to use a dye absorbing the wave length also for anti-halation.

For preventing halation using a dye having absorption in a visible region, it is preferred that the color of the dye does not substantially remain after the image formation, and it is preferred to use means for fading the color by the heat of heat development and it is particularly preferred to add a heat fading dye and a base precursor to the photosensitive layer to function the layer as an anti-halation layer. The techniques are described, for example, in JP-A No. 11-231457.

The addition amount of the discharging dye is determined depending on the application use of the dye. Generally, it is preferred to use the dye in such an amount that the optical density (absorptibity) when measured at an aimed wavelength exceeds 0.1. The optical density is, preferably, from 0.15 to 2 and, more preferably, 0.2 to 1. The amount of the dye to be used for obtaining such an optical density is generally about 0.001 g/m$^2$ or more and 1 g/m$^2$ or less.

When the color of the dye is discharged as described above, the optical density after the heat development can be lowered to 0.1 or less. Two or more kinds of color fading dyes may be used together in the heat color fading type recording material or heat developing sensitive material. In the same manner, two or more kinds of base precursors may be used together.

In the heat fading using the color fading dye and the base precursor, it is preferred to use together a substance that lowers the melting point by 3° C. (deg) or more (for example, diphenyl sulfone, 4-chlorophenyl(phenyl)sulfone), when mixed with the base precursor as described in JP-A No. 11-352626, 2-naphthyl benzoate, etc. with a view point of heat color fading property or the like.

3) Back Layer

The photothermographic material in the present invention is preferably a so-called one side photosensitive material having at least one layer of silver halide emulsion on one side of a support and having a back layer on the other side of the support.

The back layer applicable to the present invention is described in JP-A No. 11-65021, in column Nos. 0128 to 0130.

In the present invention, a colorant having an absorption maximum at 300–450 nm can be added with an aim of improving the silver color tone and aging change of images. The colorant is described, for example, in JP-A Nos. 62-210458, 63-104046, 63-103235, 63-208846, 63-306436, 63-314535, 01-61745, and 2001-100363.

The colorant is usually added within a range from 0.1 mg/m$^2$ or more and 1 g/m$^2$ or less and the layer for addition is preferably a back layer disposed on the side opposite to the image forming layer.

4) Matting Agent

In the present invention, a matting agent is preferably added for the improvement of the transportability and the matting agent is described in JP-A No. 11-65021, in column Nos. 0126 to 0127.

The coating amount of the matting agent per 1 m$^2$ of the photosensitive material is, preferably, 1 mg/m$^2$ or more and 400 mg/m$^2$ or less and, more preferably, 5 mg/m$^2$ or more and 300 mg/m$^2$ or less.

In the present invention, the shape of the matting agent may be either a definite or indefinite shape and it is preferably of a definite shape, and spherical shape is used preferably. The average particle size is within a range, preferably, 0.5 μm or more and 10 μm or less, more preferably, 1.0 μm or more and 8.0 μm or less and, further preferably, 2.0 μm or more and 6.0 μm or less. The fluctuation coefficient of the size distribution is, preferably, 50% or less, more preferably, 40% or less and, further preferably, 30% or less. The fluctuation coefficient is a value represented by: (standard deviation of particle size)/(average value of particle size)×100. Further, it is also preferred to use two kinds of matting agents with a small fluctuation coefficient and with a ratio of the average particle size of 3 or more.

The matting degree at the surface of the image forming layer may be at any level so long as it is free of star dust failure. It is preferred that the Beck smoothness is 30 sec or more and 2000 sec or less and, particularly preferably, 40 sec or more and 1500 sec or less. The Beck smoothness can be determined easily according to Japanese Industry Standards (JIS) P8119 "Smoothness test method for paper and paper board by a Beck tester" and according to TAPPI standard method T479.

In the present invention, the matting degree of the back layer, by Beck smoothness, is, 1200 sec or less and 10 sec or more and, more preferably, 800 sec or less and 20 sec or more and, further preferably, 500 sec or less and 40 sec or more.

5) Polymer Latex

In a case of using the photothermographic material of the present invention for printing application use where dimensional change particularly causes problems, it is preferred to use a polymer latex for the surface protection layer or the back layer.

The polymer latex is also described in "Synthetic Resin Emulsion (edited by Taira Okuda, Hiroshi Inagaki, published from Kobunshi Publishing Society (1978))", "Application of Synthetic Latex (edited by Takaaki Sugimura, Yasuo Kataoka, Soichi Suzuki and Keiji Kasahara, published from Kobunshi Publishing Society (1993))", "Chemistry of Synthetic Latex (written by Soichi Muroi, Published from Koabunshi Publishing Society (1970))" and can include, specifically, a latex of methyl methacrylate (33.5 wt %)/ethyl acrylate (50 wt %)/methacrylic acid (16.5 wt %) copolymer, a latex of methyl methacrylate (47.5 wt %)/butadiene (47.5 wt %)/itaconic acid (5 wt %) copolymer, a latex of ethyl acrylate/methacrylic acid copolymer, a latex of methyl methacrylate (58.9 wt %)/2-ethylhexyl acrylate (25.4 wt %)/styrene (8.6 wt %)/2-hydroxyethyl methacrylate (5.1 wt %)/acrylic acid (2.0 wt %) copolymer, and a latex of methyl methacrylate (64.0 wt %)/styrene (9.0 wt %)/butyl acrylate (20.0 wt %)/2-hydroxyethyl methacrylate (5.0 wt %)/acrylic acid (2.0 wt %) copolymer.

Further, as the binder for the surface protection layer, the technique described in the specification of JP-A No. 2000-267226, in column Nos. 0021 to 0025, and the technique described in the specification of JP-A No. 2000-019678, in column Nos. 0023 to 0041 may also be applied.

The ratio of the polymer latex of the surface protection layer is, preferably, 10 wt % or more and 90 wt % or less and, particularly preferably, 20 wt % or more and 80 wt % or less based on the entire binder.

The coating amount (per 1 m$^2$ of support) of the entire binder (including the water soluble polymer and the latex polymer) in the surface protection layer (per one layer) is, preferably, 0.3 g/m$^2$ or more and 5.0 g/m$^2$ or less and, more preferably, 0.3 g/m$^2$ or more and 2.0 g/m$^2$ or less.

6) Film Surface pH

The film surface pH of the photothermographic material of the present invention, before heat development processing is, preferably, 7.0 or lower and, more preferably, 6.6 or lower. While there is no particular restriction for the lower limit, it is about 3. A most preferred pH range is within a range from 4 to 6.2.

For controlling the film surface pH, it is preferred to use an organic acid such as a phthalic acid derivative or a non-volatile acid such as sulfuric acid, or a volatile base such as ammonia, with a view point of lowering the film surface pH. Particularly, ammonia is preferred for attaining a low film surface pH since it is easily evaporative and can be removed in the coating step or heat development.

It is also preferred to use a non-volatile base such as sodium hydroxide, potassium hydroxide, or lithium hydroxide, and ammonia together. The measuring method for the film surface pH is described in the specification of JP-A No. 2000-284399, in column No. 0123.

7) Film Hardener

A film hardener may be used in each of the layers such as the photosensitive layer, the protection layer and the back layer of the present invention. Examples of the film hardener include various methods described in "THE THEORY OF THE PHOTOGRAPHIC PROCESS FOURTH EDITION", written by T. H. James (Published from Macmillan Publishing Co., Inc. in 1977), in pages 77 to 87, and they can include chrome alum, sodium salt of 2,4-dichloro-6-hydroxy-s-triazine, N,N-ethylenebis (vinylsulfone acetoamide), N,N-propylenebis(vinylsulfone acetoamide), as well as polyvalent metal ions described in page 78 of the literature, polyisocyanates described in U.S. Pat. No. 4,281,060 and JP-A No. 6-208193, epoxy compounds described, for example, in U.S. Pat. No. 4,791,042 and vinylsulfonic compounds in JP-A No. 62-89048.

The film hardener is added as a solution and the solution is added into the protection layer coating solution at a timing from 180 min before to immediately before and, preferably, from 60 min before to 10 sec before the coating, and there are no particular restrictions on the mixing method and mixing conditions so long as the effect of the present invention can be obtained sufficiently.

The concrete mixing method can include a method of mixing in a tank adapted such that the average staying time calculated based on the addition flow rate and the liquid feed amount to the coater is controlled to a desired time, or a method of using a static mixer as described in "Liquid Mixing Technology", written by N. Harnby, M. F. Edwards, A. W. Nienow, translated by Koji Takahashi (published from Nikkan Kogyo Shinbun-sha in 1989), in Chapter 8.

8) Surface Active Agent

The surface active agent applicable in the present invention is described in JP-A No. 11-65021, in column No. 0132.

In the present invention, a fluoro surface active agent is used preferably. Specific examples of the fluoro surface active agent can include compounds described in JP-A Nos. 10-197985, 2000-19680 and 2000-214554. Further, a polymeric fluoro surface active agent described in JP-A No. 9-281636 is also used preferably. In the present invention, it is preferred to use the fluoro surface active agents described in JP-A Nos. 2002-082411 and 2003-057780. Particularly, the fluoro surface active agent described in JP-A No. 2003-057780 is preferred in a case of preparation by coating using an aqueous coating solution with view points of charge controlling performance, stability for the coated surface state and the slipping property.

In the present invention, the fluoro surface active agent can be used either to the image forming layer side or to the back side and it is preferred to use the side for both sides. Further, it is particularly preferred to use in combination with a conductive layer containing the metal oxide described above. In this case, sufficient performance can be obtained even when the amount of the fluoro surface active agent on the surface having the conductive layer is reduced or eliminated.

A preferred amount of the fluoro surface active agent to be used for each of the image forming layer side and the back side is within a range of 0.1 $mg/m^2$ or more and 100 $mg/m^2$ or less, more preferably, within a range of 0.3 $mg/m^2$ or more and 30 $mg/m^2$ or less, and, further preferably, within a range of 1 $mg/m^2$ or more and 10 $mg/m^2$ or less. It is further more preferably, within a range of 0.01 $mg/m^2$ or more and 10 $mg/m^2$ or less and, particularly preferably, within a range of 0.1 $mg/m^2$ or more and 5 $mg/m^2$ or less.

9) Anti-static Agent

In the present invention, an anti-static agent layer containing conductive materials such as various known metal oxides or conductive polymers may be provided. As preferred conductive materials, metal oxides improved with conductivity by the incorporation of oxygen defects and hetero metal atoms in the metal oxides are used preferably.

As examples of the metal oxides, ZnO, $TiO_2$, and $SnO_2$ are preferred. It is preferred to add Al or In for ZnO, add Sb, Nb, P or halogen element for $SnO_2$, and Nb or Ta for $TiO_2$. Particularly, $SbO_2$ with addition of Sb is preferred.

The addition amount of the hetero atom is within a range, preferably, of 0.01 mol % or more and 30 mol % or less, and, more preferably, within a range of 0.1 mol % or more and 10 mol % or less. The shape of the metal oxide may be any of spherical, needle shape or tabular, and a needle shape particle with the major axis/minor axis ratio of 2.0 or more, preferably, from 3.0 to 50 is preferred with a view point of providing the conductivity.

The amount of the metal oxide to be used is, preferably, within a range of 1 mg/m or more and 1000 $mg/m^2$ or less, more preferably, within a range of 10 $mg/m^2$ or more and 500 $mg/m^2$ or less and, further preferably, within a range of 20 $mg/m^2$ or more and 200 $mg/m^2$ or less.

The anti-static layer of the present invention may be disposed either on the side of the image forming layer or on the side of the back layer. Further, it may be used also as the coating layer, the back layer or the protection layer or it may be disposed separately. It is preferably disposed between the support and the back layer. For the anti-static layer, the techniques described in JP-A No. 11-65021, in column No 0135, JP-A Nos. 58-62646, 56-120519, 11-84573, in column Nos. 0040 to 0051, in the specification of U.S. Pat. No. 5,575,957, and JP-A No. 11-223898, in column Nos. 0078 to 0084, and JP-A Nos. 7-295146 and 11-223901 can be applied.

10) Support

For the transparent support, polyester, particularly, polyethylene terephthalate applied with a heat treatment in a temperature range from 130 to 185° C. is used preferably for moderating internal strains remaining in the film upon biaxial stretching and eliminating heat shrinking strains caused during heat development. In the case of a photothermographic material for medical use, the transparent support may be colored by a blue dye (for example, dye-1 described in Examples of JP-A No. 8-240877), or it may be not colored. An example of a specific support is described in JP-A No. 11-65021, in column No. 0134.

The undercoating techniques of water soluble polyester in JP-A No. 11-84574, styrene-butadiene copolymer in JP-A No. 10-186565, and vinyliden chloride copolymer in JP-A No. 2000-39684 are applied preferably for the support.

The photothermographic material of the present invention is preferably a mono-sheet type (type capable of forming images on a photothermalgraphic material without using other sheet such as an image receiving material.

11) Other Additives

For the photothermographic material, an antioxidant, stabilizer, plasticizer, UV-ray absorbent or coating aid may be added further. Various kinds of additives are added either to the image forming layer or to the non-photosensitive layer. WO98/36322, EP-A No. 803764 A1, JP-A Nos. 10-186567 and 10-18568, etc. can be referred to. Further, the method of obtaining color images is described in JP-A No. 11-65021, in column 0136.

12) Preparation and Viscosity Property of Coating Solution

The temperature for preparing the coating solution of the image forming layer in the present invention is preferably 30° C. or higher and 65° C. or lower and, a further preferred temperature is 35° C. or higher and lower than 60° C., and a more preferred temperature is 35° C. or higher and 55° C. lower. Further, it is preferred that the temperature of the image forming layer coating solution just after the addition of the polymer latex is kept at 30° C. or higher and 65° C. or lower.

The image forming layer coating solution in the present invention is preferably a so-called thixotropic fluid. For the technique, JP-A No. 11-52509 can be referred to.

The image forming layer coating solution in the present invention has a viscosity of, preferably, 400 mPa·s or more and 100,000 mPa·s or less, more preferably, 500 mPa·s or more and 20,000 mPa·s or less at a shearing speed of 0.1 $S^{-1}$. It is, preferably 1 mPa·s or more and 200 mPa·s or less and, more preferably, 5 mPa·s or more and 80 mPa·s or less at a shearing speed of 1000 $S^{-1}$.

13) Coating Method

The photothermographic material in the present invention may be coated by any method. Specifically, various coating operations including extrusion coating, slide coating, curtain coating, dip coating, knife coating, flow coating or an extrusion coating using a hopper of the type as described in U.S. Pat. No. 2,681,294 are used. Extrusion coating or slide coating described in "LIQUID FILM COATING" written by Stephen F. Kistler, Petert M. Schweizer (published from Chapman and Hall Co. in 1997), pages 399 to 536 is used preferably and the slide coating is used particularly preferably. An example for the shape of the slid coater used for the slide coating is shown in FIG. 11*b*.1 on page 427 of the literature. If necessary, two or more layers can be coated simultaneously by the method described in pages 399 to 536 of the literature and the method described in U.S. Pat. No. 2,761,791 and British Patent No. 837,095.

(14) Other Utilizable Techniques

Other utilizable techniques that can be used for the photothermographic material of the present invention are described in EP-A Nos. 803764A1 and 883022A1, WO 98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536, 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864 and 2001-348546.

2. Image Forming Method

For the image forming method applied to the photothermographic material of the present invention, it is preferred to expose the photothermographic material by using a semiconductor laser having a light emission peak at 350 to 450 nm as a light source.

2-1 Exposure

The photosensitive material of the present invention provides its characteristic feature in a short time exposure of a light at a high illuminance of 1 mW/mm2. Exposure at such high illuminance can provide a sufficient sensitivity also in a heat developing material containing a high iodine content silver halide emulsion and a non-photosensitive organic silver salt of the present invention. That is, higher sensitivity can be obtained at high illuminance exposure in the present invention compared with exposure at low illuminance.

The illuminance in the present invention is 1 $mW/mm^2$ or higher, more preferably, 2 $mW/mm^2$ or higher and 50 $W/mm^2$ or lower and further preferably, 10 $mW/mm^2$ or higher and 50 $W/mm^2$ or lower.

The photosensitive material of the present invention may be exposed by any method and a laser light is preferred as an exposure light source.

The laser light used preferably in the present invention is preferably a light of a gas laser ($Ar^+$, Kr), YAG laser, dye laser, or semiconductor laser. Further, a laser and a second harmonic wave generation device may also be used. It is, more preferably, a semiconductor laser emitting blue-purple light, more preferably, a semiconductor laser having a light emission peak intensity at a wave length from 350 nm to 450 nm and, particularly preferably, a semiconductor laser having a light emission peak intensity at a wavelength from 390 nm to 430 nm.

A high power semiconductor laser of emitting blue-purple light can include NLHV 3000 E semiconductor laser manufactured by Nichia Kagaku. A laser of 35 mW power at a wavelength of 405 nm has been disclosed, and a high illuminance light at 390 nm to 430 nm which is a wavelength particularly preferred in the present invention can be obtained by using such a laser light.

2-2 Heat Development

The photothermographic material of the present invention may be developed by any method and, usually, a photothermographic material exposed imagewise is heated to conduct development. The developing temperature is, preferably, from 80° C. or higher and 250° C. or lower, more preferably, 100° C. or higher and 140° C. or lower and, further preferably, from 1 10° C. or higher and 130° C. or lower. The developing time is, preferably, 1 sec or more and 60 sec or less, more preferably, 3 sec or more and 30 sec or less and, further preferably, 5 sec or more and 25 sec or less and, particularly preferably, 7 sec or more and 15 sec or less.

For the heat development system, either a drum heater or a plate heater may be used, with the plate heater system being more preferred. As the heat development method by the plate heater system, a method described in JP-A No. 11-133572 is preferred, which uses a heat developing apparatus of obtaining visible images by bringing a photothermographic material formed with latent images into contact with heating means in a heat developing station. In the apparatus, the heating means comprises a plate heater, a plurality of retaining rollers are opposed to each other along one surface of the plate heater, and the photothermographic material is passed between the retainer rollers and the plate heater to conduct heat development. It is preferred that the plate heater is divided into 2–6 stages in which the temperature is lowered by about 1 to 10° C. for the top end portion.

For example, four sets of plate heaters capable of independent temperature control are used which are controlled to 112° C., 119° C., 121° C., and 120° C., respectively. The method is disclosed also in JP-B No. 54-30032, and can remove the water content or organic solvent contained in the photothermographic material out of the system, and suppress the change of the shape of the support for the photothermographic material by rapid heating of the photothermographic material.

The method described above is disclosed also in JP-A No. 54-30032, which can remove the water content or organic solvent contained in the photothermographic material out of the system. Further, the method can suppress the change of the shape of the support for the photothermographic material by rapid heating of the photothermographic material.

3. Packaging Material

The photosensitive material of the present invention is preferably packaged with a packaging material of low oxygen permeation and/or water permeation rate in order to suppress the fluctuation of the photographic performance during unprocessed storage, or for improving the crimping tendency.

The oxygen permeation rate at 25° C. is, preferably, 50 ml/atm·m$^2$·day or less, more preferably, 10 ml/atm·m$^2$·day or less and, further preferably, 1.0 ml/atm·m$^2$·day or less. The water permeation rate is, preferably, 10 g/atm·m$^2$·day or less, more preferably, 5 g/atm·m$^2$·day, further preferably, 1 g/atm·m$^2$·day or less.

Specific examples of the packaging material of low oxygen permeation rate and/or water permeation rate are packaging materials described, for example, in the specification of JP-A-Nos. 8-254793 and 2000-206653.

4. System

A laser imager for medical use having an exposure station and a heat developing station can include Fuji Medical Dry Laser Imager FM-DP L.

FM-DP L is disclosed in Fuji Medical Review No. 8, pages 39 to 55, and the techniques can of course be applied as the laser imager for the photothermographic material of the present invention. Further, it can also be applied as the photothermographic material for laser imager in "AD Network" proposed by Fuji Film Medical Co. as a network system conforming DICOM standards.

5. Application Use of the Present Invention

The photothermographic material of the present invention forms black and white images by silver images and is used preferably as photothermographic material for use in medical diagnosis, photothermographic material for use in industrial photography, photothermographic material for use in printing, and photothermographic material for use in COM.

EXAMPLES

The present invention is to be descried specifically by way of examples but the present invention is not restricted to them.

Example 1

1-1. Preparation of PET Support (Film Preparation)

PET with an inherent viscosity IV=0.66 (measured in phenol/tetrachloroethane=6/4 (weight ratio) at 25° C.) was prepared using terephthalic acid and ethylene glycol in accordance with a customary method. After pelleting the product, it was dried at 130° C. for 4 hours, melted at 300° C., and then extruded from a T die and quenched to prepare a not-stretched film of 175 μm thickness after heat setting.

The film was stretched longitudinally by 3.3 times using rolls of different circumferential speeds and then stretched laterally by a tenter by 4.5 times. The temperatures was at 110° C. and 130° C., respectively. Subsequently, it was heat set at 240° C. for 20 sec and then relaxed by 4% in the lateral direction at an identical temperature. Then, after slitting the chuck portion of the tenter, it was knurled at both ends, and taken up under 4 kg/cm$^2$, to obtain a roll of 175 μm thickness.

[Surface Corona Discharge Treatment]

Both surfaces of the support were treated by using a solid state corona discharge processing machine model 6 KVA manufactured by Piller Co. at a room temperature and at 20 m/min. In view of the read values for current and voltage, it was found that a treatment at 0.375 kV·A·min/m$^2$ was applied to the support. The processing frequency was 9.6 kHz and a gap clearance between the electrode and the dielectric roll was 1.6 mm.

1-2 Preparation Undercoating Support (1) Preparation Example of Undercoating Layer Coating Solution

| Formulation <1> (for undercoating layer on the side of image forming layer) | |
|---|---|
| Pesresin A-520 (30 wt % solution) manufactured by Takamatsu Yushi Co. | 59 g |
| 10 wt % solution of polyethylene glycol mono nonylphenyl ether (average ethylene oxide Number = 8.5) | 5.4 g |
| MP-1000 (fine polymer particles, average particle size 0.4 μm) manufactured by Soken Kagaku Co. | 0.91 g |
| distilled water | 935 ml |
| **Formulation <2> (first layer for back surface)** | |
| styrene-butadiene copolymer latex (solid content 40 wt %, styrene/butadiene weight ratio = 68/32) | 158 g |
| Aqueous 8 wt % solution of sodium salt of 2.4-dichloro-6-hydroxy-S-triazine | 20 g |
| Aqueous 1 wt % solution of sodium lauryl benzene sulfonate | 10 ml |
| distilled water | 854 ml |
| **Formulation <3> (second layer for back surface)** | |
| $SnO_2$/SbO (9/1 mass ratio, average particle size 0.038 μm, 17 wt % dispersion | 84 g |
| Gelatin (aqueous 10 wt % solution) | 89.2 g |
| Metrose TC-5 (aqueous 2 wt % solution) manufactured by Shinetsu Chemical Industry Co. | 8.6 g |
| MP-1000 manufactured by Soken Kagaku Co. | 0.01 g |
| Aqueous 1 wt % solution of sodium dodecylbenzene sulfonate | 10 ml |
| NaOH (1 wt %) | 6 ml |
| Proxel (manufactured by ICI) | 1 ml |
| Distilled water | 805 ml |

After applying the corona discharging treatment describe above on both surfaces of the biaxially stretched polyethylene terephthalate support of 175 μm thickness, respectively, the undercoating solution formulation <1> described above was coated on one surface (image forming layer surface) such that the wet coating amount was 6.6 ml/m$^2$ (per one side surface) by a wire bar and dried at 180° C. for 5 min. Then, the undercoating solution preparation <2> described above was coated on the rear face (back surface) thereof such that the wet coating amount was 5.7 ml/m$^2$ by a wire bar and dried at 180° C. for 5 min and, further, the undercoating solution preparation <3> was coated to the rear face (back surface) by the wire bar such that the wet coating amount was 7.7 ml/$m^2$ and then dried at 180° C. for 6 min to prepare an undercoated support.

(Preparation of Back Surface Coating Solution)

(Preparation of Anti-halation Coating Solution)

60 g of gelatin, 24.5 g of polyacrylamide, 2,2 g of 1 mol/L sodium hydroxide, 2.4 g of mono-dispersed fine trimethyl mechacrylate particles (average particle size: 8 μm, standard deviation of particle size: 0.4), 0.08 g of benzoisothiazolinone, 0.3 g of sodium polystyrene sulfonate, 0.21 g of blue dye compound-1, 0.15 g of yellow dye compound-1, and 8.3 g of acrylic acid/ethyl acrylate copolymer latex (copolymerization ratio: 5/95) were mixed and made up with water to 818 ml to prepare an anti-halation layer coating solution.

[Preparation of Back Surface Protection Layer Solution]

A vessel was kept at a temperature of 40° C., and 40 g of gelatin, 1.5 g of liquid paraffin emulsion as a liquid paraffin, 35 mg of benzoisothiazolinone, 6.8 g of 1 mol/L of sodium hydroxide, 0.5 g of sodium t-octyl phenoxyethoxy ethane sulfonate, 0.27 g of sodium polystyrene sulfonate, 5.4 ml of an aqueous 2 wt % solution of fluoro surface active agent (F-1), 6.0 g of acrylic acid/ethyl acrylate copolymer (copolymerization mass ratio: 5/95) and 2.0 g of N,N-ethylene bis (vinylsulfone acetoamide) were mixed and made up with water to 1000 ml, to prepare a back surface protection layer coating solution.

1-3. Image Forming Layer, Intermediate Layer and Surface Production Layer 1-3-1. Provision of Coating Material Preparation of Silver Halide Emulsion <Preparation of silver halide emulsion 1>

A solution formed by adding 3.1 ml of 1 wt % potassium bromide solution to 1420 ml of distilled water and further adding 3.5 ml of sulfuric acid at 0.5 M/L concentration and 36.7 g of gelatin phthalide was kept at a liquid temperature of 30° C. while stirring in a stainless steel reaction vessel, to which were added a solution A formed by diluting 22.22 g of silver nitrate with addition of distilled water to 95.4 ml and a solution B formed by diluting 15.3 g of potassium bromide and 0.8 g of potassium iodide with addition of distilled water to 97.4 ml volume, entirely, at a constant flow rate for 45 sec. Subsequently, 10 ml of an aqueous 3.5 wt % solution of hydrogen peroxide was added and 10.8 ml of an aqueous 10 wt % solution of benzimidazole was further added.

Further, a solution C formed by diluting 51.86 g of silver nitride with addition of distilled water to 317.5 ml and a solution D formed by diluting 44.2 g of potassium bromide and 2.2 g of potassium iodide with addition of distilled water to 400 ml volume were added such that the solution D was added entirely at a constant flow rate for 20 min, while the solution D was added by a controlled double jet (CDJ) method with pAg being kept at 8.1. Potassium hexachloroiridate (III) was added by an entire amount so as to be $1\times10^{-4}$ mol per 1 mol of silver 10 min after starting the addition of the solution C and the solution D. Further, an aqueous solution of potassium hexacyano ferrate (II) was added by an entire amount so as to be $3\times10^{-4}$ mol per 1 mol of silver 5 sec after completing the addition of the solution C. pH was adjusted to 3.8 by using sulfuric acid at 0.5 mol/L concentration, stirring was stopped and a precipitation/desalting/water washing step was conducted.

pH was adjusted to 5.9 by using sodium hydroxide at 1 mol/L concentration, to prepare a silver halide dispersion at pAg of 8.0.

While keeping the silver halide dispersion at 38° C. under stirring, 0.34 wt % of 1,2-benzoisothiazolin-3-on in a 5 ml methanol solution was added and the temperature was elevated to 47° C. 20 min after the temperature elevation, sodium benzene thiosulfonate in a methanol solution was added by $7.6\times10^{-5}$ mol based on 1 mol of silver and, further 5 min after, tellurium sensitizer C in a methanol solution was added by $2.9\times10^{-4}$ mol per 1 mol of silver and aged for 91 min.

0.8 wt % of N,N'-dihydroxy-N" diethyl melamine in a 1.3 ml methanol solution was added and, further 4 min after, 5-methyl-2-mercapto benzoimidazole in a methanol solution was added by $4.8\times10^{-3}$ mol per 1 mol of silver, and 1-phenyl-2-heptyl-5-mercapto-1,3,4-triazole in a methanol solution was added by $5.4\times10^{-3}$ mol per one mol of silver, to prepare a silver halide emulsion 1. Particles in the thus prepared silver halide emulsion were pure silver iodide particles with an average sphere-equivalent diameter of 0.040 μm and a fluctuation coefficient for the sphere-equivalent diameter of 18%. The particle size, etc. were determined based on the average for the particles by the number of 1000 using an electron microscope.

<Preparation of Mixed Emulsion for Coating Solution>

The silver halide emulsion 1 was dissolved, and benzothiazolium iodide in an aqueous 1 wt % solution was added by $7\times10^{-3}$ mol pre 1 mol of silver. Further, water was added such that the content of the silver halide as silver was 38.2 g per 1 kg of the mixed emulsion for coating solution.

<Preparation of silver halide emulsion 2>

A solution formed by adding 4.3 ml of a 1 wt % potassium bromide solution to 1420 ml of distilled water and further adding 3.5 ml of sulfuric acid at 0.5 mol/L concentration and 36.7 g of gelatin phthalide was kept at a liquid temperature of 42° C. while stirring in a stainless steel reaction vessel, to which were added a solution A formed by diluting 22.22 g of silver nitrate with addition of distilled water to 195.6 ml and a solution B formed by diluting 21.8 g of potassium iodide with addition of distilled water to 218 ml, entirely, at a constant flow rate for 9 min. Subsequently, 10 ml of an aqueous 3.5 wt % solution of hydrogen peroxide was added and an aqueous 10 wt % solution of benzimidazole was added by 10.8 ml.

Further, a solution C formed by diluting 51.86 g of silver nitrate with addition of distilled water to 317.5 ml and a solution D formed by diluting 60 g of potassium iodide with addition of distilled water to 600 ml volume were added such that the solution C was added entirely at a constant flow rate for 120 min while the solution D was added by a controlled double jet method with pAg being kept at 8.1. Potassium hexachloroiridate (III) was added by an entire amount so as to be $1\times10^{-4}$ mol per 1 mol silver 10 min after starting the addition of the solution C and the solution D. Further, an aqueous solution of potassium hexacyano ferrate (II) was added by an entire amount so as to be $3\times10^{-4}$ mol per 1 mol of silver 5 sec after completing the addition of the solution C. pH was adjusted to 3.8 by using sulfuric acid at 0.5 mol/L concentration, stirring was stopped and precipitation/desalting/water washing step was conducted. pH was adjusted to 5.9 by using sodium hydroxide at 1 mol/L concentration, to prepare a silver halide dispersion at pAg of 8.0.

While keeping the silver halide dispersion at 38° C. under stirring, 0.34 wt % 1,2-benzoisothiazolin-3-on in a 5 ml methanol solution was added and the temperature was elevated to 47° C. 20 min after the temperature elevation, sodium benzene thiosulfonate in a methanol solution was added by $7.6\times10^{-5}$ mol based on 1 mol of silver and, further 5 min after, a tellurium sensitizer B in a methanol solution was added by $2.9\times10^{-4}$ mol per 1 mol of silver and aged for 91 min. 0.8 wt % of N,N'-dihydroxy-N" diethyl melamine in a 1.3 ml methanol solution was added and, further 4 min after, 5-methyl-2-mercapto benzoimidazole in a methanol solution was added by $4.8\times10^{-3}$ mol per 1 mol of silver, and 1-phenyl-2-heptyl-5-mercapto-1,3,4-triazole in a methanol solution was added by $5.4\times10^{-3}$ mol per one mol of silver, to prepare a silver halide emulsion 2.

Particles in the thus prepared silver halide emulsion were pure silver iodide particles with an average sphere-equivalent diameter of 0.040 μm and a fluctuation coefficient for the sphere-equivalent diameter of 18%. The particle size, etc. were determined based on the average for the particles by the number of 1000 using an electron microscope.

<Preparation of silver halide emulsion 3>

A silver halide emulsion 3 was prepared quite in the same manner as in the silver halide emulsion 2, except for changing the temperature of the reaction solution to 27° C.

Particles in the thus prepared silver halide emulsion were pure silver iodide particles with an average sphere-equivalent diameter of 0.022 μm and a fluctuation coefficient for the sphere-equivalent diameter of 17%. The particle size, etc. were determined based on the average for the particles by the number of 1000 using an electron microscope.

[Preparation of mixed emulsion A for coating solution]

The silver halide emulsion 2 and the silver halide emulsion 3 were dissolved in an amount of 4:6 as the silver molar ratio, and benzothiazolium iodide as an aqueous 1 wt % solution was added by $7\times10^{-3}$ mol per 1 mol of silver. Further, water was added such that the content of the silver halide per 1 kg of the mixed emulsion for coating solution was 38.2 g, and 1-(3-methyl ureido phenyl)-5-mercapto tetrazole was added so as to be 0.34 g per 1 kg of the mixed emulsion for coating solution.

Further, as "compound in which a one-electron oxidant formed by one-electron oxidation can release one electron or more electrons", compounds 2, 20 and 26 were added such that they were $2\times10^{-3}$ mol per one mol of silver of the silver halide, respectively.

(2) Preparation of Silver Fatty Acid Salt Dispersion

<Preparation of Recrystallized Behenic Acid>

100 kg of behenic acid manufactured by Henkel Co. (Trade name of products: Edenor C22-85R) was mixed in 1200 kg of isopropyl alcohol, dissolved at 50° C., filtered through a 10 μm filter, and then cooled to 30° C. to conduct recrystallization. The cooling rate during recrystallization was controlled at 3° C./hr. The obtained crystals were filtered centrifugally and then spray washed with 100 kg of isopropyl alcohol and dried. When the obtained crystals were esterified and put to GC-FID measurement, they contained 96 mol % of behenic acid and, in addition, 2 mol % of lignoceric acid, 2 mol % of arachidic acid and 0.001 mol of erucic acid.

[Preparation of Fatty Acid Silver Salt Dispersion]

88 kg of recrystallized behenic acid, 422 L of distilled water, 49.2 L of an aqueous solution of NaOH at 5 mol/L concentration and 120 L of t-butyl alcohol were mixed and reacted at 75° C. while stirring for one hour to obtain sodium behenate solution. Separately, 206.2 L (pH 4.0) of an aqueous solution of 40.4 kg of silver nitrate was prepared and kept at a temperature of 10° C. A reaction vessel containing 635 L of distilled water and 30 L of t-butyl alcohol was kept at a temperature of 30° C. and, under sufficient stirring, the entire amount of the sodium behenate solution and the entire amount of the aqueous solution of silver nitrate described above were added, respectively, each at a constant flow rate for 93 min and 15 sec and 90 min, respectively. In this case, only the aqueous solution of silver nitrate was added for 11 min after starting the addition of the aqueous solution of silver nitrate. Then, the addition of the sodium behenate solution was started, and only the solution of sodium behenate was added for 14 min and 15 sec after completing the addition of the aqueous solution of silver nitrate. The external temperature was controlled such that the temperature in the reaction vessel was 30° C. and the liquid temperature was kept constant. Further, it was controlled such that the temperature of the pipeline for the addition system of the sodium behenate solution was kept by circulating warm water to the outside of the double-walled tube and the liquid temperature at the exit of the addition nozzle top end was at 75° C. Further, the temperature of the pipeline for the addition system of the silver nitrate aqueous solution was kept by circulating cold water to the outside of the double walled tube. The addition position for the sodium behenate solution and the addition position for the silver nitrate aqueous solution were arranged symmetrically with respect to the stirring axis, and they were controlled to such a height not in contact with the reaction solution.

After completing the addition of the sodium behenate solution, it was stirred and left as it was at the temperature for 20 min, the temperature was elevated to 35° C. for 30 min and then aging was conducted for 210 min. After completing the aging, solid were directly separated by centrifugal filtration and the solids were washed with water till the conductivity of the water of the filtrate was changed to 30 ES/cm. A fatty acid silver salt was thus obtained. The obtained solids were stored as wet cakes with no drying.

When the form of the obtained silver behenate particles was evaluated by electron microscopic photography, they were crystals at a=0.21 μm, b=0.4 μm, and c=0.4 μm in average values, and having an average aspect ratio of 2.1 and a sphere-equivalent diameter fluctuation coefficient of 11 % (a, b, c being defined in the text).

19.3 kg of polyvinyl alcohol (PVA-217: Trade name of products) and water were added to wet cakes corresponding to 260 kg of dry solids to a total weight of 1,000 kg, then they were slurrified by dissolver blades and then preliminarily dispersed by a pipeline mixer (model PM-10, manufactured by Mizuho Industry Co.).

Then, the stock solution after the preliminary dispersion was treated for three times while controlling the pressure of a dispersing equipment (Micro Fluidizer M-610, trade name of products of Microfluidex International Corporation: Z-type interaction chamber used) to 1150 kg/cm$^2$, to obtain a silver behenate dispersion. In the cooling operation, a coiled heat exchangers were attached to each of the front and back of an interaction chamber and dispersion temperature was set to 18° C. by controlling the temperature of coolants.

(3) Preparation of Reducing Agent Dispersion

<Preparation of Reducing Agent-1 Dispersion>

10 kg of water was added to 10 kg of a reducing agent-1 (2,2-methylene bis-(4-ethyl-6-tert-butylhpenol) and 16 kg of an aqueous 10 wt % solution of modified polyvinyl alcohol (Poval MP203, manufactured by Kuraray Co.) and mixed thoroughly to form a slurry. The slurry was fed by a diaphragm pump, dispersed for 3 hours by a horizontal sand mil (UVM-2; manufactured by Imex Co.) filled with zirconia beads of an average diameter of 0.5 mm, then 0.2 g of sodium salt of benzoisothiazolinon and water were added to control such that the concentration of the reducing agent was 25 wt %. The liquid dispersion was heat treated at 60° C. for 5 hrs to obtain a reducing agent-1 dispersion. The reducing agent particles contained in the thus obtained reducing agent dispersion had a median diameter of 0.40 μm and a maximum particle size of 1.4 μm or less. The thus obtained reducing agent dispersion was filtered through a polypropylene filter of 3.0 μm pore size to remove obstacles such as dusts and then stored.

<Preparation of Reducing Agent-2 Dispersion>

10 kg of water was added to 10 kg of a reducing agent-2 (6,6'-di-t-butyl-4,4'-dimethyl-2,2'-butylidene diphenol) and 16 kg of an aqueous 10 wt % solution of modified polyvinyl alcohol (Poval MP203, manufactured by Kuraray Co.) and mixed thoroughly to form a slurry. The slurry was fed by a diaphragm pump, dispersed for 3 hrs and 30 min by a horizontal sand mil (UVM-2; manufactured by Imex Co.) filled with zirconia beads of an average diameter of 0.5 mm, then 0.2 g of sodium benzoisothiazolinon sodium salt and water were added to control such that the concentration of the reducing agent was 25 wt %. The liquid dispersion was heated at 40° C. for one hour and successively applied with a heat treatment at 80° C. for one hour to obtain a reducing agent-2 dispersion. The reducing agent particles contained in the thus obtained reducing agent dispersion had a median diameter of 0.50 μm and a maximum particle size of 1.6 μm or less. The thus obtained reducing agent dispersion was filtered through a polypropylene filter of 3.0 μm pore size to remove obstacles such as dusts and then stored.

4) Preparation of Hydrogen Bonding Compound Dispersion

<Preparation of Hydrogen Bonding Compound-1 Dispersion> 10 kg of water was added to 10 kg of a hydrogen bonding compound-i (tri(4t-butylphenyl)phosphine oxide) and 16 kg of an aqueous 10 wt % solution of a modified polyvinyl alcohol (Poval MP203, manufactured by Kuraray Co.) and mixed thoroughly to prepare a slurry. The slurry was fed by a diaphragm pump and, after dispersion by a horizontal type sand mill filled with zirconia beads with an average diameter of 0.5 mm (UVM-2: manufactured by Imex Co.) for 4 hours, 0.2 g of sodium salt of benzoisothiazolinone and water were added to prepare such that the concentration of the hydrogen bonding compound was 25 wt %. The liquid dispersion was heated at 40° C. for one hour and then successively heated at 80° C. for one hour, to obtain a hydrogen bonding compound-1 dispersion. The thus obtained hydrogen bonding compound particles contained in the hydrogen bonding compound dispersion had a median diameter of 0.45 μm and a maximum particle diameter of 1.3 μm or less. The obtained hydrogen bonding compound dispersion was filtered through a polypropylene filter having a pore size of 3.0 μm to remove obstacles such as dusts and stored.

5) Preparation of Development Accelerator Dispersion and Color Toning Agent Dispersion <Preparation of development accelerator-1 dispersion>

10 kg of water was added to 10 kg of a development accelerator-1 and 20 kg of an aqueous 10 wt % solution of a modified polyvinyl alcohol (Poval MP203, manufactured by Kuraray Co.) and mixed thoroughly to prepare a slurry. The slurry was fed by a diaphragm pump and, after dispersion by a horizontal type sand mill filled with zirconia beads with an average diameter of 0.5 mm (UVM-2: manufactured by IMEX Co.) for 3 hours and 30 min, 0.2 g of sodium salt of benzoisothiazolinone and water were added to prepare such that the concentration of the development accelerator was 20 wt %, to obtain a development accelerator-i dispersion. The thus obtained development accelerator particles contained in the development accelerator dispersion had a median size of 0.48 μm and a maximum particle size of 1.4 μm or less. The obtained dispersion was filtered through a polypropylene filter having a pore size of 3.0 μm to remove obstacles such as dusts and stored.

<Development Accelerator-2 and Color Toning Agent-1 Dispersion>

Solid dispersions of the development accelerator-2 and color toning agent-1 were also dispersed by the same method as in the development accelerator-1, to obtain liquid dispersions of 20 wt % and 15 wt %, respectively.

6) Preparation of Polyhalogen Compound Dispersion

<Preparation of Organic Polyhalogen Compound-1 Dispersion>

10 kg of an organic polyhalogen compound-1 (tribromo methanesulfonyl benzene), 10 kg of an aqueous 20 wt % solution of modified polyvinyl alcohol (Poval MP203, manufactured by Kuraray Co.), 0.4 kg of an aqueous 20 wt % solution of sodium triisopropyl naphthalene sulfonate and 14 kg of water were added and mixed thoroughly to form a slurry. The slurry was fed by a diaphragm pump and dispersed in a horizontal type sand mill filled with zirconia beads of an average diameter of 0.5 mm (UVM-2: manufactured by IMEX Co.) for 5 hours and then 0.2 g of sodium salt of benzoisothiazolinone and water were added to prepare such that concentration of the organic polyhalogen compound was 30 wt %, to obtain an organic polyhalogen compound-1 dispersion. The thus obtained organic trihalogen compound particles contained in the organic trihalogen compound dispersion had a median diameter of 0.41 μm and a maximum particle size of 2.0 μm or less. The obtained organic polyhalogen compound dispersion was filtered through a polypropylene filter having a pore size of 10.0 μm to remove obstacles such as dusts and stored.

<Preparation of Organic Polyhalogen Compound-2 Dispersion>

10 kg of an organic polyhalogen compound-2 (N-butyl-3-tribromo methane sulfonuyl benzoamide), 20 kg of an aqueous 10 wt % solution of modified polyvinyl alcohol (Poval MP203, manufactured by Kuraray Co.) and 0.4 kg of an aqueous 20 wt % solution of sodium triisopropyl naphthalene sulfonate were added and mixed thoroughly to form a slurry. The slurry was fed by a diaphragm pump and dispersed in a horizontal type sand mill filled with zirconia beads of an average diameter of 0.5 mm (UVM-2: manufactured by IMEX Co.) for 5 hours and then 0.2 g of sodium benzoisothiazolinone and water were added to prepare such that concentration of the organic polyhalogen compound was 30 wt %. The liquid dispersion was heated at 40° C. for 5 hours to obtain a polyhalogen compound-2 dispersion. The thus obtained organic polyhalogen compound particles contained in the organic polyhalogen compound dispersion had a median diameter of 0.40 μm and a maximum particle size of 1.3 μm or less. The obtained organic polyhalogen compound dispersion was filtered through a polypropylene filter having a pore size of 3.0 μm to remove obstacles such as dusts and stored.

7) Preparation of Phthalazine Compound Solution

<Preparation of Phthalazine Compound-1 Solution>

8 kg of modified polyvinyl alcohol MP 203 manufactured by Kuraray Co. was dissolved in 174.57 kg of water and then 3.15 kg of an aqueous 20 wt % solution of sodium triisopropyl naphthalene sulfonate and 14.28 kg of an aqueous 70 wt % solution of phthalazine compound-1 (6-isopropyl phthalazine) were added to prepare a 5 wt % solution of phthalazine compound-1.

8) Preparation of Mercapto Compound

<Preparation of Mercapto Compound-1 Aqueous Solution>

7 g of mercapto compound-1 (1-(3-sulfophenyl)-5-mercaptotetrazole sodium salt) was dissolved in 993 g of water to form an aqueous 0.7 wt % solution.

<Preparation of Mercapto Compound-2 Aqueous Solution>

20 g of mercapto compound-2 (1-(3-methylureido)phenyl-5-mercaptotetrazole) was dissolved in 980 g of water to form an aqueous 2.0 wt % solution.

9) Preparation of S-1 and S-2 Aqueous Solution

<Preparation of S-1 Aqueous Solution>

5 g of compound S-1 was dissolved in 995 g of water to prepare an aqueous 0.5 wt % solution.

<Preparation of S-2 Aqueous Solution>

5 g of compound S-2 was dissolved in 995 g of water to prepare an aqueous 0.5 wt % solution.

10) Preparation of Pigment-1 Dispersion

<Preparation of Pigment-1 Dispersion>

250 g of water was added to 64 g of C.I. Pigment Blue 60 and 6.4 g of DEMOL M manufactured by Kao Corp. and mixed thoroughly to form a slurry. 800 g of zirconia beads with an average diameter of 0.5 mm were provided, charged together with the slurry into a vessel and dispersed in a dispersing device (¼ G sand grinder mill, manufactured by Imex Co.) for 25 hours, and water was added to prepare such that the pigment concentrations was 5 wt %. The average particle size of the pigment particles contained in the obtained pigment dispersion was 0.21 μm.

11) Preparation of SBR Latex Liquid

<Preparation of SBR Latex Liquid>

An SBR latex was prepared as described below. 287 g of distilled water, 7.73 g of a surface active agent (Pionin A-43-S (manufactured by Takemoto Yushi Co.): solid content, 48.5%), 14.06 ml of 1 mol/L NaOH, 0.15 g of tetrasodium ethylenediamine tetraacetate, 255 g of styrene, 11.25 g of acrylic acid and 3.0 g of tert-dodecylmercaptane were charged in a polymerization vessel of a gas monomer reaction device (model TAS-2J, manufactured by Taiatsu Glass Industry Co.), the reaction vessel was tightly closed and stirred at a stirring speed of 200 rpm. After evacuating by a vacuum pump and repeating nitrogen gas substitution for several times, 108.75 g of 1,3-butadiene was charged under pressure and the temperature was elevated to an internal temperature of 60° C. A solution containing 1.875 g of ammonium persulfate dissolved in 50 ml of water was added and stirred for 5 hours as it was. Further, stirring was conducted for three hours under temperature elevation to 90° C., and after completing the reaction and after lowering the internal temperature to a room temperature, NaOH and $NH_4OH$ each at 1 mol/L were used and added such that $Na^+$ ion:$NH_4^+$ ion=1:5.3 (molar ratio) to adjust the pH to 8.4. Then, the filtration was conducted by a polypropylene filter with a pore size of 1.0 μm to remove obstacles such as dusts and stored to obtain 774.7 g of an SBR latex. When halogen ions were measured by ion chromatography, chloride ion concentration was 3 ppm. As a result of measuring the concentration of a chelating agent by high speed liquid chromatography, it was 145 ppm.

The latex had an average particle size of 90 nm, Tg=17° C., a solid concentration of 44 wt %, an equilibrium water content of 0.6 wt % at 25° C., 60% RH, an ionic conductivity 4.80 mS/cm (ionic conductivity was measured by using a conductivity meter CM-30S manufactured by Toa Denpa Industry Co. for latex stock solution (44 wt %) at 25° C.), and pH was 8.4.

1-3-2 Preparation of Coating Solution

1) Preparation of image forming layer coating solution-1

To 1,000 g of the fatty acid silver salt dispersion described above and 276 ml of water, were added pigment-1 dispersion, organic polyhalogen compound-1 dispersion, organic polyhalogen compound-2 dispersion, phthalazine compound-1 solution, SBR latex liquid (Tg: 17° C.), reducing agent-1 dispersion, reducing agent-2 dispersion, hydrogen bonding compound-1 dispersion, development accelerator-1 dispersion, development accelerator-2 dispersion, color toning agent-1 dispersion, mercapto compound-1 aqueous solution, mercapto compound-2 aqueous solution, additive S-1 aqueous solution and additive S-2 aqueous solution successively, and silver halide emulsion mixture A was added just before coating and mixed thoroughly to form an emulsion layer coating solution, which was fed as it was to a coating dye and coated.

The viscosity of the image forming layer coating solution was 25 [mPa·s] at 40° C. (No. 1 rotor 60 rpm) when measured by a B-type viscometer of Tokyo Keiki.

The viscosity of the coating solution at 25° C. by using RFS fluid spectrometer manufactured by Rheometrix Far East Co. was 242, 65, 48, 26, and 20 (mPa·s) at the shearing rate of 0.1, 1, 10, 100, and 1000 (1/sec) respectively.

The amount of zirconium in the coating solution was 0.52 mg per 1 g of silver.

2) Preparation of Intermediate Layer Coating Solution on Image Forming Layer 27 ml of an aqueous 5 wt % solution of aerosol OT (manufactured by American Cyanamid Co.) and 135 ml of an aqueous 20 wt % solution of diammonium phthalate salt were added to 1000 g of polyvinyl alcohol PVA-205 (manufactured by Kuraray Co.), 272 g of pigment-1 dispersion, and 4200 ml of a 19 wt % solution of methylmethacrylate/styrene/butyl acrylate/hydroxyethyl methacrylate/acrylic acid copolymer (copolymerization weight ratio 64/9/20/5/2), and made up with water to a total amount of 10,000 g, which was controlled to pH 7.5 with NaOH to form an intermediate layer coating solution and fed to a coating die so as to be 9.1 ml/$m^2$.

The viscosity of the coating solution was 58 [mPa·S] when measured by a B-type viscometer at 40° C. (No. 1 rotor, 60 rpm).

3) Preparation of First Layer Coating Solution for Surface Protection Layer 64 g of inert gelatin was dissolved in water, to which were added 112 g of 19.0 wt % liquid latex of methyl methacrylate/styrene/butyl acrylate/hydroxyethyl methacrylate/acrylic acid copolymer (copolymerization weight ratio 64/9/20/5/2), 30 ml of a 15 wt % methanol solution of phthalic acid, 23 ml of an aqueous 10 wt % solution of 4-methyl phthalic acid, 28 ml of sulfuric acid at 0.5 mol/L concentration, 5 ml of an aqueous 5 wt % solution of aerosol OT (manufactured by American Cyanamid Co.), 0.5 g of phenoxy ethanol, and 0.1 g of benzoisothiazolinone, and made up with addition of water to the total amount to 750 g to form a coating solution, to which 26 ml of 4 wt % chromium alum was mixed immediately before coating by a static mixer, which was fed to a coating dye so as to be 18.6 ml/m$^2$.

The viscosity of the coating solution was 20 [mPa·S] when measured by a B-type viscometer at 40° C. (No. 1 rotor, 60 rpm).

4) Preparation of a Second Layer Coating Layer Solution for Surface Protection Layer 80 g of inert gelatin was dissolved in water, to which were added 102 g of 27.5 wt % liquid latex of methyl methacrylate/styrene/butyl acrylate/hydroxyethyl methacrylate/acrylic acid copolymer (copolymerization weight ratio 64/9/20/5/2), 5.4 ml of an aqueous 2 wt % solution of fluoro surface active agent (F-1), 5.4 ml of a 2 wt % solution of fluoro surface active agent (F-2) and 23 ml of an aqueous 5 wt % solution of aerosol OT (manufactured by American Cyanamid Co.), 4 g of fine polymethyl methacrylate particles (average particle size of 0.7 μm), 21 g of fine polymethyl methacrylate particles (average particle size of 4.5 μm), 1.6 g of 4-methylphthalic acid, 4.8 g of phthalic acid, 44 ml of sulfuric acid at 0.5 mol/L concentration, and 10 mg of benzoisothiazolinone, and made up with water was to the entire amount to 650 g, and 445 ml of an aqueous solution containing 4 wt % of chromium alum and 0.67 wt % of phthalic acid was mixed just before coating by a static mixer, which is used as the surface protection layer coating solution and was fed to a coating dye so as to provide 8.3 ml/m$^2$.

The viscosity of the coating solution was 19 [mPa·S] when measured by a B-type viscometer at 40° C. (No. 1 rotor, 60 rpm).

1-4 Preparation of Photothermographic Materials 1–12

<Preparation of Photothermographic Materials 1–6>

On the back side of the undercoated support, were coated an anti-halation layer coating solution at a gelatin coating amount of 0.88 g/m$^2$ and a back surface protection layer coating solution at a gelatin coating amount of 1.2 g/m$^2$ by simultaneous stack coating, and dried to prepare a back layer.

An image forming layer, an intermediate layer, a surface protection first layer, and a surface protection second layer were coated in this order from the undercoat layer on the surface opposite to the back surface by simultaneous stack coating by a slide bead coating method to prepare a specimen for a photothermographic material. The temperature was controlled at 31° C. for the image forming layer and the intermediate layer, at 36° C. for the surface protection first layer and at 37° C. for the surface protection second layer.

The coating amount (g/m$^2$) for each of the compounds in the image forming layer is as described below. The coating amount (g/m$^2$) for each of the compounds in the image forming layer is as described below.

| | |
|---|---|
| Silver fatty acid salt | 5.27 |
| Pigment (C. I. Pigment Blue 60) | 0.036 |
| Polyhalogen compound-1 | 0.09 |
| Polyhalogen compound-2 | 0.14 |
| Phthalazine compound-1 | 0.18 |
| SBR latex | 9.43 |
| Reducing agent-1 | 0.55 |
| Reducing agent-2 | 0.22 |
| Hydrogen bonding compound-1 | 0.28 |
| development accelerator-1 | 0.025 |
| development accelerator-2 | 0.020 |
| Color toning agent-1 | 0.008 |
| Mercapto compound-1 | 0.002 |
| Mercapto compound-2 | 0.006 |
| Additive S-1 | 0.001 |
| Additive S-2 | 0.002 |

Silver Halide (as Ag) (Silver Halide Coating Amounts Were as Shown in Table 1, Respectively, for Photothermographic Material)

Drying and coating conditions are as described below.

The support was charge-eliminated by ionic blow before coating, and coating was conducted at a speed of 160 m/min. Coating and drying conditions were controlled within the following ranges for each of the specimen and set to conditions capable of obtaining most stable surface state.

A gap between the coating die top end and the support was set to 0.10 to 0.30 mm and the pressure in a pressure reduction chamber was set lower by 196–882 Pa to an atmospheric pressure.

In a succeeding chilling zone, the coating solution was cooled by a blow at a dry bulb temperature of 10 to 20° C. and then it was conveyed in a non-contact manner, and dried in a helical non-contact type drying apparatus by a drying blow at a dry bulb temperature of 23 to 45° C. and at a wet bulb temperature of 15 to 21° C.

After drying, and controlling the humidity to 40 to 60% RH at 25° C., the film surface was heated to 70 to 90° C. After heating, the film surface was cooled down to 25° C.

The degree of matting of the prepared photothermographic material according to Bekk smoothness was 550 sec on the side of the image forming layer and 130 sec on the back surface. Further, when pH at the film surface on the side of the image forming layer was measured, it was 6.0.

Photothermographic materials 1–6 were obtained as described above.

<Preparation of Photothermographic Materials 7 to 12>

Photothermographic materials 7 to 12 were prepared in the same manner as for the Photothermographic materials 1 to 6 except for using the mixed emulsion A for coating instead of the silver halide emulsion 1, with the coating amount of the silver halides being as described in Table 1, respectively, to prepare photothermographic materials 7 to 12.

Chemical structures of the compounds used in the examples of the present invention are shown below.

Tellurium sensitizer C
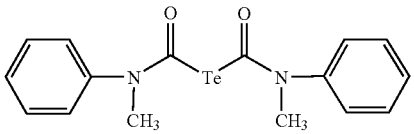
Blue dye compound-1
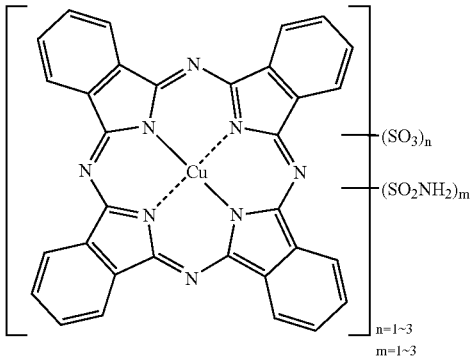
Yellow dye compound-1
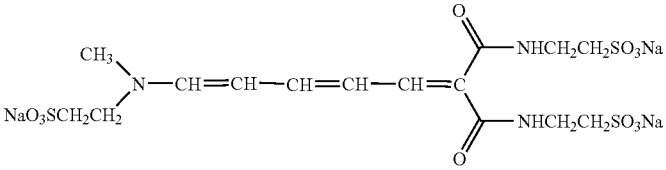
(Reducing agent-1)
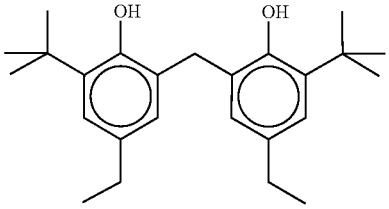
(Reducing agent-2)
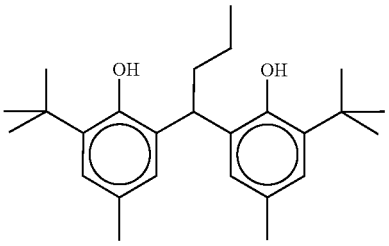
(Hydrogen bonding compound-1)
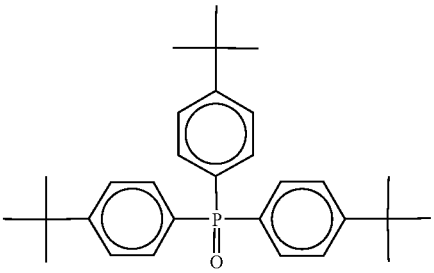
(Polyhalogen compound-1)
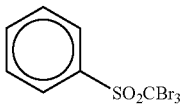
(Polyhalogen compound-2)
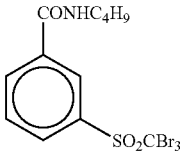
(Phthalazine compound-1)
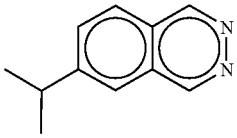
(development accelerator-1)
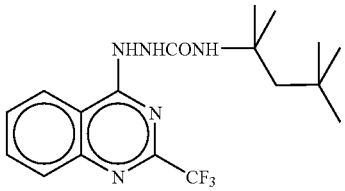
(development accelerator-2)
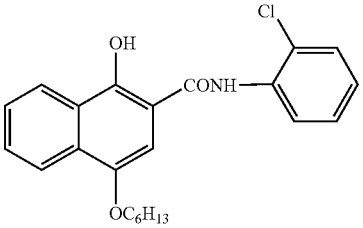
(Color toning agent-1)
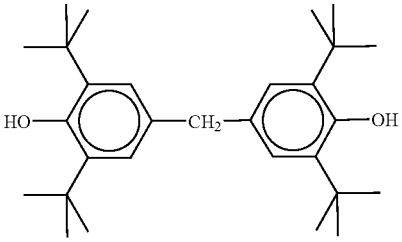
(S-1)
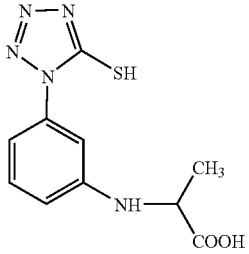

-continued (S-2)

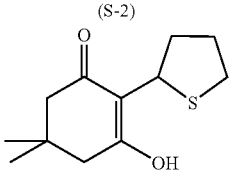

(F-1)

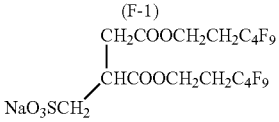

(F-2)

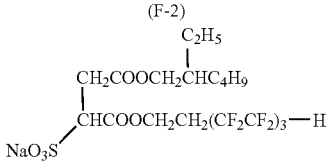

1-5 Evaluation for Photothermographic Materials 1 to 12

Each of the specimens for the photothermographic materials 1 to 12 obtained as described above was evaluated as described below.

(Exposure of Photosensitive Material)

Each of the specimens of the photothermographic materials 1 to 12 was put to exposure processing as described below.

In the exposure station of a Fuji medical dry laser imager FM-DPL, NLHV 3000E semiconductor laser of a Nichia Kagaku Kogyo was mounted as a semiconductor laser light source and a beam diameter was restricted to about 100 μm. The photosensitive materials were exposed for $10^{-6}$ sec while changing the illuminance by the laser beam on the photosensitive material surface between 0 and 1 to 1000 $mW/mm^2$. The light emitting wavelength of the laser light was 405 nm. (Heat development treatment for photosensitive material) The thus exposed photosensitive materials were applied with heat development processing as described below.

In the heat development station of Fuji medical dry laser imager FM-DPL, four panel heaters were set to 112° C.–115° C.–119° C.–123° C., and heat development was conducted such that the heat development time in total was 13 sec, 14 sec and 15 sec by increasing the film conveying speed.

(Evaluation for Specimen)

The density of the obtained images was measured by a densitometer to prepare characteristic curves for the density relative to the logarithms of the exposure amount. The reciprocal to the exposure amount for providing the optical density at density 2 was defined as sensitivity. In Table 1, assuming the sensitivity at 14 sec of the heat development time as 100 for each of the photosensitive materials, the sensitivities for the heat development time of 13 sec and 15 sec were expressed by relative values. As the ratio of the sensitivity value for 13 sec, 14 sec and 15 sec approaches 1, scattering is smaller and it is more preferred.

For each of the development specimens, L*, a*, b* in the CIELAB calorimetric system of Commission Internationale de I'Eclairage (CIE) were determined as values according to the specification of JIS Z 8719 by a spectral colorimetric densitometer as values at a test light F5 (daylight color). Color difference was calculated according to the equation (E) for the case of the heat development time of 14 sec and the case of the heat development time of 13 sec and 15 sec, and the values at the intermediate density portions (D=1.5) were described in Table 1. For the color tone storability, the color difference was calculated in the same manner as that described above just after the development and after 1d store in a light shielded circumstance at 40° C., 40% RH, and described in Table 1.

Color difference for the specimen 1 and specimen 2 is expressed by the following equation (E).

$$\Delta E=[(L_2^*-L_1^*)^2+(a_2^*-a_1^*)^2+(b_2^*-b_1^*)^2]^{1/2} \quad \text{Equation (E)}$$

in which $L_1^*$, $a_1^*$, $b_1^*$ and $L_2^*$, $a_2^*$, $b_2^*$ represent the amount with respect to the metric lightness, hue and saturation in the CIELAB space (color coordinate) for specimens 1 and 2.

The results are shown in Table 1.

TABLE 1

| No. | Silver halide composition | Average particle size [nm] | AgX silver coating amount [g/m²] | Sensitivity to developing time 13 sec | 14 sec | 15 sec | Color difference to developing time (ΔE) 13 sec | 14 sec | 15 sec | Color storability (ΔE) | Remark |
|---|---|---|---|---|---|---|---|---|---|---|---|
| 1 | AgBr96.5 I3.5 | 29 nm | 0.007 | 92 | 100 | 107 | 0.69 | 0.58 | 0.97 | | Comparative Example |
| 2 | AgBr96.5 I3.5 | 29 nm | 0.01 | 93 | 100 | 107 | 0.74 | 0.59 | 1.03 | | Comparative Example |
| 3 | AgBr96.5 I3.5 | 29 nm | 0.04 | 93 | 100 | 106 | 0.77 | 0.62 | 1.01 | | Comparative Example |
| 4 | AgBr96.5 I3.5 | 29 nm | 0.1 | 93 | 100 | 106 | 0.79 | 0.63 | 1.01 | | Comparative Example |
| 5 | AgBr96.5 I3.5 | 29 nm | 0.4 | 92 | 100 | 107 | 0.84 | 0.61 | 1.02 | | Comparative Example |
| 6 | AgBr96.5 I3.5 | 29 nm | 0.5 | 92 | 100 | 108 | 0.81 | 0.56 | 1.10 | | Comparative Example |
| 7 | AgI100 | 29 nm | 0.007 | 99 | 100 | 100 | 0.29 | 0.31 | 0.54 | | Invention |
| 8 | AgI100 | 29 nm | 0.01 | 98 | 100 | 101 | 0.34 | 0.38 | 0.64 | | Invention |
| 9 | AgI100 | 29 nm | 0.04 | 98 | 100 | 101 | 0.37 | 0.41 | 0.74 | | Invention |
| 10 | AgI100 | 29 nm | 0.1 | 97 | 100 | 102 | 0.41 | 0.44 | 0.87 | | Invention |

TABLE 1-continued

| No. | Silver halide composition | Average particle size [nm] | AgX silver coating amount [g/m$^2$] | Sensitivity to developing time 13 sec | 14 sec | 15 sec | Color difference to developing time (ΔE) 13 sec | 14 sec | Color storability (ΔE) 15 sec | Remark |
|---|---|---|---|---|---|---|---|---|---|---|
| 11 | AgI100 | 29 nm | 0.4 | 95 | 100 | 103 | 0.47 | 0.51 | 1.02 | Invention |
| 12 | AgI100 | 29 nm | 0.5 | 92 | 100 | 107 | 0.84 | 0.74 | 1.13 | Comparative Example |

As shown in Table 1, it can be seen that the high silver iodide content photosensitive material, different from silver iodo bromide photosensitive material, can reduce the scattering in the sensitivity and the color tone depending on the developing time and can improve the storability of the color tone.

The present invention can provide an image forming material showing less scattering in the sensitivity and the color tone depending on the developing time and also favorable in view of the storability of the color tone in the photosensitive material using the high silver iodide.

What is claimed is:

1. A photothermographic material containing, on a substrate, at least a photosensitive silver halide having an average particle size of 5 nm to 40 nm, a non-photosensitive organic silver salt comprising silver behenate in an amount of 40 mol % to 99 mol %, a reducing agent which contains a compound represented by general formula (R):

General formula (R)

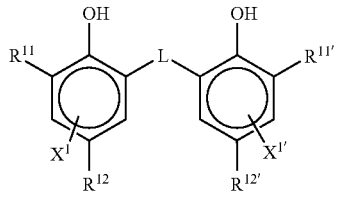

in which $R^{11}$ and $R^{11'}$ each represents independently an alkyl group of 1 to 20 carbon atoms, $R^{12}$ and $R^{12'}$ each represents independently an alkyl group of 1 to 20 carbon atoms, L represents an —S— group or —$CHR^{13}$— group, $R^{13}$ represents a hydrogen atom or an alkyl group of 1 to 20 carbon atoms, and $X^1$ and $X^{1'}$ each represents independently a hydrogen atom or a group capable of substitution on a benzene ring, and a binder in which the total silver iodide content of the photosensitive silver halide is 90 mol % to 100 mol %, and the coating amount of photosensitive silver halide in terms of an amount of silver is 0.005 g/m$^2$ to 0.05 g/m$^2$ wherein in the photosensitive silver halide is formed in a state where the non-photosensitive organic salt is not present and wherein the average γ-phase ratio of the photosensitive silver halide is 5 mol % to 90 mol %.

2. A photothermographic material according to claim 1, wherein $R^{11}$ and $R^{11'}$ in general formula (R) each represents independently a secondary or tertiary alkyl group of 3 to 15 carbon atoms.

3. A photothermographic material according to claim 1, which further comprising a compound represented by the following general formula (H):

$$Q—(Y)_N—C(Z_1)(Z_2)X \qquad \text{General formula (H)}$$

in which Q represents an alkyl group, aryl group or heterocyclic group, Y represents a bivalent connection group, N represents 0 or 1, $Z_1$ and $Z_2$ each represents a halogen atom, and X represents a hydrogen atom or an electron attractive group.

4. A photothermographic material according to claim 1, wherein the average γ-phase ratio of the photosensitive silver halide is 25 mol % to 50 mol %.

5. A photothermographic material according to claim 1, further comprising a compound in which a one-electron oxidant formed by one-electron oxidation can release one electron or more electrons.

6. A photothermographic material according to claim 1, wherein the non-photosensitive organic silver salt contains silver behenate in an amount of 65 mol % to 85 mol %.

7. A photothermographic material according to claim 1, further comprising a development accelerator.

8. A photothermographic material according to claim 1, further comprising a compound represented by the following general formula (D):

General formula (D)

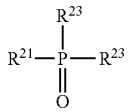

in which $R^{21}$ to $R^{23}$ each represents independently an alkyl group, aryl group, alkoxy group, aryloxy group, amino group or heterocyclic group.

9. An image forming method for a photothermographic material which comprises exposing a photothermographic material according to claim 1 by using a semiconductor laser having an emission peak intensity at a wavelength of from 350 nm to 450 nm as a light source.

10. An image forming method for a photothermographic material according to claim 9, wherein the exposure illuminance of the semiconductor laser is 1 mW/mm$^2$ or more.

11. An image forming method for the photothermographic material according to claim 9, wherein the exposure illuminance of the semiconductor laser is 10 mW/mm$^2$ to 50 mW/mm$^2$.

* * * * *